US009834998B2

(12) United States Patent
Holck

(10) Patent No.: US 9,834,998 B2
(45) Date of Patent: Dec. 5, 2017

(54) DUAL ACTIVITY OFF-SHORE DRILLING RIG

(71) Applicant: MAERSK DRILLING A/S, Copenhagen (DK)

(72) Inventor: Jesper Holck, Humlebaek (DK)

(73) Assignee: MAERSK DRILLING A/S, Copenhagen (DK)

( * ) Notice: Subject to any disclaimer, the term of this patent is extended or adjusted under 35 U.S.C. 154(b) by 0 days.

(21) Appl. No.: 14/891,808

(22) PCT Filed: May 20, 2014

(86) PCT No.: PCT/CA2014/050465

§ 371 (c)(1),
(2) Date: Nov. 17, 2015

(87) PCT Pub. No.: WO2014/186889

PCT Pub. Date: Nov. 27, 2014

(65) Prior Publication Data

US 2016/0090794 A1 Mar. 31, 2016

Related U.S. Application Data

(60) Provisional application No. 61/994,811, filed on May 16, 2014.

(30) Foreign Application Priority Data

May 20, 2013 (DK) ..... 2013 00303
Oct. 22, 2013 (DK) ..... 2013 70604
(Continued)

(51) Int. Cl.
*E21B 19/00* (2006.01)
*E21B 15/02* (2006.01)
(Continued)

(52) U.S. Cl.
CPC ..... *E21B 19/008* (2013.01); *E21B 15/02* (2013.01); *E21B 19/002* (2013.01); *E21B 19/02* (2013.01); *E21B 19/084* (2013.01)

(58) Field of Classification Search
CPC ..... E21B 15/02; E21B 19/002; E21B 19/008; E21B 19/02; E21B 19/084; E21B 19/004; E21B 19/006
See application file for complete search history.

(56) References Cited

U.S. PATENT DOCUMENTS 2,240,794 A * 5/1941 Conley ..... E21B 19/02 254/264
3,389,562 A * 6/1968 Mott ..... E02B 17/00 405/227
(Continued)

FOREIGN PATENT DOCUMENTS

EP 2378056 A2 10/2011
NL WO 2009102196 A2 * 8/2009 ..... B63B 35/4413
(Continued)

OTHER PUBLICATIONS

International Search Report (PCT/ISA/210) dated Jul. 28, 2014, by the Canadian Patent Office as the International Searching Authority for International Application No. PCT/CA2014/050465.
(Continued)

*Primary Examiner* — James G Sayre
(74) *Attorney, Agent, or Firm* — Buchanan Ingersoll & Rooney PC

(57) ABSTRACT

An offshore drilling rig configured for lowering and/or raising a string of tubular equipment into a subsea borehole. The drilling rig includes a drill deck; a first hoisting system being adapted for raising or lowering a first load carrier along a vertical first hoisting axis, wherein the first hoisting system is supported by a first support structure extending upwardly relative to the drill deck; a second hoisting system being adapted for raising or lowering a second load carrier
(Continued)

along a vertical second hoisting axis located apart from the first hoisting axis, wherein the second hoisting system is supported by a second support structure extending upwardly relative to the drill deck; and a joint operations well center on the drill deck. During joint operations, the first and second hoisting axes are preferably located apart from the joint operations well center.

39 Claims, 29 Drawing Sheets

(30) Foreign Application Priority Data

| | | |
|---|---|---|
| Jan. 13, 2014 | (WO) | PCT/EP2014/050509 |
| Jan. 13, 2014 | (WO) | PCT/EP2014/050510 |
| Mar. 17, 2014 | (DK) | 2014 70131 |
| Mar. 17, 2014 | (WO) | PCT/EP2014/055307 |
| Mar. 17, 2014 | (WO) | PCT/EP2014/055312 |
| May 16, 2014 | (DK) | 2014 00266 |

(51) Int. Cl.
*E21B 19/02* (2006.01)
*E21B 19/084* (2006.01)

(56) References Cited

U.S. PATENT DOCUMENTS

| | | | | |
|---|---|---|---|---|
| 4,128,229 | A | 12/1978 | Elliston | |
| 4,417,846 | A | 11/1983 | Elliston | |
| 4,423,994 | A | 1/1984 | Schefers et al. | |
| 4,585,213 | A | 4/1986 | Slagle, Jr. et al. | |
| 4,899,832 | A | 2/1990 | Bierscheid, Jr. | |
| 5,762,279 | A * | 6/1998 | Horton, III | E21B 19/02 254/285 |
| 6,047,781 | A * | 4/2000 | Scott | B63B 35/4413 175/5 |
| 6,217,258 | B1 * | 4/2001 | Yamamoto | E21B 15/02 175/5 |
| 6,412,576 | B1 | 7/2002 | Meiners | |
| 7,584,810 | B1 | 9/2009 | McKnight, Jr. et al. | |
| 9,045,948 | B2 | 6/2015 | Roodenburg et al. | |
| 2003/0056993 | A1 | 3/2003 | Smith | |
| 2010/0147524 | A1 * | 6/2010 | Springett | E21B 19/14 166/313 |

FOREIGN PATENT DOCUMENTS

| | | | |
|---|---|---|---|
| WO | 9742393 | A1 | 11/1997 |
| WO | WO 97/42393 | A1 | 11/1997 |
| WO | WO 02/057593 | A1 | 7/2002 |
| WO | 2012/087119 | A1 | 6/2012 |
| WO | WO 2014/140369 | A2 | 9/2014 |

OTHER PUBLICATIONS

Search Report issued in corresponding Danish Patent Application No. PA 2015 00775, dated Nov. 2, 2016 (4 pages).

* cited by examiner

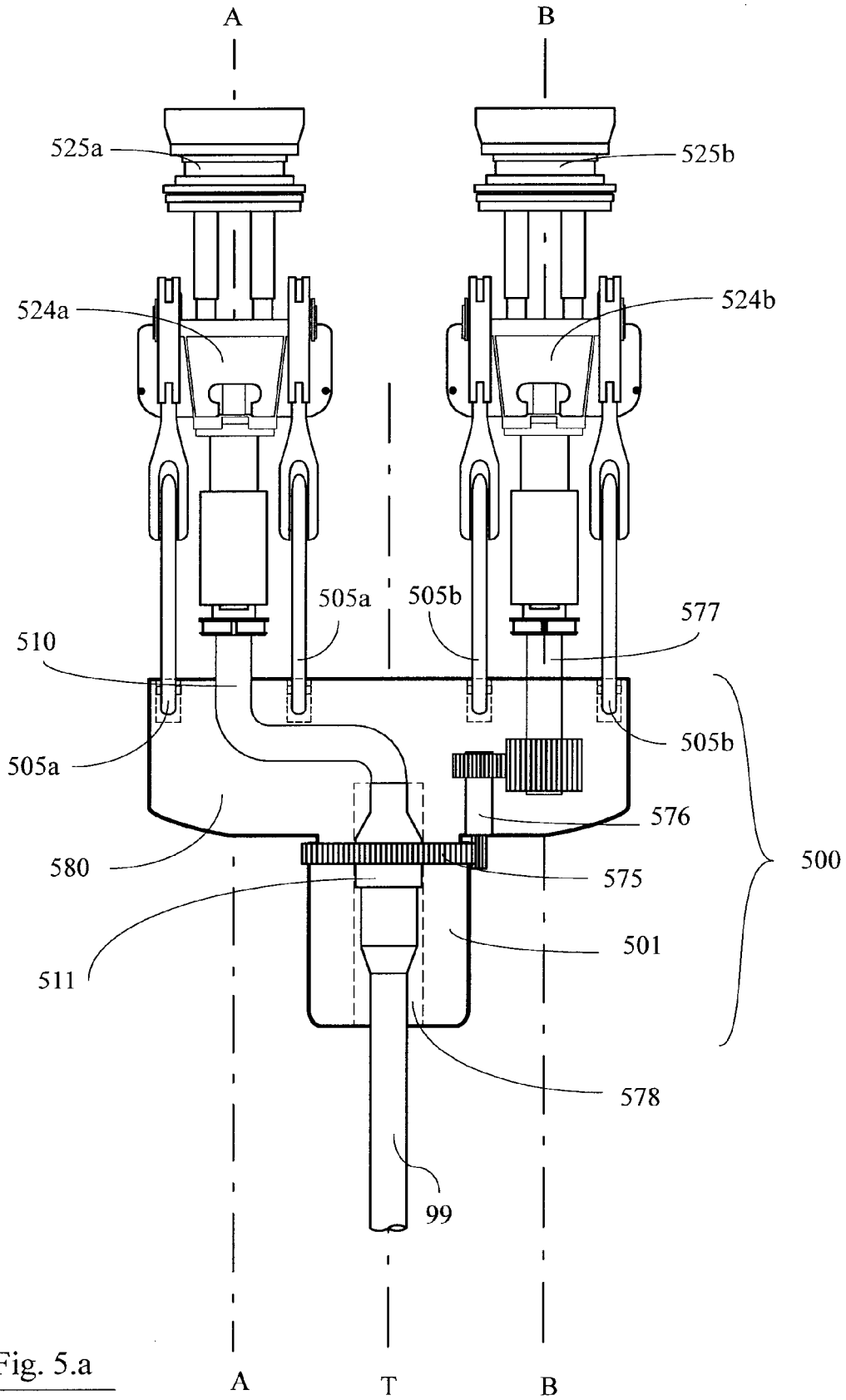
Fig. 5.a

DUAL ACTIVITY OFF-SHORE DRILLING RIG

The present invention relates in one aspect to an offshore drilling rig. The drilling rig comprises a drill deck, and first and second hoisting systems. The first hoisting system is adapted for raising or lowering a first load carrier along a vertical first hoisting axis. The second hoisting system is adapted for raising or lowering a second load carrier along a vertical second hoisting axis horizontally spaced apart from the first hoisting axis by a hoisting axis distance. The first and the second hoisting systems are supported by a drilling support structure extending upwardly relative to the drill deck.

In a further aspect, the present invention relates to an assembly for use during operations of raising or lowering a string of tubular equipment in a subsea borehole in an offshore drilling rig of the above-mentioned kind.

In yet a further aspect, the present invention relates to a connecting tool for use during operations of raising or lowering a string of tubular equipment in a subsea borehole in an offshore drilling rig of the above-mentioned kind.

In yet a further aspect, the present invention relates to a bail section for use during operations of raising or lowering a string of tubular equipment in a subsea borehole in an offshore drilling rig of the above-mentioned kind.

In another aspect, the present invention relates to a method of lowering and/or raising a string of tubular equipment into a subsea borehole through a joint operations well centre in a drill deck of an offshore drilling rig,

BACKGROUND OF THE INVENTION

Lowering and/or raising a string of tubular equipment into a subsea borehole is a critical operation during drilling, or when e.g. preparing and/or closing a well for production. Such strings of tubular equipment may comprise casing and/or liner pipes placed in the borehole for stabilization of the borehole, protection of the formation or for optimizing a drilling operation. In order to reach larger depths, a string of casing and/or liner pipes may be suspended from a so-called landing string during any such lowering and/or raising operations. The operations require using the string building, lifting, drilling mud handling, and rotating functions of the facilities around the well centre. With boreholes achieving larger and larger depths, and with offshore drilling operations being performed where the top of the borehole is located on the sea floor at greater and greater depths of the sea, ever longer strings of tubular equipment have to be placed into the borehole or recovered therefrom. However, as the strings of tubular equipment to be handled during such operations get longer and longer, the total weight of the combined string may easily exceed 1000 metric tons, thereby reaching the load rating limits of much of the equipment in the configurations that are typically available on an offshore drilling rig.

One load limiting component is the top-drive commonly used on modern drilling rigs, which in addition to driving the rotation of e.g. a drill string during a drilling operation often also provides numerous other functionalities, such as a so-called link-tilt function used for an efficient and at least partially automated building of a string of tubular equipment, and/or mud handling functions for e.g. filling drilling mud into the string of tubular equipment as the tubular equipment is lowered into a borehole while being suspended in a load bearing device attached to the top drive. Such functions are typically a part of the so-called pipe handler hanging under the top drive. For the purpose to the present invention this pipe handler is considered an optional part of the top drive. The pipe handler typically uses interchangeable bails and pipe elevators to handle different types of tubulars. The top drive is typically suspended from a load carrier of a hoisting system, which provides the actual lifting functionality. The top drive is thus a load carrying link between the load carrier of the hoisting system and the heavy tubular string. In such a set-up, the safe working load rating of the top drive is typically the limiting factor and is often used as a design specification for designing the load capacity of the remaining components of such a system. While top drives with larger and larger SWL ratings become available on the market, these tend to be over-dimensioned for most of the primary applications for which top-drives are used in practice, and are therefore much more inefficient than a top-drive that is properly dimensioned for these primary applications.

Other load limitations may be inferred from e.g. the hoisting systems and the support structure supporting the hoisting system.

One object of the present invention is to provide a heavy duty system for lowering and/or raising tubular equipment during offshore drilling operations, which allows overcoming such load limitations in an efficient manner. Another object is to provide a cheaper, faster and/or more reliable rig where two hoisting systems of lower capacity (typically cheaper and/or faster relative to systems with a higher load rating) can work individually on most parts of a well and optionally provide redundancy and/or improved efficiency by having two hoisting system. For parts of the well where the drilling operation which may exceed the load capacity of the individual hoisting systems (such as running heavy casing) the hoisting systems may be arranged to perform this job in cooperation.

According to a first aspect of the invention this object is achieved by an offshore drilling rig configured for lowering and/or raising a string of tubular equipment into a subsea borehole as defined below. According further aspects, the object is achieved by an assembly, a connecting tool and a bail section for use in an offshore drilling rig, and a method of lowering and/or raising a string of tubular equipment into a subsea borehole through a joint operations well centre in a drill deck of an offshore drilling rig, as further detailed below.

SUMMARY

Definitions

An offshore drilling rig may be any vessel that includes machinery and equipment used for drilling a well. The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively the offshore rig may be of a different type, such as bottom-supported drilling rig, e.g. a jack-up drilling rig, or a drill ship or other type of drilling vessel.

The drilling rig is operable to lower and/or raise a string of tubular equipment in a subsea borehole, such as casing and/or liner. The lowering and/or raising operations are performed at the well centre of the drill deck in the offshore drilling rig.

Moreover, the drilling rig comprises a hoisting system, top drive and/or other equipment configured to operate through the well centre and to perform drilling operations in the seabed.

For the purpose of this description, the term drill deck is intended to refer to the deck of an operating platform of an offshore drilling rig immediately above which joints of tubulars are assembled to form the drill string which is advanced through the well centre towards the seabed. Hence the drill deck is the primary work location for the rig crew and/or machines performing similar functions, such as iron roughnecks. The drill deck normally comprises at least one rotary table for supporting and/or rotating a drill string during drilling operations. For the purpose of the present description, the term drill deck includes the drill floor located directly under/next to the mast and surrounding the well centre as well as deck areas on the same level as, and connected with, the drill floor area by uninterrupted floor area on the same level, i.e. the floor area where human operators and movable equipment such as forklifts, equipment moved on skid beams, etc. can move around and to/from the well centre; in some embodiments without having to climb/descend stairs or other elevations. The drill deck is typically the floor of a platform, e.g. the lowest platform, above the diverter system.

The term well centre refers to a hole in the drill deck through which the drilling rig is configured to lower tubulars all the way to the seabed and/or through which the drilling rig can perform drilling into the seabed. A well centre is sometimes also referred to as a drilling centre. Different tools may be inserted into or supported from the well centre, such as power-slips or other equipment. In some embodiments, a well centre comprises a rotary table or a similar device allowing a drill string to be suspended by the well centre; to this end, a well centre may comprise power slips or other devices operable to engage tubular equipment and to support the weight of the tubular equipment so as to prevent the tubular equipment from descending through the well centre. It will be appreciated that the drill deck may comprise additional holes such as foxholes and mouse holes that may e.g. be used for building stands of tubulars, but through which the drilling rig cannot lower tubulars to the seabed and/or through which the drilling rig cannot either run and set casing into a well and/or perform drilling into the seabed e.g. by lacking a system arranged to rotate a drill string with sufficient force such as a top drive or a rotary table. In some embodiments the hoisting axis hoisting systems (e.g. the lines of the hoisting system) and/or the well centres are movable, a hole in the drilling deck is in some embodiments considered a well center when the drilling rig is arranged to allow the provision of the necessary equipment over the well centre to provide drilling into the seabed such as a hoisting axis of a hoisting system and a top drive. For the case of the joint operations well centre, the drilling rig will in some embodiments not be arranged to have drilling capability through this well centre. Instead the rig will be arranged to allow running of casing into a well, typically through a riser connected to the joint operation well centre. This capability may be provided via suitable slips (and/or arrangement for receiving such slips) e.g. in a rotary table for hanging of a tubular string of casing and/or drill string, landing string etc., by provision of a connecting tool aligning a tool axis thereof with the joint operation well centre and/or the ability to receive a riser e.g. by having a diverter connected to the well centre below the drill deck.

Tubular elements are often simply referred to as "tubulars".

The term tubular equipment is intended to refer to tubular equipment that is advanced through the well centre towards the sea floor during one or more stages of the drilling operation. The tubular equipment may be selected from drill pipes and/or other tubular elements of the drill string, risers, liners and casings. Examples of tubular elements of the drill string include drill pipes, drill collars, etc. In the context of the present invention drill pipe is (unless related to actual drilling) synonymous with land string, heavy drill pipe and other tubulars having substantially the same outer profile as drill pipe.

For the purpose of the present description, the term drilling support structure is intended to refer to any construction extending upwardly relative to the drill deck and being equipped for supporting a hoisting system for hoisting and lowering tubulars (such as drill strings, casings and/or risers) towards the seabed so that drilling into the seabed can be performed. The drilling support structure may extend from the drill deck or from a deck different to the drill deck. The hoisting system is in this relation any system that provides a lifting capacity above the drill deck. This may, in some embodiments, be in the form of a hydraulic hoisting system comprising upwardly extending cylinders for supporting the load to be hoisted or lowered, typically via cable sheaves mounted on top of the cylinders or, alternatively, it may be in the form of a conventional draw works system. Examples of a drilling support structure includes a derrick structure which is typically applied to support a draw works hoisting system and a mast structure which is typically applied to support a cylinder hoisting system. In embodiments where the drilling support structure is located adjacent to a well centre, the drilling rig may be arranged in a number of different configurations, including a face-to-face configuration where the well centres are located horizontally between the respective support structures, in a back-to-back configuration where the drilling support structures are located horizontally between the respective well centres, or in a side-by-side configuration where the drilling support structures are located on one side of an axis connecting multiple well centres.

In some embodiments, a longitudinal direction may be defined in the plane of the drill floor deck as a direction extending through the first well centre and through the position of the first hoisting system. In some embodiments, the position of the first hoisting system within the plane of the drill floor deck may be defined as a position of a centre of mass of the top sheave of the first hoisting system over which the hoist lines of the first hoisting system are run. In some embodiments of a cylinder hoisting system, the top sheave is a traveling sheave supported and pushed upwards by the cylinders. In draw works and mast system the top is typically fixed to the mast. In a draw works-and-derrick system the top sheave is typically a fixed sheave in the crown block. In many embodiments, the rig is equipped with a top drive arranged to rotate drill strings and lower them through the first well centre; the top drive is arranged to be lifted by the first hoisting system. To keep the top drive from rotating a guide-dolly is typically arranged to slide along a vertically extending rail or rails while being connected to the top drive. In some embodiments the longitudinal direction may thus be defined in the plane of the drill floor deck as a direction extending through the first well centre and through the position of this rail or, in case of multiple rails, a centre point of said rails. In some embodiments the centre point is calculated by weighing the position of each of the rails with fraction of the rotational force from the top drive that the rails absorb. Similarly, a transverse direction may be defined within the plane of the drill floor deck as extending normal to the longitudinal direction.

In some embodiments, the drilling rig is a dual (or even multiple) activity rig where more than one drilling operations may be performed through two or even more separate work centres, one, some or all of which may be well centres. In some embodiments, in addition to a well centre for performing primary drilling operations, an additional work centre may be a hole in the drill floor through which tubulars may be lowered but through which tubulars may not necessarily be lowered all the way to the seabed. Such a work centre may even comprise a bottom which prevents tubulars from inadvertently fall to the seabed. Alternatively or additionally, one or more additional work centres may be well centres as described above. To this end, in some embodiments, the offshore drilling rig further comprises a second work centre such as a second well centre displaced from the first well centre, optionally a second mast upwardly extending relative to the drill floor deck, and a second hoisting system supported by the second mast and configured for hoisting and lowering tubular equipment through the second work centre. In some embodiments, the positions of the first well centre and the second work centre together define a transverse direction within the plane of the drill floor deck; the first and second masts may be arranged side by side in the transverse direction or in another suitable configuration. The two masts may be integrated into one mast. In some embodiments, the position of the second work centre is placed substantially along the longitudinal direction; the first and second masts may be arranged opposite each other.

Hence, efficient dual (or even multiple) drilling activities may be carried out, and drilling crew and equipment may conveniently be moved between the well centres. Furthermore, operations at both the first well centre and the second work centre may conveniently be monitored and/or controlled, e.g. from a single control room having a direct line of sight to both the first well centre and the second work centre. Moreover, the first well centre and the second work centre may be used as back-up/replacement for each other in a convenient manner, because storage areas, pipe handling equipment etc. serving both the first well centre and the second work centre may be arranged to efficiently serve/cooperate with both the first well centre and the second work centre. This is particularly the case when the second work centre is operable as a well centre. It will be appreciated that, during operation of embodiments of a drilling rig with two (or more) well centres, not all well centres may necessarily be capable of simultaneously accessing the same bore well.

In some embodiments the drilling rig comprises a first dolly that is vertically moveable attached to a vertically extending track, and a first top drive suspended by the first hoisting system attached to and guided by the first dolly and/or the drilling rig comprises a second dolly that is vertically moveable attached to a vertically extending track, and a second top drive suspended by the second hoisting system and attached to and guided by the second dolly. The dolly and track is referred to as the dolly system and the track is typically attached to a respective support structure of the corresponding hoisting system or to a respective portion of a common support structure. For such embodiments the drilling rig can be said to have the first and second well centre (with corresponding hoisting systems and top drives) configured in face-to-face, side-by-side or back-to-back configurations as discussed below. The drilling rig may also be arranged with angles and positions of well centres in between these three configurations as discussed below.

In some embodiments, the dolly system is offset with respect to the hoisting axis, wherein a front side of the dolly system faces towards the hoisting axis of the associated hoisting system, and a back side of the dolly system faces away from the hoisting axis. In such embodiments, a forward direction of the dolly system is defined as the direction from the position of the dolly system towards the hoisting axis.

Typically, a top drive is attached to the front side of the dolly system. In general, the position of the top drive in a vertical projection onto the plane of the drill deck may be defined as the position coordinate of the primary axis of operation. Typically during individual operation at a given well centre, the location of the top drive is aligned with the well centre. The forward direction of the dolly system thus corresponds to the longitudinal direction as defined above for embodiments with a dolly system.

When performing individual drilling or drilling related operations on a dual (or multiple) activity rig independently at a first well centre and a second well centre, the first and second hoisting axes are aligned with the respective well centres, and the hoisting plane is parallel to the well centre axis defined by location of the first and second well centres in the plane of the drill deck.

In some embodiments, at least one dolly system may be arranged to face with the forward direction parallel to the vertical hoisting plane defined by the first and second hoisting axes. For example, in a face-to-face configuration a dual activity drilling rig may comprise a first dolly system for guiding a first top drive along a first hoisting axis for operation at a first well centre and a second dolly system for guiding a second top drive along a second hoisting axis for operation at a second well centre, wherein the first and second dolly systems are both oriented with their forward directions parallel to the hoisting plane, and wherein the respective front sides of the first and second dolly systems face towards each other. In such a face-to-face configuration of the dolly systems, the first and second hoisting axes as well as the first and second work/well centres at which they operate, are located between the first and second dolly systems. As a further example, in a back-to-back configuration, the first and second dolly systems may both be oriented parallel to the hoisting plane, and the respective front sides of the first and second dolly systems face away from each other. In such a back-to-back configuration of the dolly systems, the first and second dolly systems are located between the first and second hoisting axes as well as between the first and second work/well centres at which they operate.

In some embodiments, at least one dolly system may be located at a distance from the hoisting plane and arranged to face with the forward direction in a sideways direction towards the hoisting plane. For example, in a side-by-side configuration a dual activity drilling rig may comprise a first dolly system for guiding a first top drive along a first hoisting axis for operation at a first well centre and a second dolly system for guiding a second top drive along a second hoisting axis for operation at a second well centre, wherein the first and second dolly systems are both oriented sideways with their forward direction pointing towards the hoisting plane, and wherein the first and second dolly systems are offset towards the same side of the hoisting plane. In a preferred embodiment with a side-by-side configuration, the first and second dolly systems face in the same direction, most preferably perpendicular to the hoisting plane.

Further according to some embodiments, the first and second hoisting systems comprise load carriers, which via cables are raised or lowered by suitable means, such as traditional draw works, or cylinder hoisting systems. The cables run through cable crowns with sheaves arranged at the top of the support structure. The cables running from the load carrier to the sheave follow vertically along the respective hoisting axis of the first and second hoisting systems. The respective sheave at the top deflects the cables in a direction away from the vertical. As seen in projection to a horizontal plan, the horizontal direction of deflection is determined by the sheave, namely perpendicular to the axis of rotation of the sheave.

In some embodiments of the drilling rig, the crown cluster sheaves of the first and second hoisting systems are oriented to rotate about an axis parallel to the vertical hoisting plane as defined by the vertical first and second hoisting axes, and the cables are deflected in a direction perpendicular to the hoisting plane. For example, the first and second hoisting systems may be configured to operate in a side-by-side configuration, where the cables of both the first and second hoisting systems are deflected in a direction perpendicular to the hoisting plane and towards the same side thereof. In some embodiments of the drilling rig, the rotation axes of the crown cluster sheaves are oriented perpendicular to the hoisting plane, and the cables are deflected in a direction parallel to the hoisting plane. In a face-to-face configuration of the hoisting systems, the cables of the first hoisting system are deflected from the vertical first hoisting axis in a direction parallel to the hoisting plane and away from the second hoisting axis, whereas the cables of the second hoisting system are deflected from the vertical second hoisting axis in a direction parallel to the hoisting plane and away from the first hoisting axis. Accordingly in a back-to-back configuration of the hoisting systems, the cables of the first and second hoisting systems are deflected in a direction parallel to the hoisting plane and towards each other. Typically, the hoisting works of a hoisting system is placed offset with respect to the hoisting axis in the general direction of deflection by the crown cluster sheave.

In some embodiments the dolly system can be said to define forward horizontal direction facing the top drive which it guides.

In some embodiments the drilling rig is arranged in a face-to-face configuration of the first and second well (or work) centres. In a face-to-face setup the two forward directions of the first and second dollies faces each other so that one is rotated 180 degrees relative to the other and the two top drives are position between the two dolly systems in the horizontal plane with the forward directions on the same axis.

In some embodiments, a face-to-face orientation of the configuration of two well centres and corresponding hoisting systems is where the horizontal distance between the first and second dolly systems is larger than the horizontal distance between the first and second top drives and/or first and second well centres.

In some embodiments the drilling rig is arranged in a back-to-back configuration of the first and second well (or work) centres. In a back-to-back setup the two dolly systems also have the respective forward directions pointing in opposite directions so one is rotated 180 relative to the other with the dolly systems between the two top drives in the horizontal direction.

In some embodiments, a back-to-back orientation of the configuration of two well centres and corresponding hoisting systems is where the horizontal distance between the first and second dolly systems is less than the horizontal distance between the first and second top drives and/or first and second well centres.

The drilling rig is in some embodiments preferably arranged in a side-by-side configuration for the first and second well (or work) centres. In a side-by-side setup the two forward directions are parallel and the dolly systems will typically be aligned on one line in the horizontal plane and the top.drives/well centres are aligned on another line parallel to the first line.

In some embodiments, a side-by-side orientation of the configuration of two well centres and corresponding hoisting systems is where the horizontal distance between the first and second dolly systems is substantially equal to the horizontal distance between the first and second top drives and/or first and second well centres.

In some embodiments the drilling rig is arranged in a side-by-side configuration for the first and second work or well centres.

Parallel and perpendicular is to be understood to within an angle of tolerance corresponding to the tolerances common in the field.

In some embodiments the drilling rig is arranged so that the forward directions of the dolly systems are arranged at an angle with respect to each other deviating from the anti-parallel/parallel alignments as in the face-to-face, back-to back and side-by-side configurations. A zero angle may be defined as the two forward directions pointing in opposite parallel directions. With an angle of 180 degrees, the two forward directions are parallel and pointing in the same direction (as in a side-by-side configuration). In some embodiments, the forward directions of two dolly systems are arranged to enclose an angle larger than zero, such as an angle of more than or equal to 10 degrees, such as more than or equal to 20 degrees, such as more than or equal to 45 degrees, such as more than or equal to 90 degrees (here the top drive may be arranged to operate over the same well centre), such as more than or equal to 135 degrees, such as more than or equal to 180 degrees (=180 is found in a side by side configuration).

In some embodiments these arrangements with an angle away from the face-to-face configuration may be in a back-to-back orientation or a face-to-face orientation.

A face to face orientation, i.e. orientations where the dolly systems with their forward directions point in converging directions towards each other, typically allows for easier collaboration between equipment related to the two well centres above the drill deck, whereas a back-to-back orientation, i.e. orientations where the dolly systems with their forward directions point in diverging directions away from each other, typically make it more straight forward to isolate the drill floors surrounding each well centre which may be beneficial for safety.

A first aspect of the invention relates to an offshore drilling rig configured for lowering and/or raising a string of tubular equipment into a subsea borehole, the drilling rig comprising:

- a drill deck;
- a first hoisting system being adapted for raising or lowering a first load carrier along a vertical first hoisting axis, wherein the first hoisting system is supported by a first support structure extending upwardly relative to the drill deck;
- a second hoisting system being adapted for raising or lowering a second load carrier along a vertical second hoisting axis spaced apart from the first hoisting axis by a hoisting axis distance, wherein the second hoisting system is supported by a second support structure extending upwardly relative to the drill deck;

a joint operations well centre on the drill deck, wherein the first and second hoisting systems are configured for operating in conjunction over the joint operations well centre, wherein the first and second hoisting axes during joint operations are preferably located apart from the joint operations well centre.

The first and the second hoisting systems are each supported by a drilling support structure such (which may be a single structure, two single structures or two linked structures), that the first and second hoisting systems can be arranged with respect to the well centre on the drill deck to perform vertical drilling related lifting operations along their respective vertical hoisting axes.

In a preferred embodiment, the drilling rig is a dual activity drilling rig that is further equipped for joint operation. In a dual activity drilling rig both the first and second hoisting systems may be operated individually, e.g. at separate work centres or even at the same work centre, one at a time. In such an embodiment according to the present invention, the individual first and second hoisting systems may also be arranged and coupled together for joint operation. Thereby a highly flexible and efficient configuration of an off-shore drilling rig is achieved, wherein the lifting components can both be optimized for efficient subsea well related operations at lower operational loads, and combined for joint operation at a high load capacity as needed.

Different advantageous configurations of hoisting systems and work/well centres that accommodate both dual activity and joint operations maybe conceived as described in more detail in the following.

As mentioned above, according to a preferred embodiment, the first and second hoisting systems are each adapted for individual operation. According to some embodiments of an offshore drilling rig, the first hoisting system is adapted for individual operation at a first work centre in the drill deck and/or the second hoisting system is adapted for individual operation at a second work centre in the drill deck spaced apart from the first work centre. During individual operation of a hoisting system at a given work/well centre the respective hoist axis is aligned with said work/well centre. Preferably, the first work centre is a first well centre. Further preferably, the second work centre is a second well centre. Consequently, the drilling rig can be operated in a conventional set-up for performing drilling related subsea-well operations at or below the load rating of the hoisting system for a single well centre. Furthermore, the drilling rig can be operated in a dual activity set-up, wherein the dual activities may e.g. include drilling related operations that require access to the well at the seabed through the well centre, and other activities that do not require such access and infrastructure for accessing lowering and raising tubular equipment, such as riser and casing, stand building, maintenance and repair of equipment, well characterisation, maintenance drilling, According to some embodiments of an offshore drilling rig, the first hoisting system is adapted for individual operation at a first well centre in the drill deck and/or the second hoisting system is adapted for individual operation at a second well centre in the drill deck spaced apart from the first well centre. Thereby, drilling related operations involving the first hoisting system may at least be performed through a first well centre. Alternatively, drilling related operations involving the second hoisting system may at least be performed through a second well centre. Furthermore, the first and second hoisting systems may be operated independently of each other to simultaneously perform drilling related operations through the first and second well centres for the same well and/or for separate wells. The first and second hoisting systems may even be operated to perform individual tasks for cooperating in a given drilling related operation.

According to some embodiments of an offshore drilling rig, the first and second support structures may be structurally connected to form a common support structure. The first and second support structures are then first and second portions of the common support structure. Thereby an improved stability of the combined structure is achieved.

According to some embodiments of an offshore drilling rig, the joint operations well centre is the first well centre or the second well centre. In this embodiment, the first and/or the second hoist may each be operated individually at the first and/or the second well centre. In order to re-configure the drilling rig for performing joint operations using the first and second hoist systems in a coupled set-up over the same well centre, the first and/or the second hoisting axes need to be repositioned with respect to the well centre, which is to be used as the joint operations well centre, so as to position the first and second hoisting axes at a lateral distance from that well centre. This can e.g. be done by moving the well centre, the hoisting system or parts thereof, moving the entire support structure, or combinations thereof.

According to some embodiments of an offshore drilling rig, the joint operations well centre is a third well centre different from the first and second well centres. In such a configuration, joint operations are performed through a well centre that is located apart from the first and second well centres. When the first and second well centres are used for individual operations, this set-up can be reconfigured for joint operations without necessarily having to reposition any of the equipment above the drill deck related to each well centre in a horizontal direction. According to a preferred embodiment of an offshore drilling rig, the joint operations well centre is located between the first well centre and the second well centre. This geometry facilitates coupling of the first and second hoisting systems for joint operations without necessarily having to re-position the hoisting axes.

According to some embodiments of an offshore drilling rig, the positions of the first, second and third well centres are fixed with respect to the drill deck. This set-up allows for providing a joint operations well centre on a dual activity drilling rig with a minimum of changes to the structural design and construction of the drill deck and associated equipment, such as e.g. diverter and riser tensioners.

According to another embodiment of an offshore drilling rig, at least one well centre is movable with respect to the drill deck. This set-up allows for reconfiguring the drilling rig from individual operation of the hoisting systems to joint operation without having to disconnect the riser and even may allow tubulars to hang off in the rotary table of the movable well centre. Risers, such as marine risers or conductor pipes, high and low pressure riser are typically connected to the well centre via a diverter just below the drill floor. In some embodiments, part of the well is drilled through a drilling riser connected to the first well centre operably to guide return mud from the drilling process back to the drilling rig. Alternative techniques exist such as so-called riserless drilling (e.g. the RDM-Riserless system from Reelwell, Norway or riserless mud recovery (RMR) from AGR, Norway). As discussed below in relation to the method aspect it may be beneficial to shift the drilling operation between the first (or second) well centre and the joint operations well centre and this may entail shifting the drilling riser as well. Shifting the drilling riser is the focus of PCT/EP2014/055312 and the offshore drilling rig of the invention may therefore in some embodiments comprise the features of one or more of the claim 1-29 of that application. The function of the drilling mu (i.e. the type of mud discussed in the present context) for controlling the pressure in the well bore and carrying cuttings out of the well will be well understood by the skilled person.

According to some embodiments of an offshore drilling rig, the movable well centre is the joint operations well centre. Also this set-up allows for reconfiguring the drilling rig from individual operation of the hoisting systems to joint operation without n having to disconnect the riser and even may allow tubulars to hang off in the rotary table of the movable well centre. The joint operations well centre may e.g. be the first well centre, which is aligned with the first hoisting axis of the first hosting system during individual operation, and moved into a position between the first and second hoisting axes for joint operation.

According to some embodiments of an offshore drilling rig, the positions of the first and second hoisting axes with respect to each other are fixed. In some embodiments this allows for a simpler support structure relative to a structure which supports shifting of the hoisting axis. This set-up obviates the need of positioning the hoisting axes with respect to each other prior to coupling. The hoisting systems may e.g. be structurally coupled so as to maintain the hoisting axes in a fixed relation to each other also during individual operation.

According to a preferred embodiment, the positions of the first and second hoisting axes are fixed with respect to the drill deck. This set-up is simplified as to the moveable parts, thereby reducing cost and increasing reliability of the offshore drilling rig.

According to a preferred embodiment, the first hoisting axis is fixed at the first well centre and/or the second hoisting axis is fixed at the second well centre. The drilling rig is thus configured for primarily operating the hoisting systems individually, independent of each other at the first and/or the second well centre. In particular in combination with an embodiment where also the positions of the well centres are fixed, this set-up provides a particularly simplified construction with respect to moveable parts, thereby reducing cost and increasing reliability of the offshore drilling rig.

According to some embodiments, the distance between the first and second hoisting axes is larger than a minimum distance, such as larger than 5 m, such as larger than 7 m, such as larger than 10 m, or about 12 m. The minimum distance allows avoiding interference between the first and second hoisting systems, in particular when both hoisting systems are operated, e.g. when performing drilling related operations at two separate well centres on the same drill deck at the same time.

An offshore drilling rig according to any of the preceding claims, wherein the first and second hoisting systems are arranged in a side-by-side configuration. This configuration allows for keeping the hoisting infrastructure and/or the first and second support structures on one side of the one or more well centres, thereby leaving the access to the one or more well centres from the remaining sides open.

According to a preferred embodiment, the offshore drilling rig further comprises a connecting tool, wherein the connecting tool comprises a load bearing device adapted for suspending tubular equipment in axial alignment with a vertical tool axis of the connecting tool, wherein the first and second hoisting axes during joint operations are coupled together by means of the connection tool such that the tool axis is located spaced apart from the first and second hoisting axes and in alignment with the joint operations well centre.

The first and second hoisting systems are connected by the connecting tool such that they jointly perform lifting operations, i.e. raising or lowering a load, with a combined safe working load exceeding that of the individual hoisting systems. The connecting tool comprises a heavy duty load bearing device that is suited for carrying the combined working load. The heavy duty load bearing device suspends the tubular equipment from its upper end, and in particular is adapted to suspend the weight of a long string of such tubular equipment extending in a downward direction from the drilling rig towards the seafloor. When the tubular equipment is suspended from the load bearing device of the connecting tool, the longitudinal axis of the tubular equipment is aligned with a tool axis of the connecting tool. The load bearing device typically engages around the tubular equipment so as to support its weight. The load bearing device of the connecting tool may resemble a heavy duty rated elevator adapted for heavy duty lifting of tubular strings.

The connecting tool has coupling points at which it is coupled to the hoisting systems. First coupling points of the connecting tool are coupled to first elements of the drilling rig that are vertically moveable with respect to the drill deck by means of and/or in conjunction with the first hoisting system, wherein said vertically moveable first elements may comprise one or more of a first load carrier of the first hoisting system, a first dolly that is vertically moveable attached to the first support structure, and a first top drive suspended by the first hoisting system and attached to the first support structure via the first dolly. Accordingly, second coupling points of the connecting tool are coupled to second elements of the drilling rig that are vertically moveable with respect to the drill deck by means of and/or in conjunction with the second hoisting system, wherein said vertically moveable second elements may comprise one or more of a second load carrier of the second hoisting system, a second dolly that is vertically moveable attached to the second support structure, and a second top drive suspended by the second hoisting system and attached to the second support structure via the second dolly.

According to the most preferred configuration, the tool axis is located between the first and second hoisting axes. The connecting tool connects the first and second hoisting systems such that the tool axis is located between the first and second hoisting axes in such a manner that the first and second hoisting systems can jointly lift the tubular string suspended by the load bearing device along the tool axis. The connecting tool thus combines the first and second hoisting systems to perform the heavy duty lifting function.

According to some embodiments of an offshore drilling rig, a distance between the coupled first and second hoisting axes during joint operations corresponds to a distance between the first and second hoisting axes during individual operations to within a range of variation, such as within +/−10%, such as within +/−5%, such as within +/−2%, or within +/−1% of the distance between the first and second hoisting axes during individual operations. Thereby reconfiguration of the drilling rig from individual to joint operation of the hoisting systems requires less rearrangement and positioning of large mechanical components such as in some instances the connecting tool.

According to some embodiments of an offshore drilling rig, a distance between the coupled first and second hoisting axes during joint operations corresponds to a well separation distance between the first and second well centres to within a range, such as within +/−10%, such as within +/−5%, such as within +/−2%, or within +/−1% of the well separation distance. Thereby reconfiguration of the drilling rig from individual to joint operation of the hoisting systems requires less rearrangement and positioning of large mechanical components.

According to some embodiments of an offshore drilling rig, a distance between the first and second hoisting axes (coupled or not) is fixed to within (an error margin) a range, such as within +/−10%, such as within +/−5%, such as within +/−2%, or within +/−1% of a mean distance between the first and second hoisting axes. Thereby reconfiguration of the drilling rig from individual to joint operation of the hoisting systems requires less rearrangement and positioning of large mechanical components.

According to some embodiments of an offshore drilling rig or the connecting tool, the connecting tool further comprises a tubular mud handling device configured for at least filling drilling mud to the inside of the tubular equipment through a sealing attachment, wherein a principal direction of the sealing attachment is arranged in axial alignment with the tool axis. The heavy duty lifting function is combined with a mud handling function for at least filling drilling mud to the tubular equipment as it is lowered into a borehole. The drilling mud may be of any kind, such as water based or oil based drilling mud. The mud handling function is provided by the tubular mud handling device. The flow of drilling mud between the mud handling device and the inside of the tubular equipment passes through a sealing attachment. During an operation of lowering or raising a string of tubular equipment, the sealing attachment is attached and detached in a cyclic manner every time a single piece of tubular equipment (e.g. single pipes) and/or a stand of tubular equipment (e.g. a stand of two or three pipes) needs to be attached to or detached from the main tubular string suspended by the connecting tool. The principal direction of the sealing attachment is arranged in axial alignment with the tool centre axis. The principal direction of the sealing attachment refers to the principal direction of the combined forces by which the sealing attachment engages the tubular equipment to maintain a sealed connection between the tubular mud handling device and the tubular string. The seal has to be able to withstand high pressures, such as above 1000 psi, above 3000 psi, above 5000 psi, above 7000 psi or even above 10000 psi to avoid leakage and spill of drilling mud to the environment. Preferably, the mud handling device is further adapted for receiving and further preferably diverting mud return flow from the inside of the tubular string. The sealing attachment should then also be suited for coping with e.g. sudden mud return flows. A reliable seal is therefore essential for a safe and environmentally viable operation of the offshore rig. By arranging the principal direction of the sealing attachment in axial alignment with the tool axis of the connecting tool, the sealing attachment is aligned with the direction of load carrying. Thereby the risk of undesirable tilting and canting of the sealing attachment with respect to the tubular equipment is avoided or at least reduced. Consequently, a reliable sealing attachment is achieved.

According to some embodiments of the offshore drilling rig or the connecting tool, the sealing attachment is an axial press-fit seal applied in the direction of the tool axis. Thereby, the sealing attachment can be connected and disconnected very rapidly, without the need of e.g. screwing/un-screwing a threaded joint. The principal axis of operation of the sealing attachment is here the direction of the pressure applied to the sealing interface. Due to the axial alignment between the principal axis of operation of the sealing attachment and the direction of load carrying as defined by the tool axis of the connecting tool, a reliable operation of the press-fit sealing attachment is achieved.

According to some embodiments of the offshore drilling rig or the connecting tool, the connecting tool further comprises a swivel device (or is adapted to receive a swivel device) so the connecting tool allows for rotation, around a vertical swivel axis, of a load suspended in the load bearing device. The swivel device allows for rotating a string of tubular equipment suspended by the heavy duty load carrying device of the connecting tool around the swivel axis. In such a situation, the swivel axis will be arranged/positioned to essentially coincide with the tool axis and the longitudinal axis of the string of tubular equipment. Such rotation may be particular useful when latching tubulars together or apart for example when a casing string has been landed via a landing string and the landing string needs to be unlatched from the casing and retrieved.

According to some embodiments of the offshore drilling rig or the connecting tool, the swivel device and/or the connecting tool comprises a rotary actuator for driving the rotation about the swivel axis. Thereby the swivel device is configured for remote, semi-automated and/or fully automated operation. As further detailed below with respect to certain embodiments of a connecting tool, the swivel device may be used to apply a rotation to the string of tubular equipment for the function of connecting/disconnecting e.g. a landing string to/from a casing- or liner-string.

According to some embodiments of the offshore drilling rig or the connecting tool, the rotary actuator comprises an electrical or hydraulic motor. The swivel device is therefore configured for self-contained operation, independent of an external drive, thereby obviating the need for a mechanical power transmission.

According to some embodiments of the offshore drilling rig or the connecting tool, the connecting tool further comprises a link tilt device adapted for tilting the load bearing device at least about a horizontal tilt axis. By providing a link tilt device on the connecting tool, the load bearing device can be tilted with respect to the vertical, and thus also with respect to the hoisting axes and with respect to a longitudinal axis of a tubular string extending from the well centre towards the seafloor. The link tilt thus allows for positioning the load bearing device of the connecting tool to receive/deposit tubular equipment at an angle with respect to the vertical direction, e.g. via a chute from/to a storage space below the drill deck. In combination with a swivel device with a vertical swivel axis arranged above the horizontal link tilt axis, the link tilt device may position the load bearing device of the connecting tool to receive/deposit tubular equipment from/to any direction around the well centre. This increases the flexibility of the rig design, e.g. for the placement of storage spaces for the tubular equipment with respect to the well centre.

According to some embodiments of the offshore drilling rig or the connecting tool, the tubular mud handling device is attached to the connecting tool. Thereby a stable alignment of the mud handling device with respect to the connecting tool is ensured, which facilitates an improved stabilization of the alignment between the principal axis of the sealing attachment and the tool axis.

According to some embodiments of the offshore drilling rig or the connecting tool, the tubular mud handling device is attached to the connecting tool by means of a gimbal mount. The gimbal mount provides a compensation mechanism for accidental misalignment in the vertical positions of the first and second hoisting systems. Thereby any unintended tilt of the connecting tool can be compensated so as to maintain the tool axis vertical when a string of tubular equipment extending towards the seafloor is suspended from the heavy duty load bearing device of the connecting tool. Thereby accidental canting of the load bearing device with respect to the string of tubular equipment suspended from it is avoided.

Advantageously, the connecting tool comprises an upper frame portion comprising the first and second coupling points to which the first and second hoisting systems are attached for suspending the connecting tool. The upper frame portion may e.g. have the form of spreader beams. A lower frame portion of the connecting is attached to the upper frame portion by means of a horizontal first gimbal axis, and the first and second hoisting systems are attached to respective coupling points in such a way as to allow for tilt of the connecting tool with respect to the vertical direction about an axis parallel to the first gimbal axis. A horizontal second gimbal axis may be provided on the lower frame portion in connection with a link tilt function for deliberately tilting the tool axis with respect to the lower frame portion, and thus with respect to the vertical direction for receiving/depositing tubular equipment from/to an off-axis chute.

According to some embodiments, the offshore drilling rig further comprises at least one top drive suspended from one of the load carriers. To perform the drilling and drilling related operations, additional equipment is provided at and around the well centre, wherein some of the equipment may be arranged to be movable in a vertical direction. For example, the additional equipment may include a top-drive suspended by the load carrier of a hoisting system. In a conventional set-up using a single hoisting system, the top drive may provide drilling power for rotating a drill pipe to drive the rotation of a drill bit. In general, to prevent counter-rotation, the top drive needs to be further secured to the support structure, e.g. by means of a vertically travelling, and horizontally retractable dolly. Typically, the top drive is further equipped with so-called pipe-handling equipment providing different functions for handling and suspending pipe. Furthermore, the top drive is often equipped with mud handling equipment that can be sealingly attached to a string of tubular equipment suspended by the pipe-handling equipment and extending towards the seafloor so as to fill the tubular equipment with drilling mud during a lowering operation. Mounting and/or un-mounting a top drive is usually a time-consuming task. By already including a top drive in the multiple hoisting configuration for operations requiring heavy duty lifting, the time required for changing between a single hoisting system configuration and a multiple hoisting system configuration is greatly reduced. The top drive is suspended from the load carrier of one of the hoisting systems in the same manner as in a single hoisting system configuration, and connects that load carrier to the corresponding coupling points on the connecting device. The other coupling points are directly or indirectly (e.g. via yet a further top drive) suspended by the load carrier of the other hoisting system. The top drive is suspended from a single hoisting system between the respective load carrier of the single hoisting system and the connecting tool. Since the connecting tool in the multiple hoisting configuration distributes the heavy duty load to the multiple hoisting systems, the load capacity rating of the top drive may be much less than the total load to be lifted, and the top drive can be optimized for a lower load rating matching to the predominant tasks that can be performed in a single hoisting system configuration. A rapid change-over to the multiple hoisting system configuration of the offshore drill rig allows then to rapidly adapt the load capacity to a heavy duty peak load as needed. In addition, the top drive can support the advantageous implementation of functions, which are required for performing the heavy duty lowering and/or raising operations, on or in combination with the connecting tool. As further detailed below, advantageous examples for such functions may comprise mud handling functionality, hydraulic power supply for link-tilt operations, and/or mechanical driving power supplied to a swivel device via a transmission/linkage/gear.

According to some embodiments of the offshore drilling rig, a mud handling system of the top drive is operatively coupled to the tubular mud handling device via a flexing/flexible fluid connection. Thereby a mud handling function of the top drive is put to service for facilitating or at least supporting the operation of the tubular mud handling device of the multiple hoisting system configuration.

According to some embodiments of the offshore drilling rig, the top drive is operatively coupled to the swivel device so as to drive the swivel rotation and/or the top drive is operatively coupled to the link tilt device so as to drive the link tilt action. By operatively coupling the swivel device to the top drive, a rotary drive function of the top drive is put to service for facilitating or at least supporting the operation of the swivel device of the multiple-hoisting system configuration. Furthermore, by operatively coupling the link tilt device to the top drive, a power supply function of the top drive is put to service for facilitating or at least supporting the operation of the link-tilt device of the multiple-hoisting system configuration. Advantageously, the power may be hydraulic power supplied to one or more hydraulic actuators of the link-tilt device of the multiple-hoisting system configuration.

According to a second aspect of the invention, an assembly is provided for use in an offshore drilling rig according to any of the embodiments disclosed in the present application during operations of raising or lowering a string of tubular equipment in a subsea borehole, the assembly comprising

- a connecting tool with a load bearing device adapted for suspending tubular equipment in axial alignment with a tool axis, and first and second coupling points for coupling the connecting tool to respective load carriers of first and second hoisting systems, and
- a tubular mud handling device attached to the connecting tool, wherein the tubular mud handling device is configured for at least filling drilling mud to the inside of the tubular equipment through a sealing attachment, wherein a principal direction of the sealing attachment is arranged in axial alignment with the tool axis.

By using this assembly, an offshore rig having first and second hoisting systems that can be positioned for operation at a well centre of a drill deck, can be rapidly configured for lowering and/or raising operations involving heavy duty lifting of loads that exceed the load capacity rating of each of the individual hoisting systems. In particular, the combination of the connecting tool with a tubular mud handling tool that has a sealing attachment with a principal direction being arranged in axial alignment with the tool axis allows for rapidly establishing a reliable seal between the tubular mud handling device and the inside of the tubular string to be lowered or raised—also during joint heavy duty lifting by multiple hoisting systems.

According to some embodiments of the assembly, the tubular mud handling tool is attached directly to the load bearing device. Thereby the risk of canting the seal with respect to a string of tubular equipment suspended by the load bearing device of the connecting tool is largely obviated.

According to a third aspect, the invention relates to a connecting tool for use in an offshore drilling rig according to any one of the embodiments mentioned in the present invention, wherein the connecting tool comprises a load bearing device adapted for suspending tubular equipment in axial alignment with a tool axis, wherein the connecting tool further comprises a first coupling point for being suspended by a first hoisting system having a vertical first hoisting axis, and a second coupling point for being suspended by a second hoisting system having a vertical second hoisting axis such that the tool axis is located between the first and second hoisting axes, wherein the load bearing device is adapted to engage the tubular equipment for applying axial torque and to perform an axial rotation around the tool axis;

By using this connecting tool, an offshore rig having first and second hoisting systems that can be positioned for operation at a well centre of a drill deck, can be rapidly configured for lowering and/or raising operations involving heavy duty lifting of loads that exceed the load capacity rating of each of the individual hoisting systems. In particular, the combination of a rotary actuation function with a heavy duty load bearing function in the same connecting tool synergistically supports operations involving heavy load lifting and the application of low/moderate axial torque, such as the operation of landing a heavy casing string from a long landing string requiring the combined load capacity of multiple hoisting systems for lifting and the subsequent disconnection of the landing string from the landed casing string by a twisting motion.

The axial torque may be represented by a torque vector aligned with the tool axis. Under operation, when suspending a tubular string from the load bearing device of the connecting tool, the tool axis is aligned with the longitudinal axis of the tubular string. The torque vector is thus aligned with the longitudinal axis of the tubular string, and the tubular string is rotated around its axis. The rotary motion may be driven by a rotary drive, wherein the rotary drive may comprise an internal motor, such as an electrical motor or a hydraulic motor. The rotary drive may be integrated with or attached to the connecting tool. Alternatively, the rotary drive may be an external drive, such as a top-drive, connected to the connecting tool via a transmission/gear/linkage that is adapted to transfer the rotary driving motion to the load bearing device.

Further advantageously, a connecting tool may comprise a transmission/gear/linkage adapted to transmit a rotary driving motion from a rotary drive to the load bearing device so as to drive the axial rotation around the tool axis. In some embodiments, the rotary drive is arranged on the connecting tool. Alternatively, according to some embodiments the transmission/gear/linkage comprises a power input adapted to be coupled to an external drive so as to receive a rotary driving input from an external drive train.

According to a fourth aspect, the invention relates to a bail section for use in an off-shore drilling rig according to any of the above-mentioned embodiments, the bail section having a first end, a second end, and a shaft portion connecting the first end and the second end, wherein the first end has a bail eye or hook, and wherein the second end is shaped and dimensioned as the outside contour of a tubular joint, such drill pipe joint or another type of joint with a shoulder. The first end is thereby configured for engaging e.g. a load bearing device, such as a heavy duty rated elevator, by means of a bail coupling in a conventional manner, whereas the second end is specially adapted for coupling to drill pipe lifting equipment, such as a conventional drill pipe elevator. Such drill pipe elevators may be used as or be attached to a load carrier of a hoisting system, and are typically also found on pipe handling equipment of commonly used top drives. Thereby, the bail sections are specially adapted to allow for a simple attachment of the connecting tool to conventional drill pipe lifting equipment, wherein a first bail section may be attached to a the drill pipe lifting equipment of a first hoisting system, and a second bail section may be attached to the drill pipe lifting equipment of a second hoisting system, while both bail sections engage the same heavy duty load bearing device via conventional bail links. Using these modified bail sections, a connecting tool can thus be assembled using lifting components that are already known and have been proven to work under the severe requirements of subsea drilling.

Drill pipe comprises a tubular section with a specified outside diameter (e.g. 3½ inch, 4 inch, 5 inch, 5½ inch, 5⅞ inch, 6⅝ inch). Each end of the drill pipe tubular is provided with a drill pipe joint having larger-diameter portions usually referred to as tool joints. The larger diameter often forms a shoulder section also referred to as elevation shoulder arranged to engage with the pipe elevator (load carrier) of the hoisting system. Such shoulders are also found on some of the other types of tubulars. The tool joints are usually configured for establishing a threaded connection between drill pipe sections and are designed to withstand different mechanical stresses, such as torque, compression and/or tensional forces along the longitudinal direction of the drill pipe tubular, e.g. in order to be able to carry the weight of an entire drill string when running drill pipe. During operations of raising/lowering drill pipe, the drill pipe is suspended by a load carrier engaging the drill pipe at the drill pipe joint portion at one end.

Preferably, the second end of the bail section may have a peripheral protrusion, such as a ledge, a ridge, or a simple increase in diameter, which is shaped and dimensioned for engaging the bail section with a conventional load carrier designed for handling drill pipe by engaging the drill pipe at its joint section. Preferably, the bail section is therefore provided with a peripheral protrusion that is shaped and dimensioned as relevant portions of the tool joint on a drill pipe, i.e. including at least the "neck" of the drill pipe usually engaged by a drill pipe elevator, where the narrow diameter of the tubular section meets the wider diameter of the tool joint.

According to a fifth aspect, the invention relates a method of operating an offshore drilling rig according to any one of the above described embodiments, the method comprising a) drilling a section of a well into the seabed through the first well centre;
b) hooking up a connecting tool, according to any of the embodiments listed above as 35-38, and/or the assembly, according to any of the embodiments listed above as 33-34a, to the first and second hoisting systems;
c) running a string of casing through the joint operations well centre with the first and second hoisting systems in collaboration.

The joint operation well centre will commonly not have the capacity to provide sufficient continuous torque to facilitate the desired drilling of the subsea well. Therefore, drilling will most often be carried in one of the well centres, such as the first well centre. Subsequent to running a casing in the joint operation well centre drilling may be resumed at either the first (or the second work centre for embodiments where the second work centre is a well centre). Some casing strings may prove too heavy for the load rating of the first hoisting system in which case the joint operations well centre can be used and the casing can be run at least part of the way jointly by the first and second hoisting systems i.e. with the first and second hoisting systems in collaboration.

The term casing string refers to the complete section of a casing (made up of multiple casing joints) which is run into the well in a single lowering operation. Any casing strings installed above this string in the well will commonly have a larger diameter and any casing string subsequently installed below will typically have a smaller diameter.

In some embodiments the entire casing string and the landing string (if needed) is made up and run through the joint operations well centre. However, so long as the lifting of the first well centre is sufficient it is in some embodiments preferable to reduce the use of the joint operations well centre with the connecting tool (or assembly) as this setup is likely to be slower in operation compared to the first hoisting system working alone over the first well centre. Accordingly, in some embodiments at least part of the casing string and sometime even part of the landing string is made up at the first well centre and the final part of the string of casing or landing string is made up at the joint operations well centre.

In some embodiments part of the well is drilled through a drilling riser connected to the first well centre operably to guide return mud from the drilling process back to the drilling rig. Alternative techniques exist such as so-called riserless drilling (e.g. the RDM-Riserless system from Reelwell, Norway or riserless mud recovery (RMR) from AGR, Norway). The casing/landing strings that are too heavy for the first centre are most likely part of the well that is drilled with mud (such as through a riser or with another system suitable for handling drilling with mud) but may in principle also be the casing for the top hole. For embodiments where the drilling mud is returned to the well centre or just below the well centre (such as via a drilling riser where the mud is returned to a diverter in connection with the well centre) the method may further comprise shifting the return mud connection to the joint operation well centre. For example, in some embodiment the method comprises shifting said riser to the joint operations well centre (i.e. aligning the first well with the tool axis of the connecting tool) located between the first well centre and the second work centre (preferably a well centre) whereby said first well centre acts as the joint operation well centre. This shifting or moving of a well centre is the subject of co-pending PCT application PCT/EP2014/055312 with either a movable well center (via a positioning system) and/or a diverter mounted at two well centers so that a riser connected to the first well center may be disconnected, moved under the drill floor to the another well center (the joint operations well centre) and connected to a diverter mounted under this well centre. Accordingly, in some embodiments the offshore drilling rig discussed above comprises the features of one or more of the claim 1-29 and/or the method described here further comprises one or more of the features described in claim 30-37 of PCT/EP2014/055312.

Building the casing string or part thereof in the first well centre is in some embodiments only feasible when the drilling rig is arranged to allow the string being made up to be hung off while the riser is shifted from the first well centre to the joint operations well centre. For a movable well centre it may be possible to hang off the casing string (or the landing string holding the casing string) in slips or similar device in the well centre such as in a rotary table of the well centre. When building the casing string in the first well centre and moving the riser by disconnecting and reconnecting at the joint operations well centre it may be necessary to hang off the casing and/or landing string e.g. in the BOP and the top section of the riser. Alternatively, the hoisting axis of the first well centre may shift along with the riser to take the weight of the string.

In further illustration of the invention, the following advantageous embodiments are disclosed in itemized form:

1. An offshore drilling rig configured for lowering and/or raising a string of tubular equipment into a subsea borehole, the drilling rig comprising:
   - a drill deck;
   - a first hoisting system being adapted for raising or lowering a first load carrier along a vertical first hoisting axis, wherein the first hoisting system is supported by a first support structure extending upwardly relative to the drill deck;
   - a second hoisting system being adapted for raising or lowering a second load carrier along a vertical second hoisting axis spaced apart from the first hoisting axis by a hoisting axis distance, wherein the second hoisting system is supported by a second support structure extending upwardly relative to the drill deck;
   - a joint operations well centre on the drill deck.

1a. An offshore drilling rig according to embodiment 1 wherein offshore drilling rig is configured for the first and second hoisting systems in conjunction over the joint operations well centre.

1b. An offshore drilling rig according to embodiment 1 or 1 a wherein the first and second hoisting axes during joint operations are located apart from the joint operations well centre.

2. An offshore drilling rig according to any of the preceding embodiments, wherein the first and second support structures are structurally connected to form a common support structure.

3. An offshore drilling rig according to any of the preceding embodiments s, wherein the first and second hoisting systems are adapted for individual operation and some embodiments the first hoisting system is adapted for individual operation at a first work centre (preferably a being a first well centre) in the drill deck and/or the second hoisting system is adapted for individual operation at a second work centre (preferably being a second well centre) in the drill deck spaced apart from the first work centre.

4. An offshore drilling rig according to any of the preceding embodiments, wherein the first hoisting system is adapted for individual operation at a first well centre in the drill deck and/or wherein the second hoisting system is adapted for individual operation at a second well centre in the drill deck spaced apart from the first well centre.

5. An offshore drilling rig according to embodiment 4, wherein the joint operations well centre is the first well centre or the second well centre.

6. An offshore drilling rig according to embodiment 4, wherein the joint operations well centre is a third well centre different from the first and second well centres.

7. An offshore drilling rig according to embodiment 6 wherein the joint operations well centre is located between the first well centre and the second well centre.

8. An offshore drilling rig according to embodiment 6 or 7, wherein the positions of the first, second and third well centres are fixed with respect to the drill deck.

9. An offshore drilling rig according to any one of the embodiments 1-7, wherein at least one well centre is movable with respect to the drill deck and the offshore drilling comprises the features of the offshore drilling according to one or more of the claims 1 to 29 of patent application PCT/EP2014/055312.

10. An offshore drilling rig according to embodiment 9, wherein the movable well centre is the joint operations well centre.

11. An offshore drilling rig according to any of the preceding embodiments, wherein the positions of the first and second hoisting axes with respect to each other are fixed.

12. An offshore drilling rig according to any of the preceding embodiments, wherein the positions of the first and second hoisting axes with respect to the drill deck are fixed.

13. An offshore drilling rig according to embodiment 12, wherein the first hoisting axis is fixed at the first well centre and/or the second hoisting axis is fixed at the second well centre.

14. An off-shore drilling rig according to any of the preceding embodiments, wherein the distance between the first and second hoisting axes is larger than a minimum distance, such as larger than 5 m, such as larger than 7 m, such as larger than 10 m, or about 12 m.

15. An offshore drilling rig according to any of the preceding embodiments, further comprising a connecting tool comprising a load bearing device adapted for suspending tubular equipment in axial alignment with a vertical tool axis of the connecting tool, wherein the first and second hoisting axes during joint operations are coupled together by means of the connection tool such that the tool axis is spaced apart from the first and second hoisting axes and in alignment with the joint operations well centre.

16. An offshore drilling rig according to embodiment 15, wherein the tool axis is located between the first and second hoisting axes.

17. An offshore drilling rig according to embodiment 15 or 16, wherein the connecting tool has coupling points at which it is coupled to the hoisting systems, wherein first coupling points of the connecting tool are coupled to first elements of the drilling rig that are vertically moveable with respect to the drill deck by means of and/or in conjunction with the first hoisting system, wherein said vertically moveable first elements comprise one or more of a first load carrier of the first hoisting system, a first dolly that is vertically moveable attached to the first support structure, and a first top drive suspended by the first hoisting system and attached to the first support structure via the first dolly; and/or wherein second coupling points of the connecting tool are coupled to second elements of the drilling rig that are vertically moveable with respect to the drill deck by means of and/or in conjunction with the second hoisting system, wherein said vertically moveable second elements comprise one or more of a second load carrier of the second hoisting system, a second dolly that is vertically moveable attached to the second support structure, and a second top drive suspended by the second hoisting system and attached to the second support structure via the second dolly.

18. An offshore drilling rig according to any one of the embodiments 15-17, wherein a distance between the coupled first and second hoisting axes during joint operations corresponds to a distance between the first and second hoisting axes during individual operations to within a range of variation, such as within +/−10%, such as within +/−5%, such as within +/−2%, or within +/−1% of the distance between the first and second hoisting axes during individual operations.

19. An offshore drilling rig according to any one of the embodiments 15-17, wherein a distance between the coupled first and second hoisting axes during joint operations corresponds to a well separation distance between the first and second well centres to within a range, such as within +/−10%, such as within +/−5%, such as within +/−2%, or within +/−1% of the well separation distance.

20. An offshore drilling rig according to any one of the embodiments 15-17, wherein a distance between the first and second hoisting axes is fixed to within a range, such as within +/−10%, such as within +/−5%, such as within +/−2%, or within +/−1% of a mean distance between the first and second hoisting axes.

21. An offshore drilling rig according to any of the preceding embodiments, wherein the first and second hoisting systems are arranged in a side-by-side configuration or at another angle away from-a-face to face configuration having as described above.

22. An offshore drilling rig according to any one of the embodiments 15-21, wherein the connecting tool further comprises a tubular mud handling device configured for at least filling drilling mud to the inside of the tubular equipment through a sealing attachment, wherein a principal direction of the sealing attachment is arranged in axial alignment with the tool axis.

23. An offshore drilling rig according to embodiment 22, wherein the sealing attachment is an axial press-fit seal applied in the direction of the tool axis.

24. An offshore drilling rig according to any one of the embodiments 15-23, wherein the connecting tool further comprises a swivel device (or is adapted to receive a swivel device) so the connecting tool allows for rotation around a vertical swivel axis of a load suspended in the load bearing device.

25. An offshore drilling rig according to embodiment 24, wherein the connecting tool and/or the swivel device comprises a rotary actuator for driving the rotation about the swivel axis.

26. An offshore drilling rig according to item 25, wherein the rotary actuator comprises an electrical or hydraulic motor.

27. An offshore drilling rig according to any one of the embodiments 15-25, wherein the connecting tool further comprises a link tilt device adapted for tilting the load bearing device at least about a horizontal tilt axis.

28. An offshore drilling rig according to any one of the embodiments 15-27, wherein the tubular mud handling device is attached to the connecting tool.

29. An offshore drilling rig according to embodiment 28, wherein the tubular mud handling device is attached to the connecting tool by means of a gimbal mount.

30. An offshore drilling rig according to any one of the embodiments 15-29, further comprising at least one top drive suspended from one of the load carriers.

31. An offshore drilling rig according to embodiment 30, wherein a mud handling system of the top drive is operatively coupled to the tubular mud handling device via a flexing/flexible fluid connection.

32. An offshore drilling rig according to any one of the embodiments 30-31, wherein the top drive is operatively coupled to the swivel device so as to drive the swivel rotation and/or wherein the top drive is operatively coupled to the link tilt device so as to drive the link tilt action.

33. An assembly for use in an offshore drilling rig according to any one of the embodiments 15-32, the assembly comprising a connecting tool with a load bearing device adapted for suspending tubular equipment in axial alignment with a tool axis, and first and second coupling points for coupling the connecting tool to respective load carriers of first and second hoisting systems, and a tubular mud handling device attached to the connecting tool, wherein the tubular mud handling device is configured for at least filling drilling mud to the in-side of the tubular equipment through a sealing attachment, wherein a principal direction of the sealing attachment is arranged in axial alignment with the tool axis.

34. Assembly according to embodiment 33, wherein the tubular mud handling tool is attached directly to the load bearing device.

34a. Assembly according to embodiment 33 or 34 further comprising any of the features of the embodiments of a connecting tool listed below as 35-38.

35. A connecting tool for use in an offshore drilling rig according to any one of the embodiments 15-32, the connecting tool comprising a load bearing device adapted for suspending tubular equipment in axial alignment with a tool axis, wherein the connecting tool further comprises a first coupling point for being suspended by a first hoisting system having a vertical first hoisting axis, and a second coupling point for being suspended by a second hoisting system having a vertical second hoisting axis such that the tool axis is located between the first and second hoisting axes, wherein the load bearing device is adapted to engage the tubular equipment for applying axial torque and to perform an axial rotation around the tool axis;

36. A connecting tool according to embodiment 35 further comprising a transmission/gear/linkage adapted to transmit a rotary driving motion from a rotary drive to the load bearing device so as to drive the axial rotation around the tool axis.

37. A connecting tool according to embodiment 36, wherein the rotary drive is arranged on the connecting tool.

38. A connecting tool according to embodiment 36, wherein the transmission/gear/linkage comprises a power input adapted to be coupled to an external drive so as to receive a rotary driving input from an external drive train.

39. A bail section for use in an offshore drilling rig according to any one of the embodiments 15-32, the bail section having a first end, a second end, and a shaft portion connecting the first end and the second end, wherein the first end has a bail eye or hook, and wherein the second end is shaped and dimensioned as the outside contour of a tubular joint, such as a drill pipe joint or another type of joint of a tubular with a shoulder.

40. Method of lowering and/or raising a string of tubular equipment into a subsea borehole through a joint operations well centre in a drill deck of an offshore drilling rig, the method comprising providing a first hoisting system for raising or lowering a first load carrier along a vertical first hoisting axis, wherein the first hoisting system is supported by a first support structure;

providing a second hoisting system for raising or lowering a second load carrier along a vertical second hoisting axis, wherein the second hoisting system is supported by a second support structure, and wherein the first and second hoisting axes are laterally displaced from another by a hoisting axis distance;

operatively coupling the first and second hoisting systems by means of a connecting tool, wherein the connecting tool comprises a load bearing device located at a vertical tool axis of the connecting tool, and wherein the tool axis is spaced apart from the first and second hoisting axes;

engaging the tubular equipment by the load bearing device, and lowering/raising the tubular equipment when the tool axis is aligned with the joint operations well centre.

41. Method according to embodiment 40, wherein the tool axis is located between the first and second hoisting axes.

42. Method according to embodiment 40 or 41, wherein the first and second hoisting systems are operated in a side-by-side configuration.

43. Method according to any one of the embodiments 40-42, further comprising maintaining the first and second hoisting axes at a fixed distance from each other.

44. Method according to embodiment 43, wherein the fixed distance is at least partially determined by the connecting tool.

45. Method according to any one of the embodiments 40-44, wherein the distance between the first and second hoisting axes at least during the step of lowering/raising the tubular equipment is larger than a minimum distance, such as larger than 5 m, such as larger than 7 m, such as larger than 10 m, or about 12 m.

46. Method according to any one of the embodiments 40-45, wherein the joint operations well centre at least during the step of lowering/raising the tubular equipment is located between the first and second hoisting axes.

47. Method according to any one of the embodiments 40-46, wherein providing the first and second hoisting systems include positioning the first and second hoisting axes with respect to the joint operations well centre.

48. Method according to any one of the embodiments 40-47, wherein providing the first and second hoisting systems include positioning the first hoisting axis and the joint operations well centre at a first lateral distance from each other and/or positioning the second hoisting axis and the joint operations well centre at a second lateral distance from each other 49. Method according to embodiment 47 or 48, wherein positioning the first and second hoisting axes with respect to the joint operations well centre comprises moving the joint operations well centre in a horizontal direction with respect to the drill deck.

50. Method according to embodiment 49, wherein the first hoisting axis is aligned with the joint operations well centre, prior to moving the joint operations well centre with respect to the drill deck.

51. Method according to any one of the embodiments 47-50, wherein positioning the first hoisting axis with respect to the joint operations well centre comprises moving a first cable crown at least in a horizontal direction with respect to the first support structure and/or wherein positioning the second hoisting axis with respect to the joint operations well centre comprises moving a second cable crown at least in a horizontal direction with respect to the second support structure.

52. Method according to any one of the embodiments 47-51, wherein positioning the first and second hoisting axes with respect to the joint operations well centre comprises moving the first support structure and/or the second support structure at least in a horizontal direction with respect to the drill deck.

53. Method according to any one of the embodiments 47-52, wherein positioning the first and second hoisting axes with respect to the joint operations well centre comprises moving the first hoisting axis from a first location of individual operation to a first location of joint operation and/or moving the second hoisting axis from a second position of individual operation to a second position of joint operation.

The first hoisting axis may prior to the step of operatively coupling the first and second hoisting systems be located for operation at a further work centre on the drill deck different from the joint operations well centre. The further work centre is preferably a further well centre where drilling related operations may be performed at a fully equipped well centre, but may also be a work centre where other drilling related operations are performed.

Accordingly, the second hoisting axis may prior to the step of operatively coupling the first and second hoisting systems be located for operation at a yet further work centre on the drill deck different from the joint operations well centre and the further work centre, wherein the yet further work centre is preferably a yet further well centre but may also be a work centre where other drilling related operations are performed.

54. Method according to any one of the embodiments 40-53, wherein the step of operatively coupling the first and second hoisting systems comprises coupling first coupling points of the connecting tool to first elements of the drilling rig that are vertically moveable with respect to the drill deck by means of and/or in conjunction with the first hoisting system, wherein said vertically moveable elements comprise one or more of a first load carrier of the first hoisting system, a first dolly that is vertically moveable attached to the first support structure, and a first top drive suspended by the first hoisting system and attached to the first support structure via the first dolly.

55. Method according to any one of the embodiments 40-54, wherein the step of operatively coupling the first and second hoisting systems comprises coupling second coupling points of the connecting tool to second elements of the drilling rig that are vertically moveable with respect to the drill deck by means of and/or in conjunction with the second hoisting system, wherein said vertically moveable elements comprise one or more of a second load carrier of the second hoisting system, a second dolly that is vertically moveable attached to the second support structure, and a second top drive suspended by the second hoisting system and attached to the second support structure via the second dolly.

56. Method according to any one of the embodiments 40-55, wherein positioning the first and second hoisting axes are performed prior to the step of coupling the first and second hoisting systems.

57. Method according to any one of embodiments 40-55, wherein positioning the first and second hoisting axes are performed after the step of coupling the first and second hoisting systems.

58. Method according to any one of embodiments 40-56, wherein the method further comprises disrupting operation of the first hoisting system at a work centre different from the joint operations well centre, prior to the step of positioning the first hoisting axis and/or wherein the method further comprises disrupting operation of the second hoisting system at a work centre different from the joint operations well centre, prior to the step of positioning the second hoisting axis.

59. A method of operating an offshore drilling rig according to any one of the above described embodiments such as those listed as embodiments 1-32, the method comprising a) drilling a section of a well into the seabed through the first well centre;

b) hooking up a connecting tool, according to any of the embodiments listed above as 35-38, and/or the assembly, according to any of the embodiments listed above as 33-34a, to the first and second hoisting systems;

c) running a string of casing through the joint operations well centre via the first and second hoisting systems in collaboration.

60. The method listed as 59 wherein said drilling through the first well centre is through a drilling riser connected to the first well centre operably to guide return mud from the drilling process back to the drilling rig.

61. The method listed as 59 or 60 further comprising subsequently drilling a further section through the first or second well centre.

62. A method listed as among 59 to 61 further comprising shifting said riser to the joint operations well centre located between the first well centre and the second work centre (preferably a well centre).

63. The method listed as 62 wherein said shifting comprises moving the first well centre such as into alignment with the tool axis of the connecting tool whereby said first well centre acts as the joint operation well centre.

64. The method listed as 62 wherein said shifting comprises disconnecting the riser from the first well centre, skidding the riser below the drill floor and connecting the riser to the joint well centre.

65. A method listed as among 59-64 comprising building (making up) at least part (such as all) of the string of casing in the first well centre.

66. A method listed as among 59-65 comprising running the string of casing at least part of (such as all of) the way to the seabed in the first well centre.

67. A method listed as among 65 or 66 comprising hanging off the string of casing and/or landing string in one or more of a blow-out preventer (BOP) connected to the well, the top section of the riser connected to the first well centre during said drilling of the section of the well or (in the case of a moving the well centre) in the rotary table of the movable well centre.

68. A method listed as among 59-67 further comprising any of the claims 30-37 of patent application PCT/EP2014/055312.

69. A method listed as among 59-68 further comprising any of features of the method listed as 40 to 58.

BRIEF DESCRIPTION OF THE DRAWINGS

Preferred embodiments of the invention will be described in more detail in connection with the appended drawings, which show schematically in FIG. 1 according to a first embodiment, a connecting tool with a tubular mud handling device attached thereto, FIG. 2 according to a second embodiment, an assembly comprising a connecting tool and a tubular mud handling device, FIG. 3 according to a third embodiment, a connecting tool with a tubular mud handling device directly attached to the heavy duty load bearing device, FIG. 4 according to a fourth embodiment, a connecting tool with a tubular mud handling device attached thereto by means of a gimbal, FIG. 5, 5*a* according to a fifth embodiment, a connecting tool with a swivel device and mud handling operatively connected to respective top drives, FIG. 6 according to a sixth embodiment, a connecting tool with a swivel device with an internal drive and mud handling operatively connected to one of the top drives, FIG. 7 according to a seventh embodiment, a connecting tool with a swivel device and a tubular mud handling device directly attached thereto FIG. 8 a perspective elevation of the connecting tool according to the seventh embodiment, and in FIG. 9 a detail of an offshore drilling rig with two hoisting systems connected for combined operation using the connecting tool according to the seventh embodiment.

FIGS. 10-18 illustrate another embodiment of an offshore drilling rig, wherein FIG. 10 shows a side view of the drilling rig, FIGS. 11-14 show 3D views of parts of the drilling rig from different viewpoints, FIGS. 15-16 show horizontal cross-sectional views of the drilling rig, and FIGS. 17-18 show lateral cross sections of the drilling rig.

Furthermore, the drawings show schematically in

Figure 19:
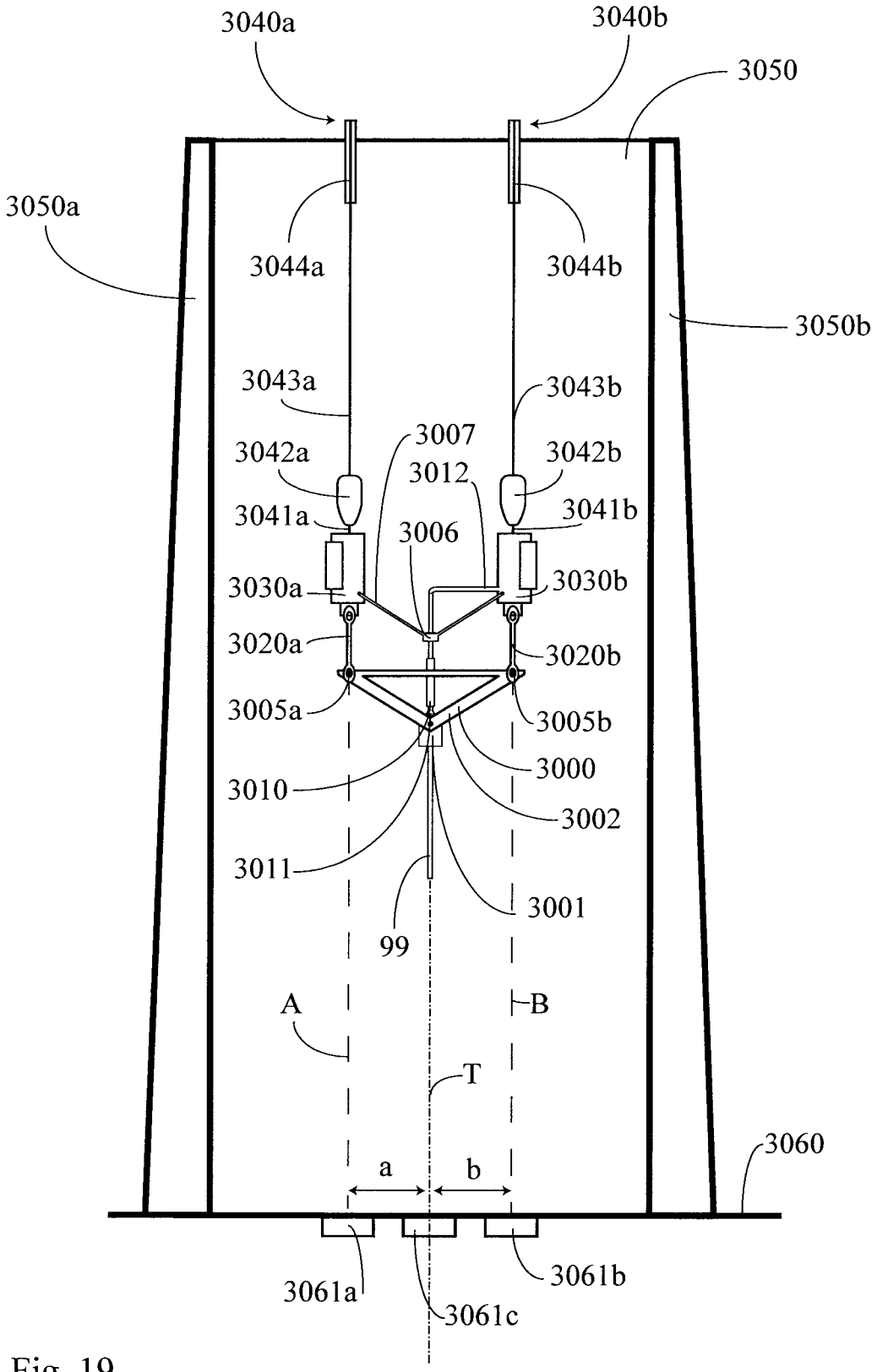
Figure 20:
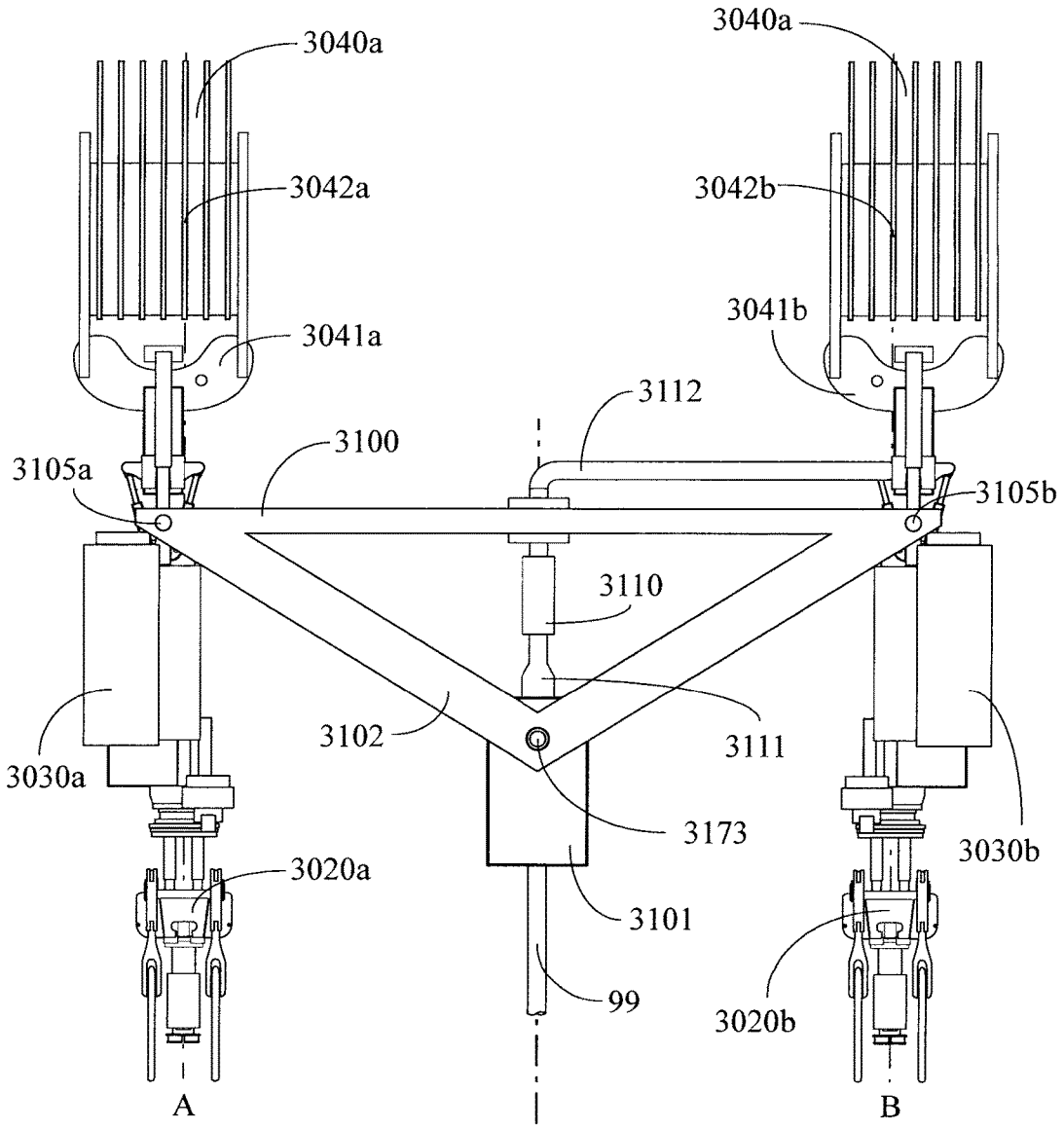
Figure 21:
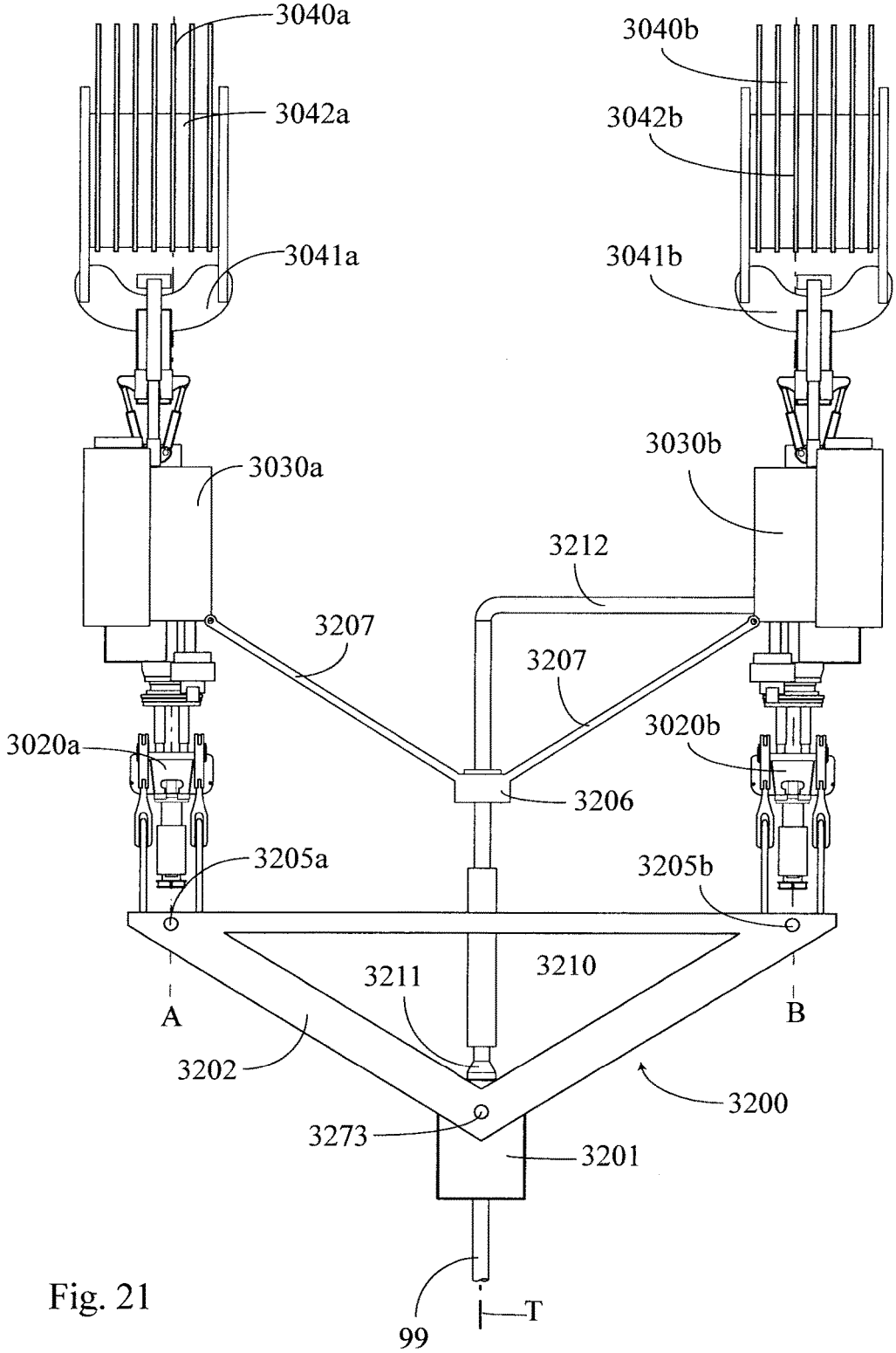
Figure 22:
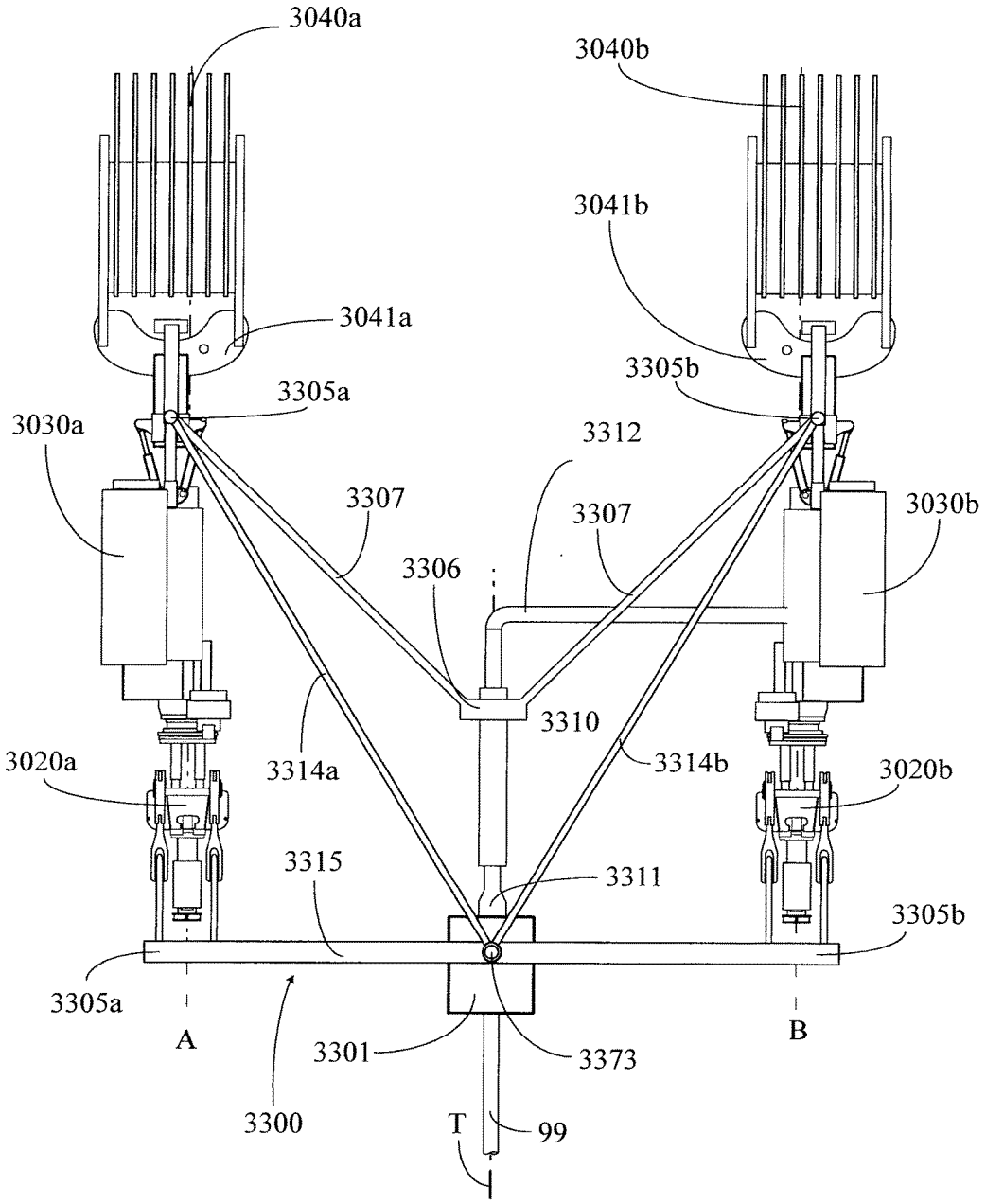
Figure 35:
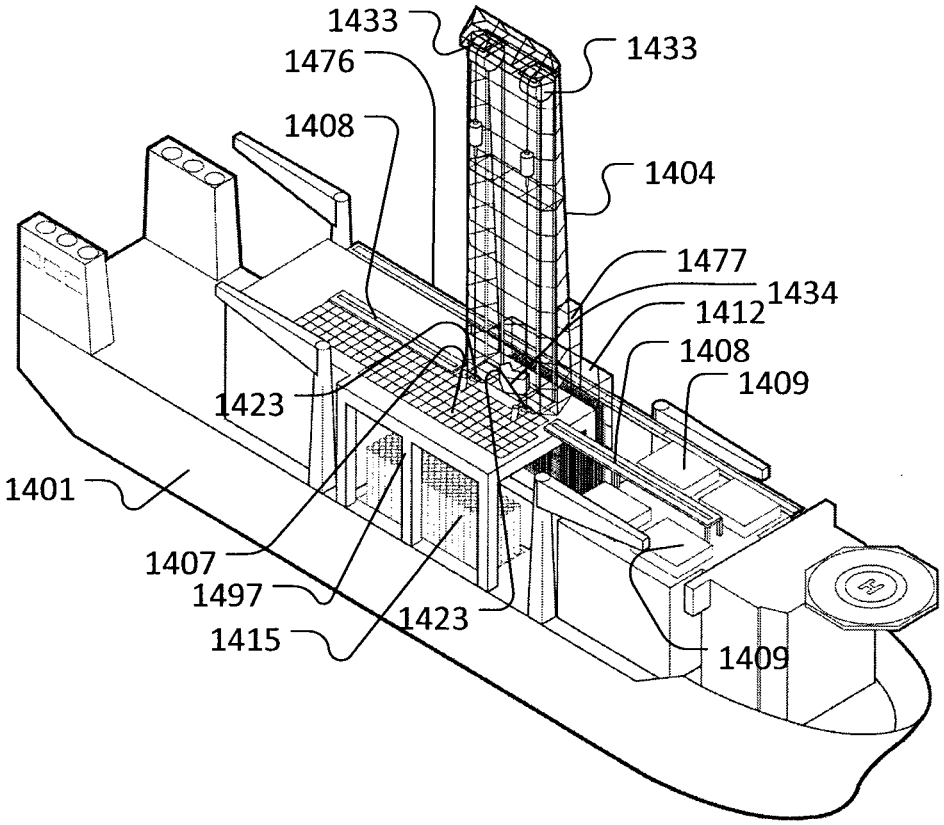

FIG. 19 a detail of an offshore drilling rig according to the embodiments shown in FIGS. 35 and/or 36 where the rig is configured in a side-by-side configuration with two hoisting systems connected for combined operation using the connecting tool according to an eighth embodiment, FIG. 20-22 shows various embodiments of a connecting tool which are particularly suitable for a long reach, such as being connected to two hoisting systems aligned with the two well centers of a dual activity rig. Here the well spacing is typically in the order of 8 meters or larger, such as 10 meters or larger, such as 12 meters or larger, FIG. 21 according to a tenth embodiment, a connecting tool with coupling points attached to the pipe handlers of first and second top drives, FIG. 22 according to a ninth embodiment, a connecting tool with coupling points attached directly to the load carriers of first and second hoisting systems and further coupling points attached to the pipe handlers of first and second top drives.

Figure 23:
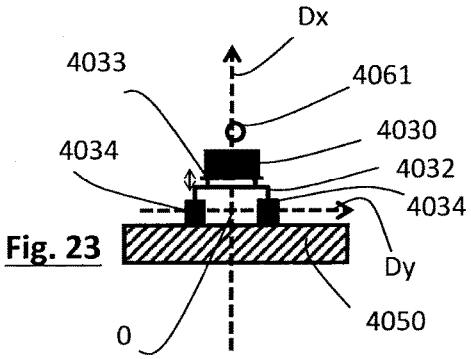

FIG. 23 shows a support structure carrying two parallel vertical rails on which a dolly may travel in a vertical direction.

Figure 24:
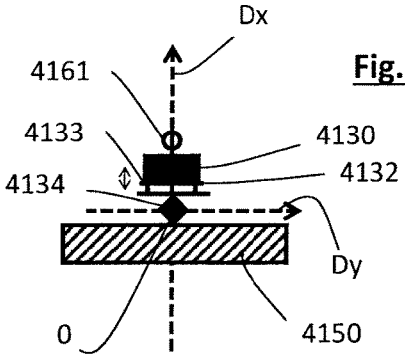

FIG. 24 shows a support structure carrying a single vertical rail on which a dolly may travel in a vertical direction.

Figure 25:
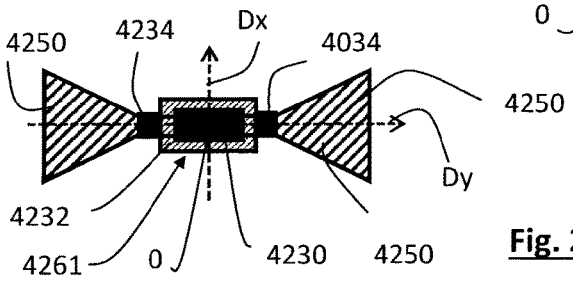

FIG. 25 shows a support structure with two parts, each carrying a vertical rail.

FIGS. 26-32 show different layouts for the angular orientation of two dolly systems a/b in a dual activity rig with respect to each other are now described with reference to their respective locations O(a), O(b) and forward directions Dx(a), Dx(b), as well as the corresponding transverse directions Dy(a), Dy(b).

Figure 33:
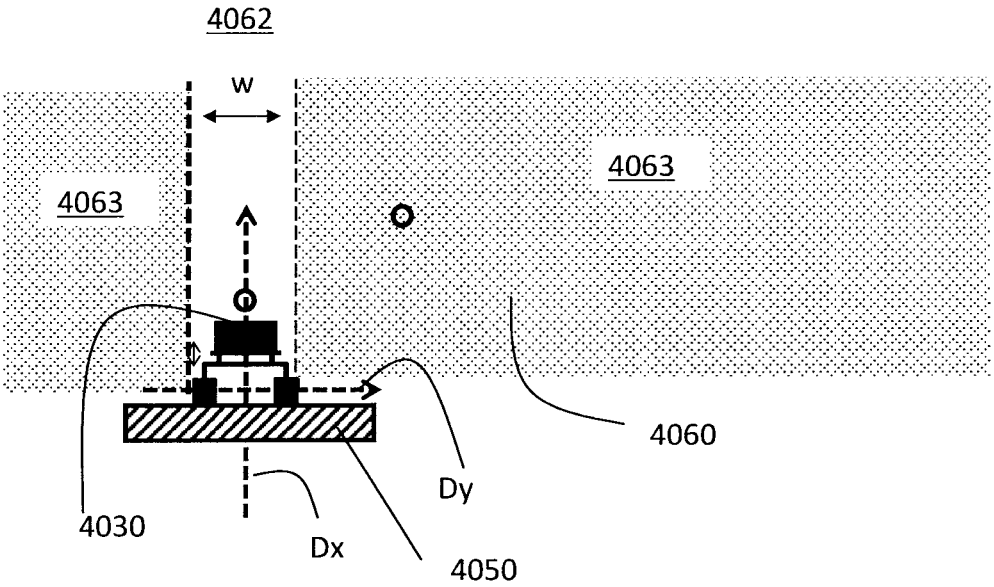

FIG. 33 shows schematically a layout of a dual activity rig having a first hoisting system and a dolly system with top drive associated therewith.

Figure 34:
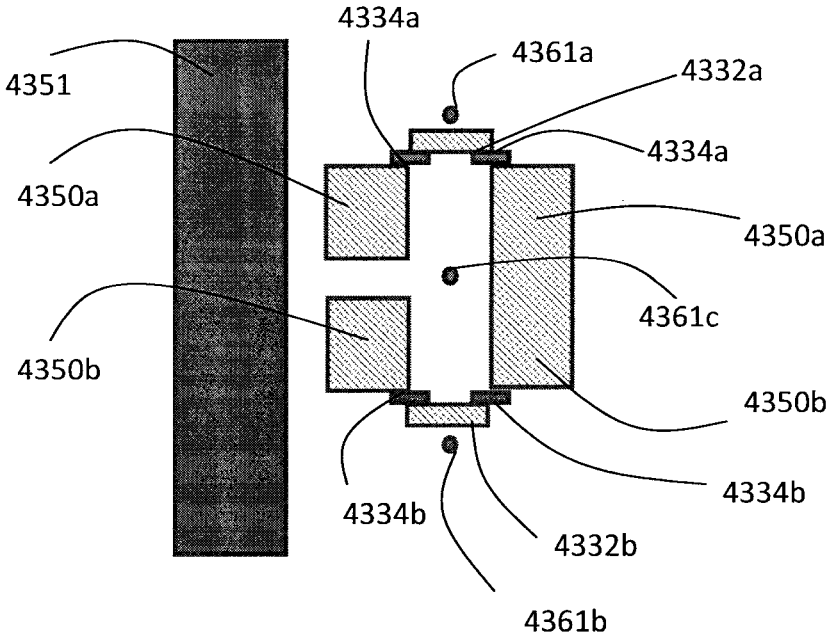

FIG. 34 shows schematically an advantageous layout according to one embodiment of a dual activity drilling rig configured for individual operation at separate well centres.

FIG. 35 illustrates another embodiment of an offshore drilling rig according to the invention showing a schematic representation of the drill deck of a side-by-side configured offshore drilling rig e.g. a drillship, semi-submersible or jack-up. The rig has two well centres (where one can optionally be another work hole) and a joint operations well centre.

Figure 36:
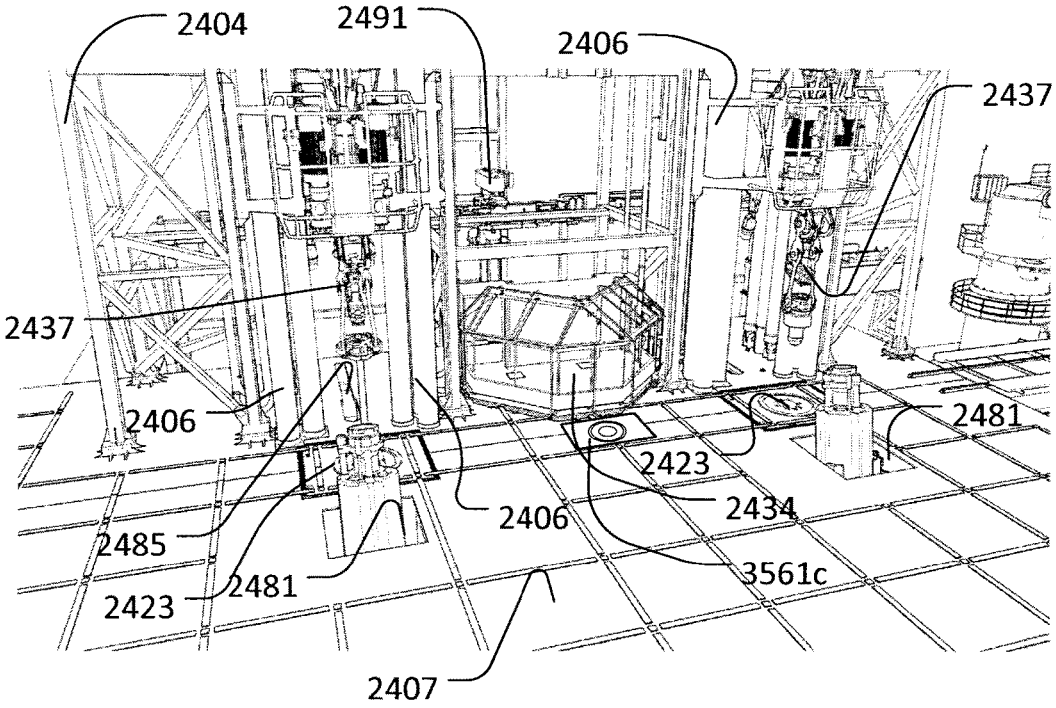
Figure 37:
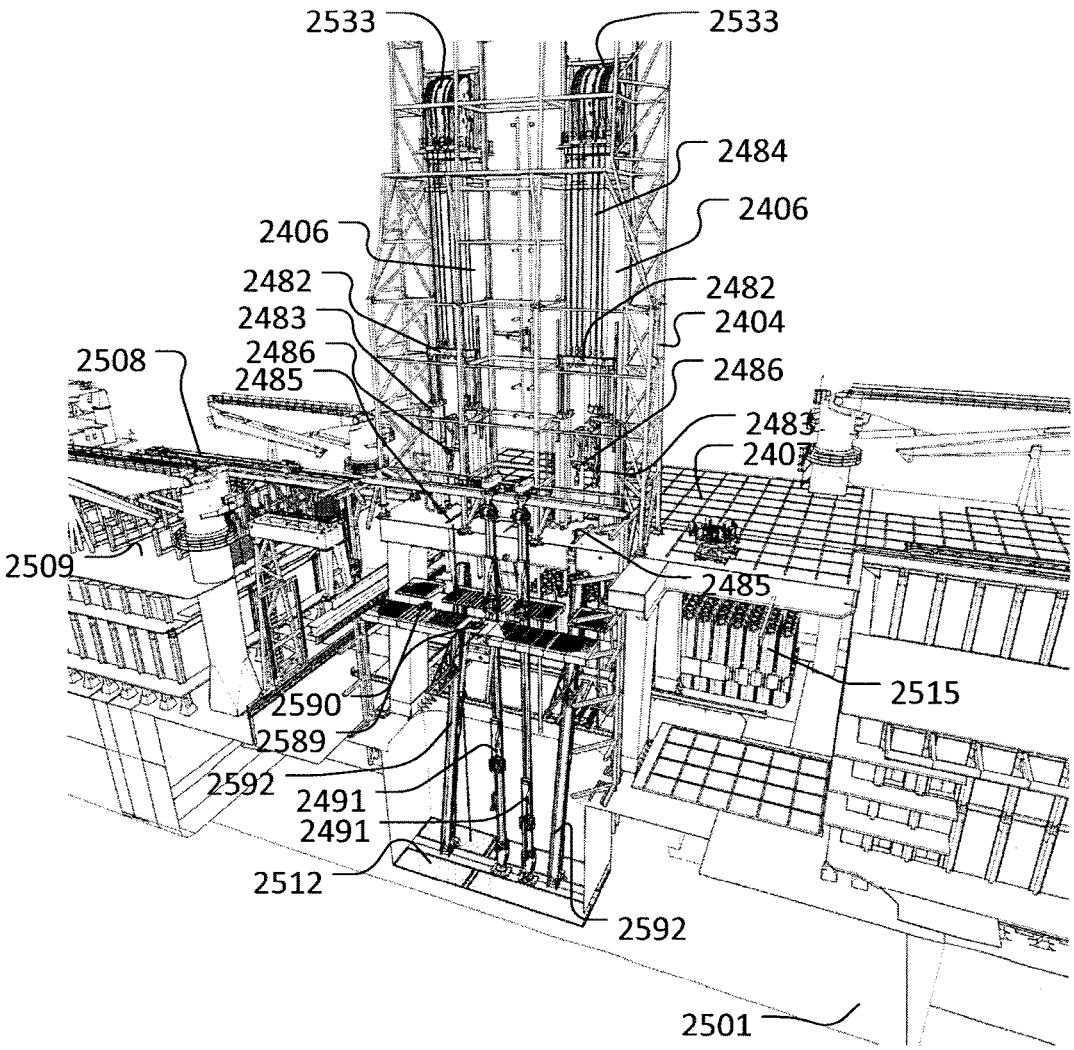
Figure 38:
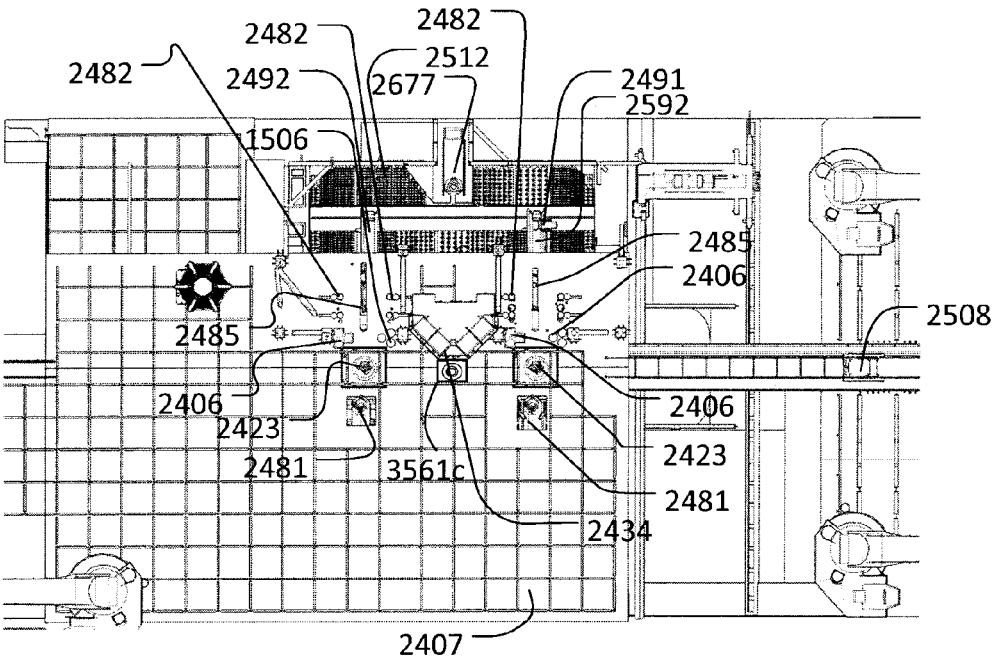
Figure 39:
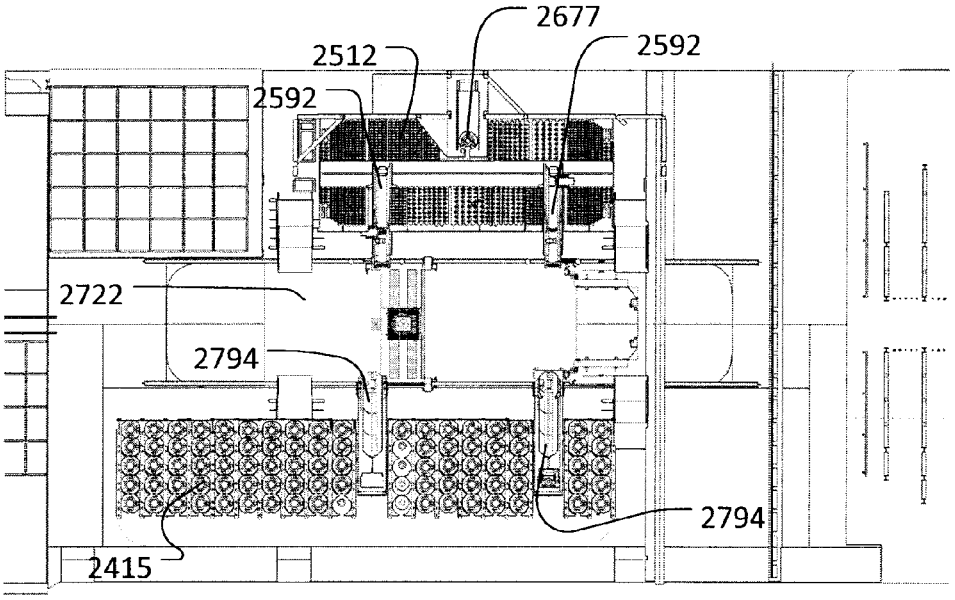
Figure 40:
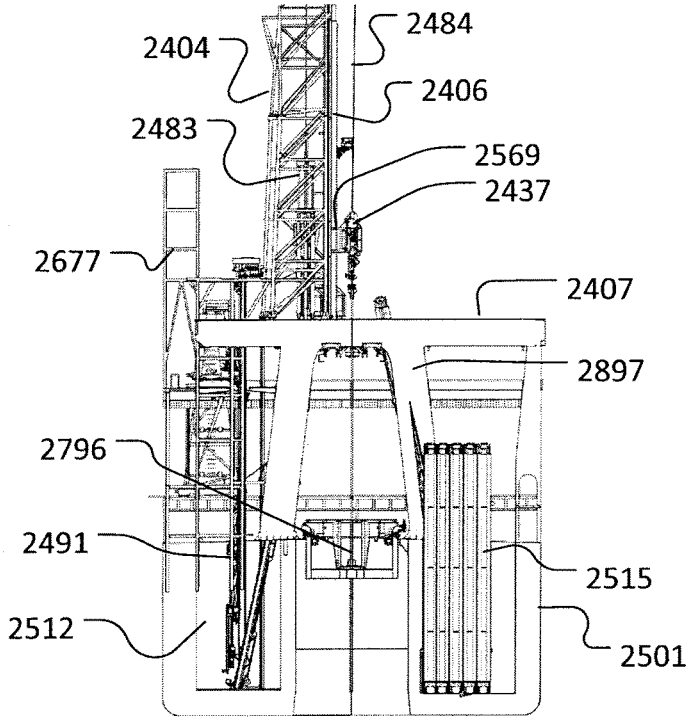
Figure 41:
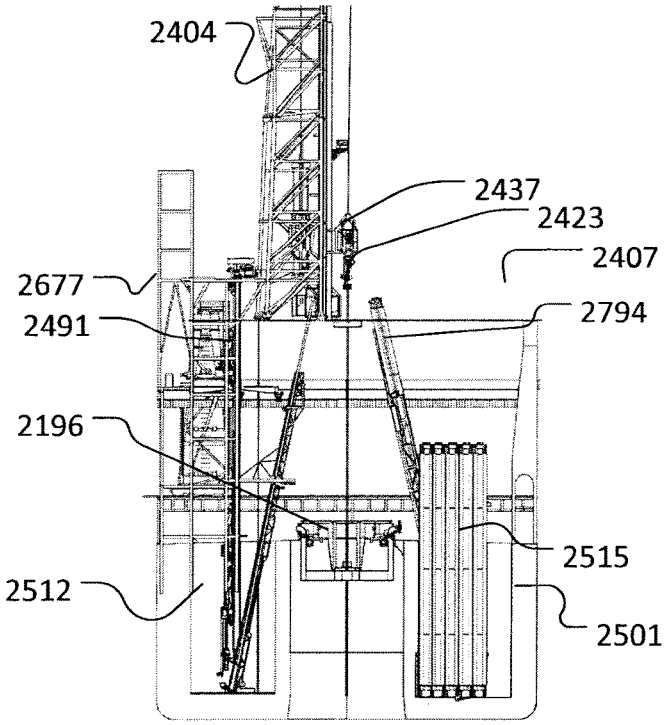
Figure 42:
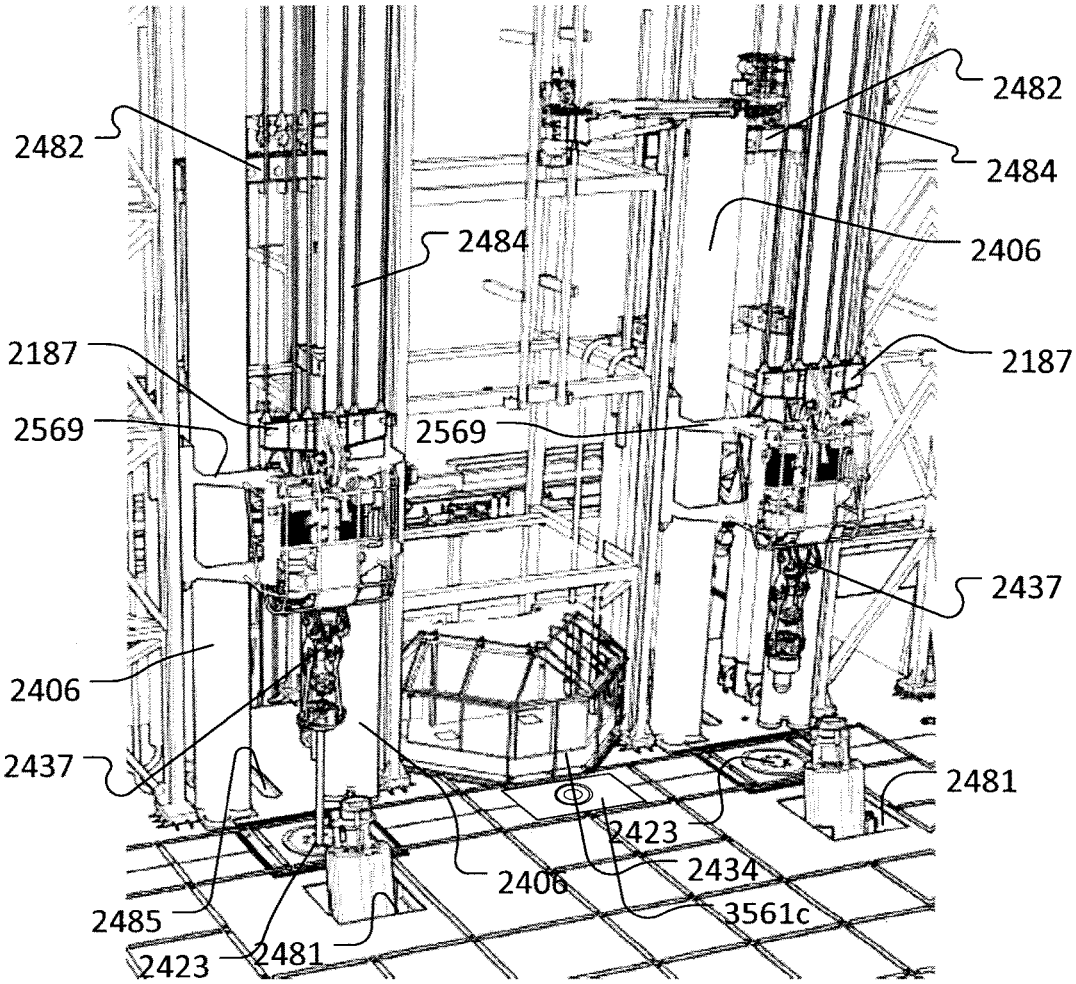

FIGS. 36-42 illustrate another embodiment of an offshore drilling rig, wherein FIGS. 36-37 show 3D views of parts of the drilling rig from different viewpoints, FIGS. 38-39 show horizontal cross-sectional views of the drilling rig, FIGS. 40-41 show lateral cross sections of the drilling rig, and FIG. 42 shows another 3D view of the drill floor seen from the starboard side of the drillship.

DETAILED DESCRIPTION OF PREFERRED EMBODIMENTS

Figure 1:
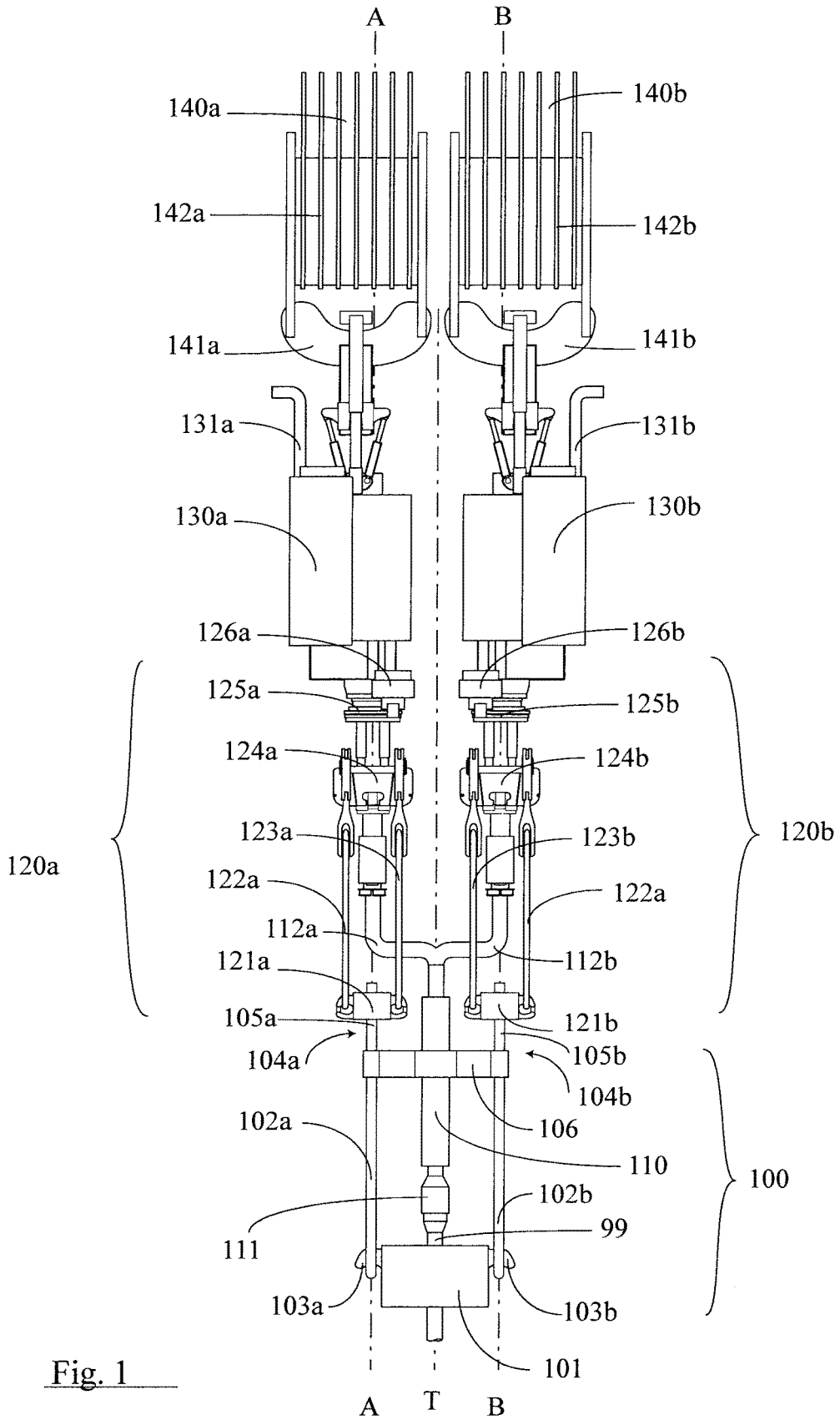

FIG. 1 shows a detail of a system for performing a heavy duty operation of lowering and/or raising a string of tubular equipment 99 into a subsea borehole, wherein the operation is to be performed through a well centre in a drill deck of an offshore drilling rig. The system uses a connecting tool 100 to connect two hoisting systems 140 with respective top drives 130 and associated pipe handling equipment 120 to perform the operation with combined lifting capacity that may exceed the safe working load rating (SWL) of the individual components 120, 130, 140. A mud handling device 110 is attached to the connecting tool 100. The mud handling device is adapted to supply drilling mud from a mud system of the drilling rig to the inside of the tubular equipment 99 through a sealing attachment 111.

The connecting tool comprises a heavy duty load bearing device 101, by which the string of tubular equipment is suspended in axial alignment with a tool axis T defined by the load bearing device 101. The connecting tool further comprises, first and second bail sections 102*a/b*, each having a lower end 103*a/b* attached to the load bearing device on opposite sides of the tool axis T, and an upper end 104*a/b* defining respective first and second coupling points 105*a/b* of the connecting tool 101.

The connecting tool further comprises a bracket 106 attached to both bail sections 102*a/b* at a location between the lower and upper ends 103*a/b*, 104*a/b*.

The bracket 106 holds the mud handling device 110, which is configured for at least filling drilling mud to the inside of the tubular equipment 99 through the sealing attachment 111. A principal direction of the sealing attachment 111 is arranged in axial alignment with the tool axis T.

In a preferred embodiment, the bail sections 102*a/b* have a first end 103*a/b*, a second end 104*a/b*, and a shaft portion connecting the first end 103*a/b* and the second end 104*a/b*, wherein the first end 103*a/b* has a bail eye or hook, and wherein the second end 104*a/b* is shaped and dimensioned as a drill pipe joint. The first end 103*a/b* is thereby configured for engaging e.g. a load bearing device 101, such as a heavy duty rated elevator, by means of a bail coupling in a conventional manner, whereas the second end is specially adapted for coupling to drill pipe lifting equipment, such as a conventional drill pipe elevator 121*a/b*. Such drill pipe elevators may be used as or be attached to a load carrier of a hoisting system, and are typically also found on pipe handling equipment of commonly used top drives as the top drives 130*a/b* shown in FIG. 1. Thereby, the bail sections 102*a/b* are specially adapted to allow for a simple attachment of the connecting tool 100 to conventional drill pipe lifting equipment. Using these modified bail sections 102*a/b* some embodiments of a connecting tool can thus be assembled using lifting components that are already known and have been proven to work under the severe requirements of subsea drilling.

At one end, the connecting tool 100 is suspended from a first coupling point by a first hoisting system 140*a* operating along a vertical first hoisting axis A. At the other end, the connecting tool 100 is suspended from a second coupling point by a second hoisting system 140*b* operating along a vertical second hoisting axis B, wherein the tool axis T is located between the first and second hoisting axes A, B. During an operation of lowering/raising tubular equipment through a well centre, the tool axis is furthermore in vertical axial alignment with the well centre.

The system is further equipped with top drives 130*a/b* suspended by load carriers 141*a/b* (here shown as yokes) of the hoisting systems 140*a/b* (here indicated as travelling blocks 142*a/b*). Associated pipe handling equipment 120*a/b* is arranged below the top drives 130*a/b*. The pipe handling equipment 120*a/b* associated with each of the top drives 130*a/b* comprises, respectively, a swivel device 125*a/b* that can be actuated by a swivel drive 126*a/b*, a link-tilt device 124*a/b*, and a pair of bails 122*a/b*, 123*a/b* carrying a drill pipe elevator 121*a/b* engaging a respective coupling point 105*a/b* of the connecting tool 100 in the form of the second (i.e. upper) end 104*a/b* of a bail section 102*a/b*. A first bail pair 122*a*, 123*a* defines a first bail plane comprising the first hoisting axis A, and a second bail pair 122*b*, 123*b* defines a second bail plane comprising the second hoisting axis B. In the embodiment of FIG. 1 the bail planes coincide, i.e. the first and second bail pairs 122*a/b*, 123*a/b* are all arranged in the same plane. This allows providing a combined link-tilt function by operating the link-tilt devices 124*a/b* in a synchronous mode—though without the possibility of swiveling the direction of the combined link-tilt function. Under heavy lifting load during a lowering/raising operation, the bail planes are vertical and coincide with the hoisting plane defined by the vertical hoisting axes A, B.

Shaft portions of the first and second bail sections 102*a/b* are arranged to extend essentially vertically along the respective first and second hoisting axes A, B. In the embodiment shown in FIG. 1, the bracket 106 bridges the bail sections 102*a/b* and is on both ends fixed to a respective bail section 102*a/b*. Thereby, the mud handling device 110 is clamped to the bail sections in a fixed relation, wherein a principal direction of the sealing attachment 111 is aligned with the tool axis T.

The top drives 130*a/b* may furthermore receive drilling mud from drilling mud supply lines 131*a/b* and supply the drilling mud to the mud handling device 110 through mud connection lines 112*a/b*. The mud connection lines may be of any suitable kind, e.g. flexible hoses, adapted to withstand any of the previously mentioned pressure ratings required for mud-filling during a lowering/raising operation.

Referring to FIGS. 2-9 in the following, further embodiments of systems for performing a heavy duty operation of lowering and/or raising a string of tubular equipment 99 into a subsea borehole are disclosed, wherein like numbers refer to like parts. The embodiments shown illustrate that a large number of combinations of the different constructional elements and functionalities can be conceived. However, the embodiments shown are not to be construed exhaustive for this large variety of combinations.

Like the system of FIG. 1, the systems shown in FIGS. 2-9 all have: a first hoisting system 140*a* being adapted for raising or lowering a first load carrier 141*a* along a vertical first hoisting a1 is A; a second hoisting system 140*b* being adapted for raising or lowering a second load carrier 141(*b*) along a vertical second hoisting axis B horizontally spaced apart from the first hoisting axis A, wherein the first and the second hoisting systems 140*a/b* are supported by a drilling support structure 150 (not shown in FIGS. 1-8) extending upwardly relative to a drill deck 160 (not shown in FIGS. 1-8); a connecting tool 100 comprising a load bearing device 101 adapted for suspending tubular equipment 99 in axial alignment with a tool axis T, wherein the connecting tool 100 is suspended from a first coupling point 105*a* by the first hoisting system 140*a*, and from a second coupling point 105*b* by the second hoisting system 140*b* such that the tool axis T is located between the first and second hoisting axes A, B and in vertical axial alignment with the well centre 161 (not shown in FIGS. 1-8); and a tubular mud handling device 110 configured for at least filling drilling mud to the inside of the tubular equipment 99 through a sealing attachment 111, wherein a principal direction of the sealing attachment 111 is arranged in axial alignment with the tool axis T. Note that each of the coupling points 105*a/b* may be suspended directly or indirectly from load carriers 141*a/b* of the respective hoisting systems 140*a/b*. In this respect, the coupling points 105*a/b* may be linked directly to the respective hoisting systems 140*a/b* or via further elements, such as intermittent top drives 130 and/or associated intermittent pipe handling equipment 120. The systems shown in FIGS. 1-9, are all equipped with top drives 130*a/b*.

In the following, only differences in the configurations relating to functionality of the shown systems are highlighted.

Figure 2:
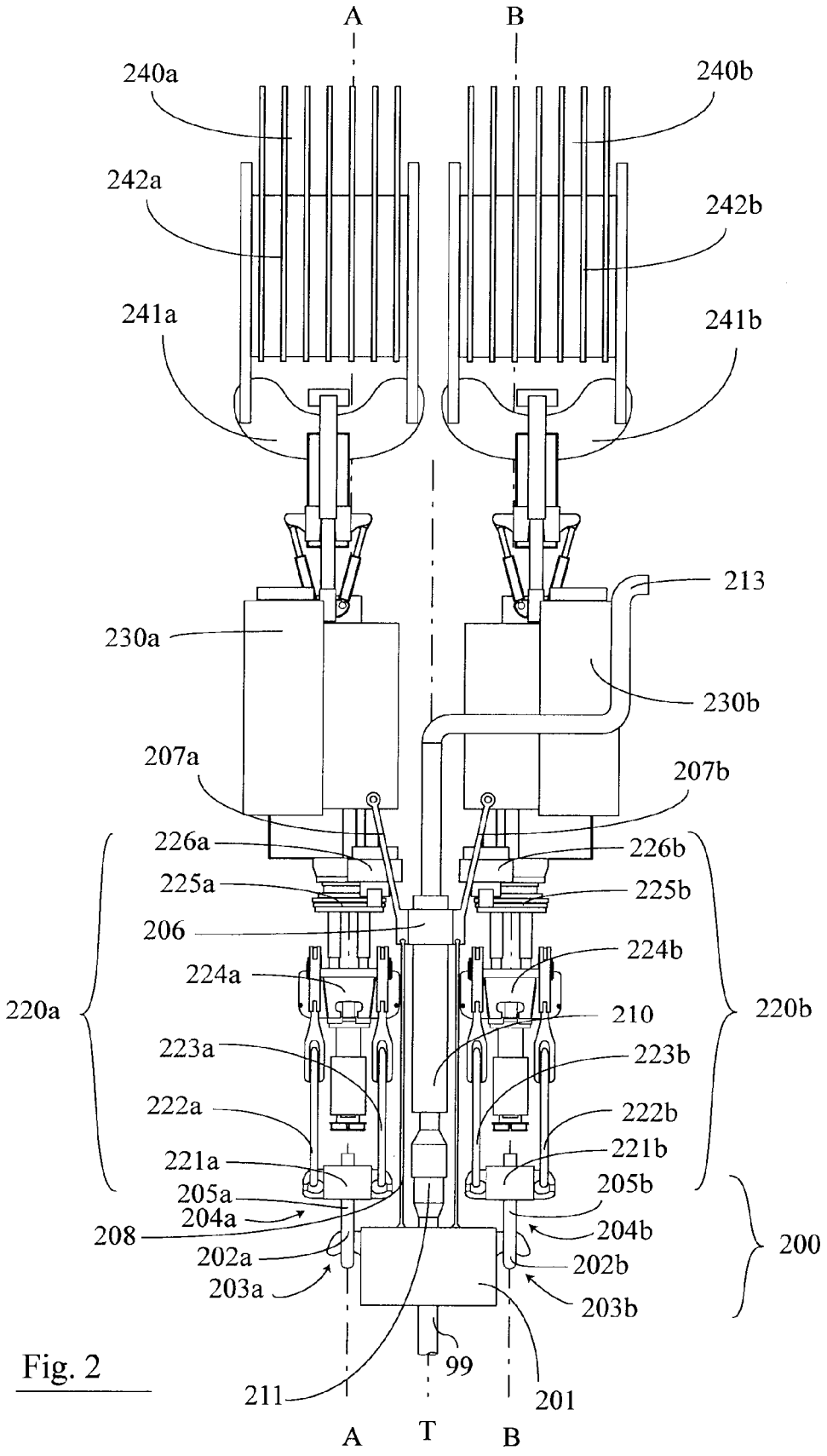

The system shown in FIG. 2 comprises an assembly with a connecting tool 200 connecting two hoisting systems 240*a/b* to operate in combination for performing an operation of lowering/raising a long string of tubular equipment 99 into/out of a deep borehole, wherein the tubular equipment 99 is suspended by a heavy duty load bearing device 201. The heavy load bearing device 201 is suspended by the first and second hoisting systems 240*a/b* by means of respective first and second bail sections 202*a/b*, which are shortened as compared to the embodiment of FIG. 1. The assembly further comprises a tubular mud handling device 210 mounted in a mounting bracket 206 between the first and second hoisting axes A/B, and suspended by the top drives 230*a/b* through pivoting joints 207 ensuring alignment with the tool axis T. Preferably, tensioners 208, are provided to strap the mounting bracket 206, and thus the mud handling tool 210, to the load bearing device 201. The tensioners 208 are adapted to counter or at least partially take up forces arising due to internal pressure inside the mud filling system 213, thereby reducing an axial load that may tend to separate the sealing attachment 211 between the mud handling device 210 and the tubular equipment 99. A mud supply line 213 connects the mud handling device 210 to a mud system of the drilling rig. The pivoting bracket-mount 206, 207, 208 suspending the mud handling device 210 at a location between the two top drives 230*a/b* allows for a compensation of accidental vertical misalignment between the first and second hoisting systems 240*a/b*, and provides a shortened design as compared to e.g. the embodiment of FIG. 1.

Figure 3:
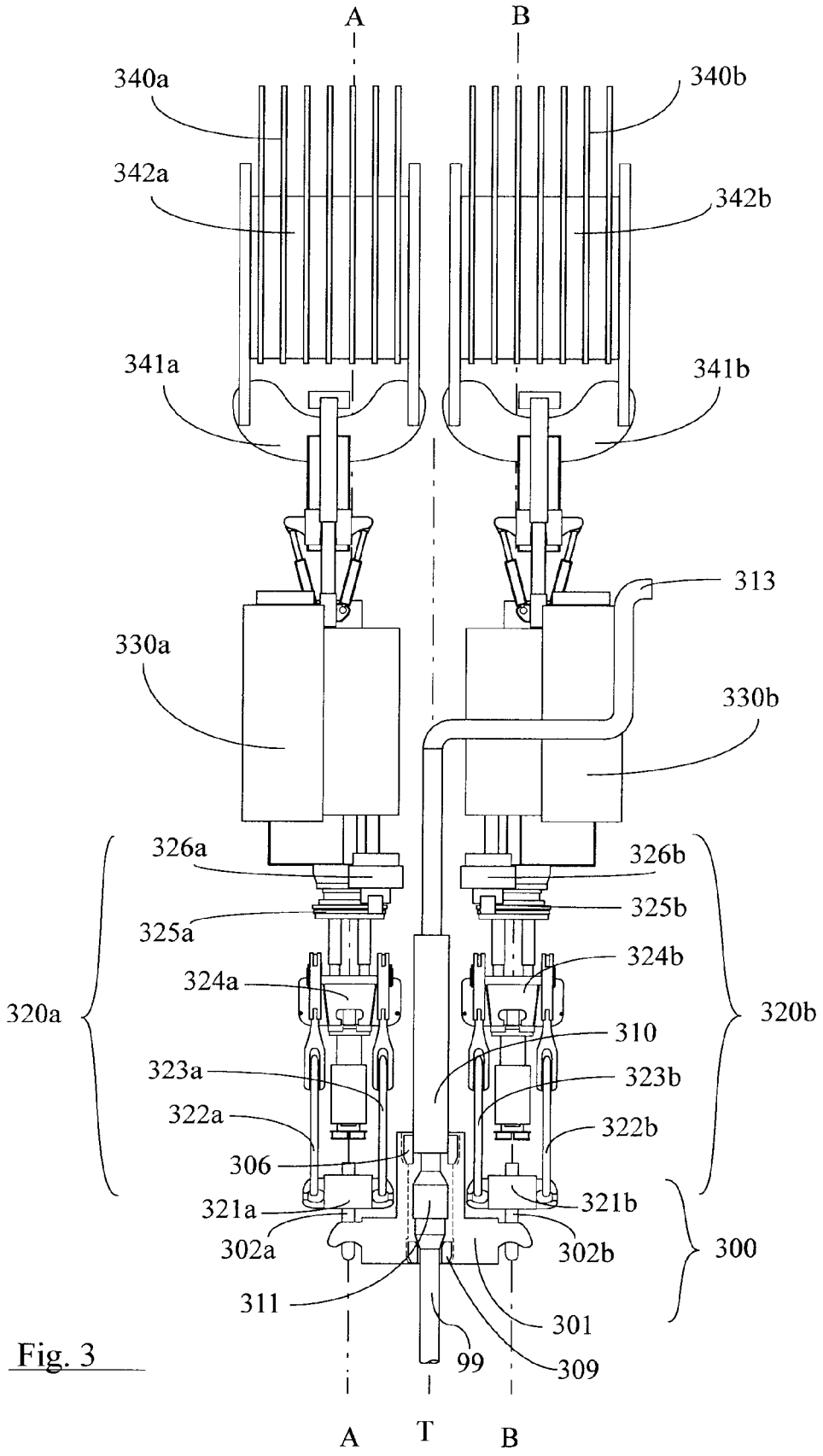

FIG. 3 shows a system with a similarly shortened design where a connecting tool 300 has a heavy duty load bearing device 301, which is suspended in drill pipe elevators 321*a/b* in first and second hoisting systems 340*a/b* by means of shortened first and second bail sections 302*a/b*. The load bearing device 301 may engage the string of tubular equipment 99 by gripping means 309, e.g. remotely controllable power slips. In the design of this embodiment, a mud handling device 310 is attached directly to the load bearing device 301 and held in place by gripping means 306.

Figure 4:
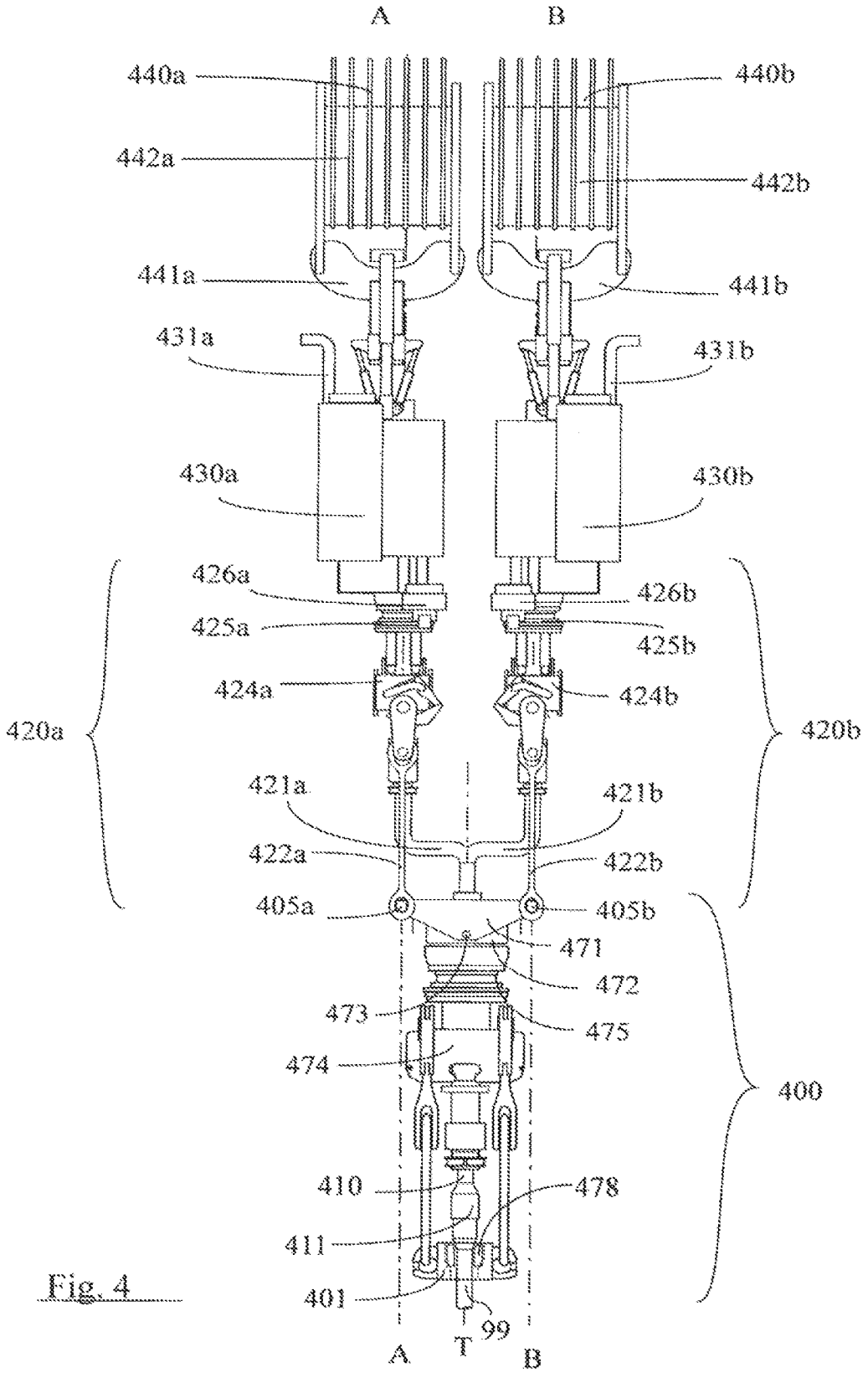

FIG. 4 shows another system where a mud handling device 410 is attached directly to the connecting tool 400. The connecting tool 400 has again a heavy duty load bearing device 401 for suspending a string of tubular equipment in axial alignment with a tool axis T, which is located between the first and second hoisting axes A/B. The connecting tool 400 has an upper gimbal frame portion 471 in the form of bars having first and second coupling points 405*a/b* on either end, from which the connecting tool 400 is suspended by first and second bails 422*a/b* and corresponding further first and second bails 423*a/b* (not shown; hidden behind the bails 422*a/b*) of the first and second pipe handlers 420*a/b* in the first and second hoisting systems 440*a/b*. The bails 422*a*, 423*a* and the bails 422*b*, 423*b* form respective first and second bail pairs, each defining a vertical bail pair plane, which is perpendicular to the hoisting plane defined by the vertical first and second hoisting axes A/B, wherein the upper gimbal frame portion 471 of the connecting tool 400 is free to pivot about first and second pivot axes, which are defined by the first and second coupling points 405*a/b* in directions perpendicular to the hoisting plane. The connecting tool 400 has furthermore a lower gimbal frame portion 472 suspended from a gimbal axis 473, wherein the gimbal axis 473 is likewise perpendicular to the hoisting plane, and intersects the tool axis T. A mud handling device 410 is mounted coaxially in the lower gimbal frame portion 472, i.e. in axial alignment with the tool axis T. The mud handling device 410 can engage the tubular device in an axial direction via sealing attachment 411 operating along the tool axis T. The connecting tool 400 is furthermore equipped with a pipe handling section between the lower gimbal frame portion 472 and the heavy duty load bearing device 401. The pipe handling equipment comprises a link tilt device 474 for tilting a lower section of the connecting tool 400 comprising the heavy duty load bearing device 401, e.g. for picking up or dropping off tubular equipment 99 from an off-axis location. When the link tilt 474 is activated, the tool axis T is bent about a horizontal axis. The tubular mud handling device 410 is therefore equipped with a flexing portion at the location of the link tilt axis (not shown). The pipe handling equipment of the connecting tool 400 further comprises a swivel device 475 for rotation about a vertical swivel axis, which is coaxial with the tool axis T at the location of the swivel device 475, i.e. at a location above the link tilt axis. Note that the pipe handling equipment of the connecting tool 400 has to be SWL-rated for the heavy duty load capacity required for the combined lifting task. The load bearing device 401 may engage the string of tubular equipment 99 by gripping means 478, e.g. remotely controllable power slips, so as to engage the tubular equipment 99 for applying axial torque and to perform an axial rotation around the tool axis. The embodiment of FIG. 4 has an increased complexity, but has the advantage of comprising a high degree of integrated functionality for performing a large number of functions. The embodiment also provides compensation for accidental vertical misalignment of the first and second hoisting systems 440*a/b*.

The system is further equipped with top drives 430*a/b* suspended by load carriers 441*a/b* (here shown as yokes) of the hoisting systems 440*a/b* (here indicated as travelling blocks 442*a/b*), Associated pipe handling equipment 420*a/b* is arranged below the top drives 430*a/b*. The pipe handling equipment 420*a/b* associated with each of the top drives 430*a/b* comprises, respectively, a swivel device 425*a/b* that can be actuated by a swivel drive 426*a/b*, and a link-tilt device 424*a/b*. The top drives 430*a/b* may furthermore receive drilling mud from drilling mud supply lines 431*a/b* and supply the drilling mud to a mud handling device through mud connection lines 412*a/b*. The mud connection lines may be of any suitable kind, e.g. flexible hoses, adapted to withstand any of the previously mentioned pressure ratings required for mud-filling during a lowering/raising operation.

Figure 5:
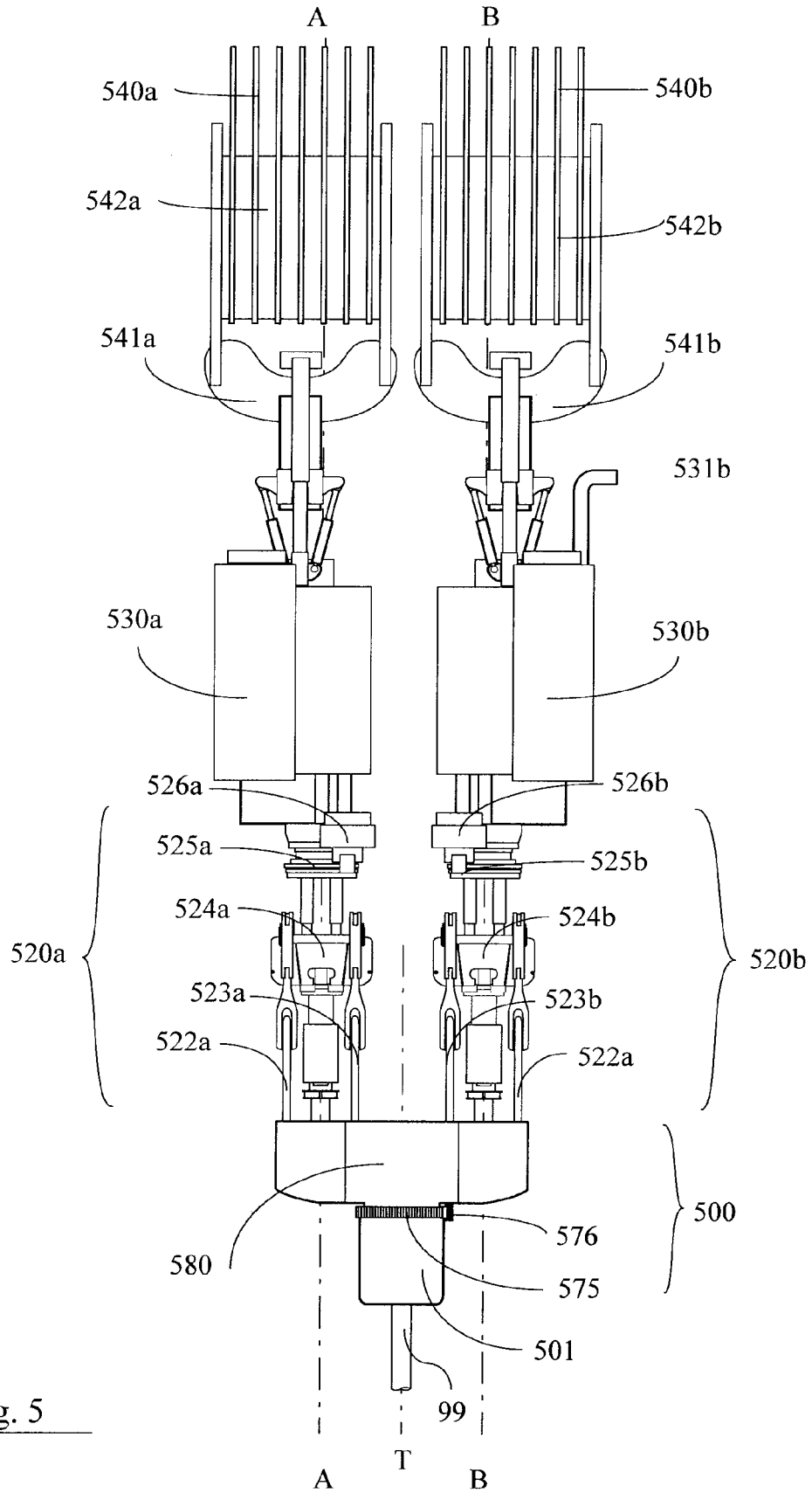

Referring to FIGS. 5 and 5*a*, a system with a comparable high level of functionality is shown. However, the system of FIGS. 5, 5*a* exploits the functionality of the first and second top drives 530*a/b* present in the system. Connecting tool 500 has a frame portion 580, a swivel device 575 with a swivel drive 576 for rotating a heavy duty load bearing device 501 around a swivel axis that is in axial alignment with the tool axis T. Frame portion 580 is directly suspended by first and second bails 522*a/b*, 523*a/b* of the pipe handlers 520*a/b* in the first and second hoisting systems 540*a/b*, As best seen in FIG. 5*a*, the tubular equipment 99 is held by the load bearing device 501 in axial alignment with the tool axis T. The sealing attachment 511, e.g. in the form of a press-fit seal, allows for rotation about the tool axis T. The mud handling device 510 is connected to the mud handling system of the drilling rig via the first top drive 530*a*, and the mechanical power input of the swivel drive 576 is via a transmission gear connected to a rotary drive of the second top drive 540*b*. Gripping means 578 allow for engaging the tubular equipment 99 for applying axial torque and to perform an axial rotation around the tool axis T.

Figure 6:
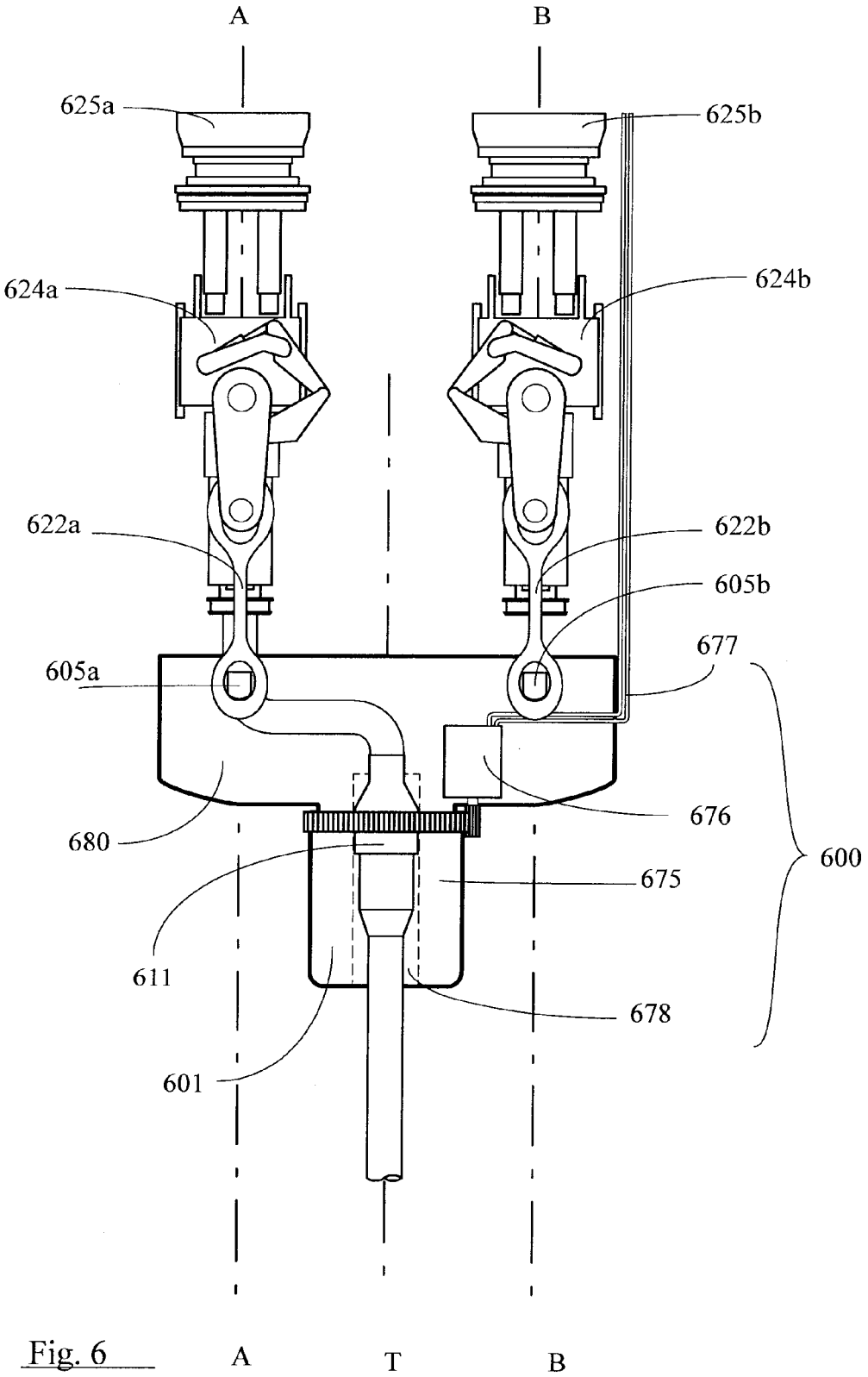

The system of FIG. 6 largely resembles the system of FIG. 5, but with rotated bail planes as defined by the bails 622*a/b* and 623*a/b*, and with an internal swivel motor for the swivel drive, which is supplied with power through input 677, e.g. in the form of hydraulic lines or electric lines. Gripping means 678 allow for engaging the tubular equipment 99 for applying axial torque and to perform an axial rotation around the tool axis T.

Figure 7:
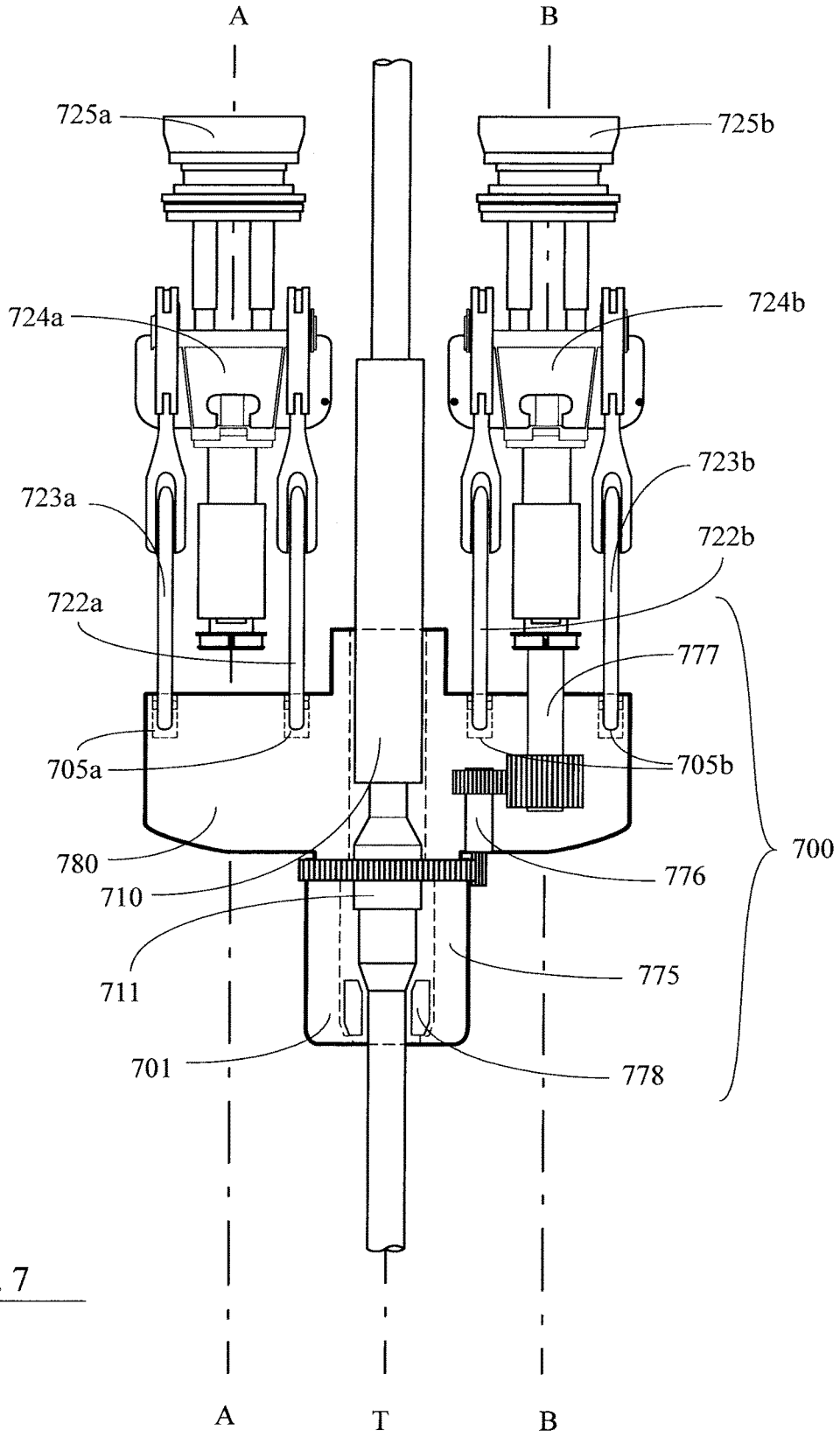

FIG. 7 shows yet a further variation of a system with a connecting tool 700 having a frame portion 780, which is suspended by bails 722*a/b*, 723*a/b*, all arranged in the hoisting plane. A mud handling tool 710 is attached directly to the frame portion 780 of the connecting tool 700 in axial alignment with the tool axis T. The system also has a swivel function driven by the second top drive, and gripping means 778 allow for engaging the tubular equipment 99 for applying axial torque and to perform an axial rotation around the tool axis T.

Figure 8:
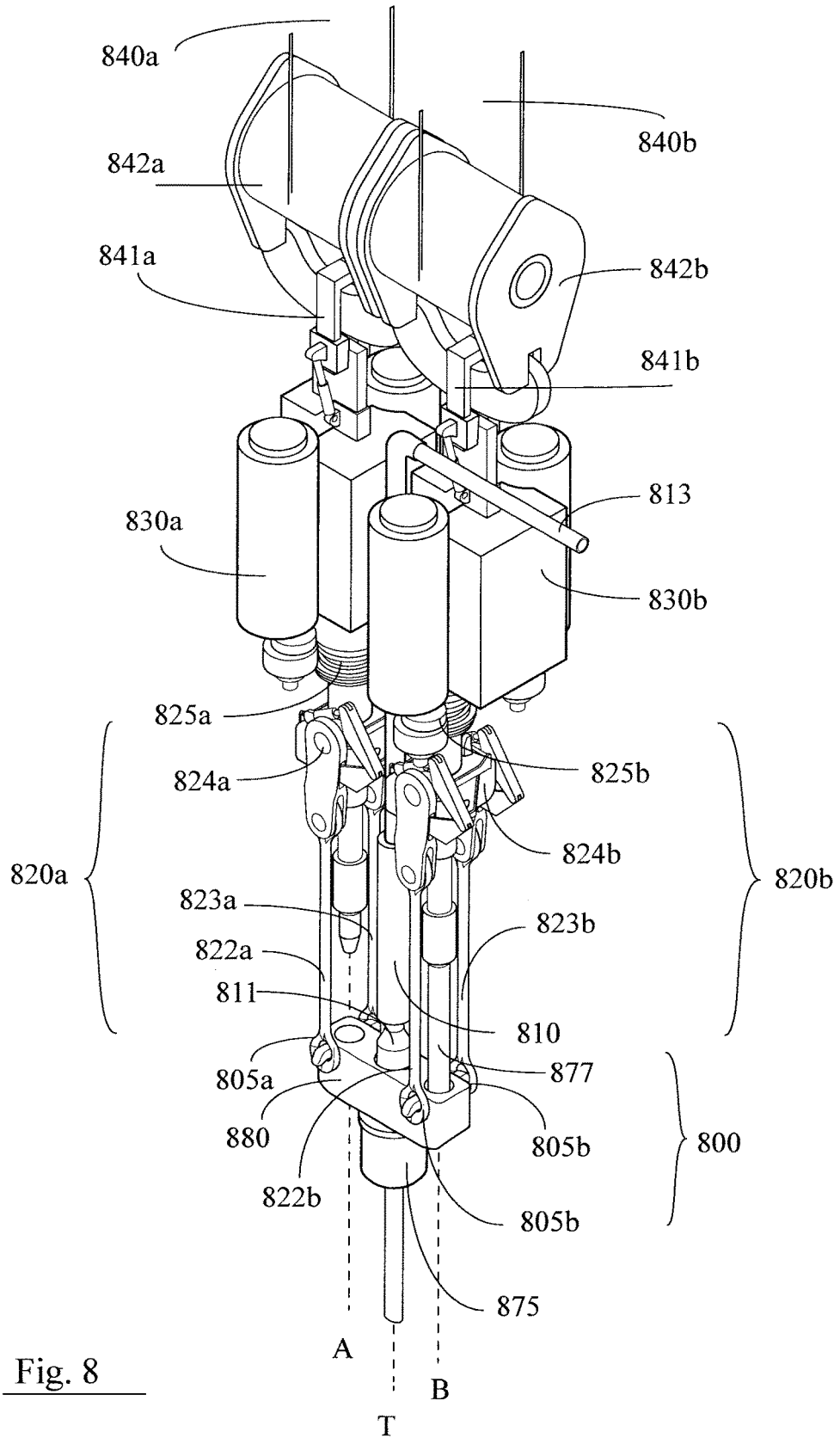

FIG. 8 shows a perspective elevation of a system corresponding to that shown in FIG. 7, only with vertical bail planes that are perpendicular to the hoisting plane.

Figure 9:
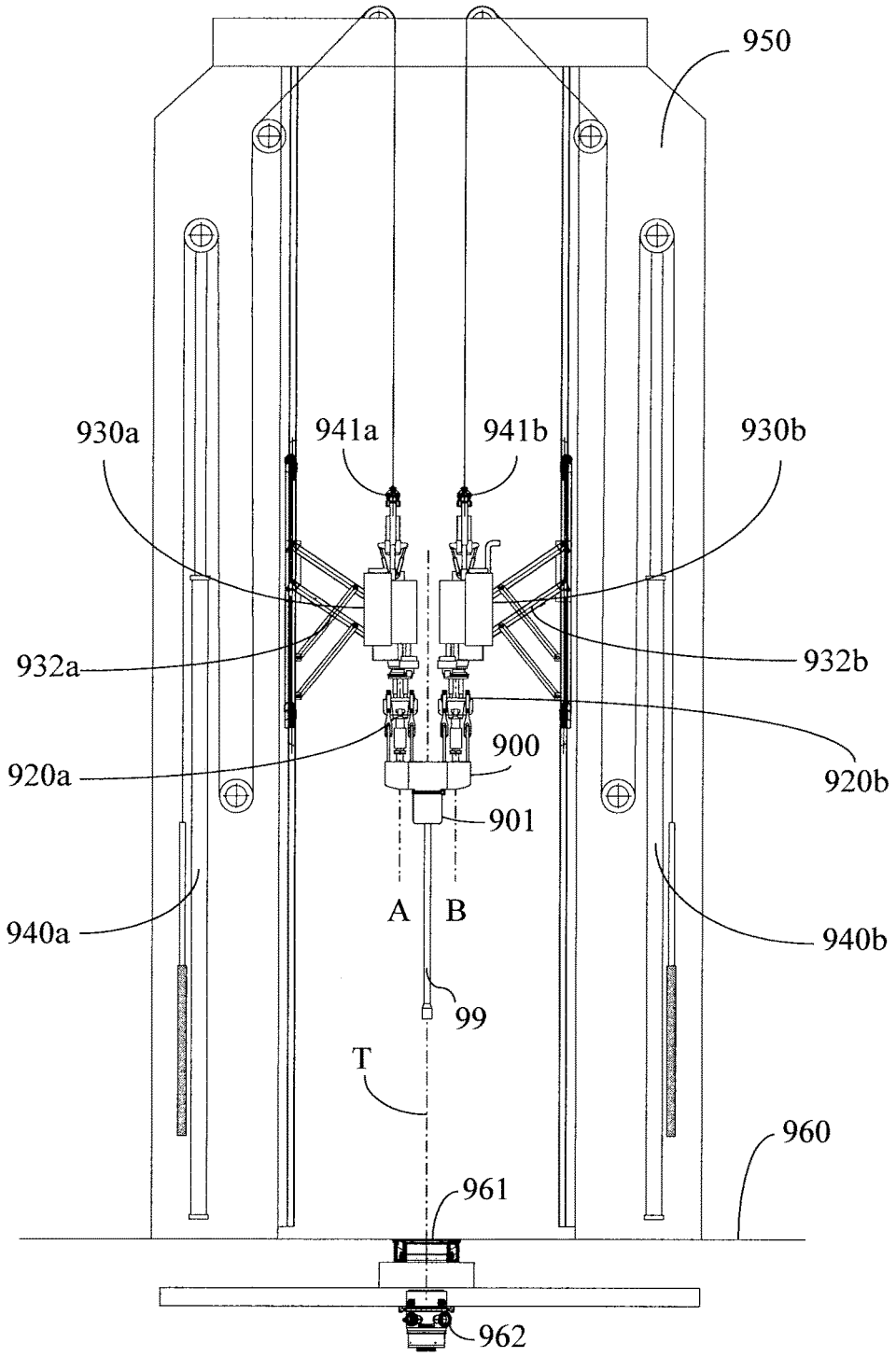

FIG. 9 shows an overview of a set-up with a system as described above. The set-up is for use on a drilling rig. A drill deck 960 has a well centre 961 with a diverter system 962 arranged below the drill deck 960. A support structure 950 extends upwardly relative to the drill deck 960. The support structure supports first and second hoisting systems 940*a/b*, each being adapted for lifting a respective load carrier 941*a/b* along a vertical hoisting axis A/B. The system further comprises top drives 930*a/b* suspended by the load carriers 941*a/b* and held by retractable vertical travelling dollies 932*a/b*. The top drives 930*a/b* are equipped with pipe handlers 920*a/b*. The two hoisting systems 940*a/b* with the installed top drives 930*a/b* and associated pipe handlers 920*a/b* are connected by connecting tool 900 so as to cooperate in a synchronous manner for lowering/raising tubular equipment 99 along a tool axis T into/out of a deep borehole as discussed above.

While the embodiments of FIGS. 5-9 do not comprise a function for the compensation of accidental vertical misalignment between the first and second hoisting systems x40a/b, the systems may be modified to provide such misalignment compensation. For example, the connecting tool 600 of FIG. 6 may be modified to comprise an upper frame portion in the form of bars with coupling points arranged at either end and connected to a lower frame portion via an axis that is perpendicular to the hoisting plane in a similar manner as in FIG. 4, where the upper frame portion 471 suspends the lower frame portion 472 via axis 473.

Figure 10:
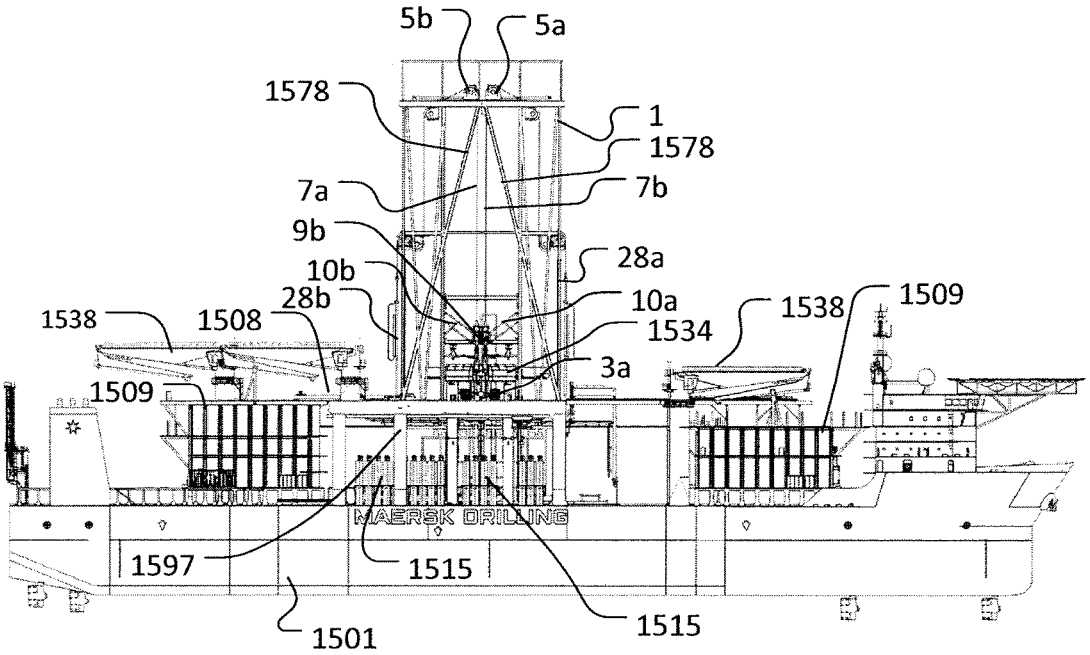
Figure 11:
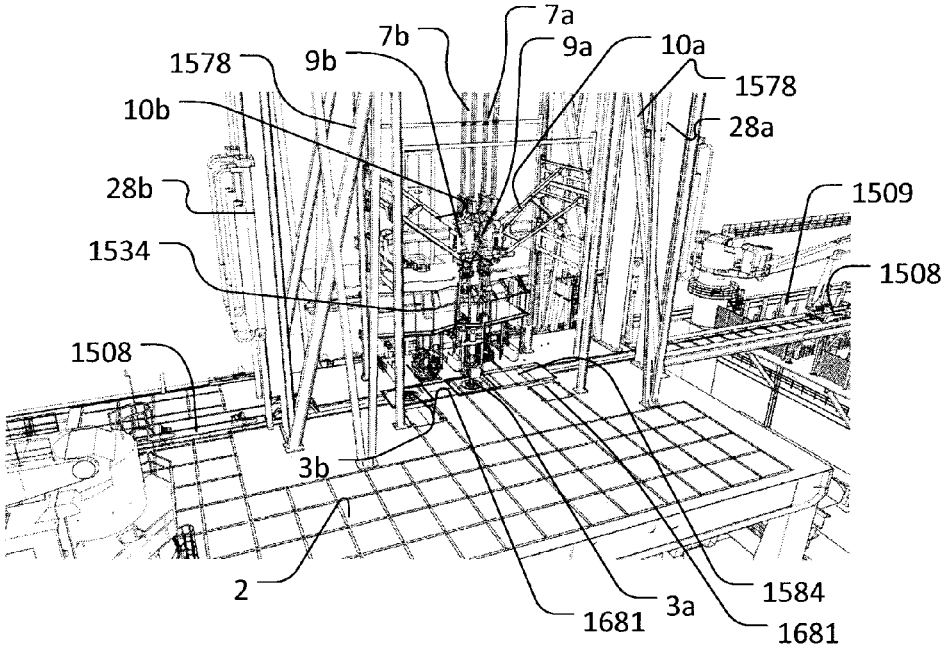
Figure 12:
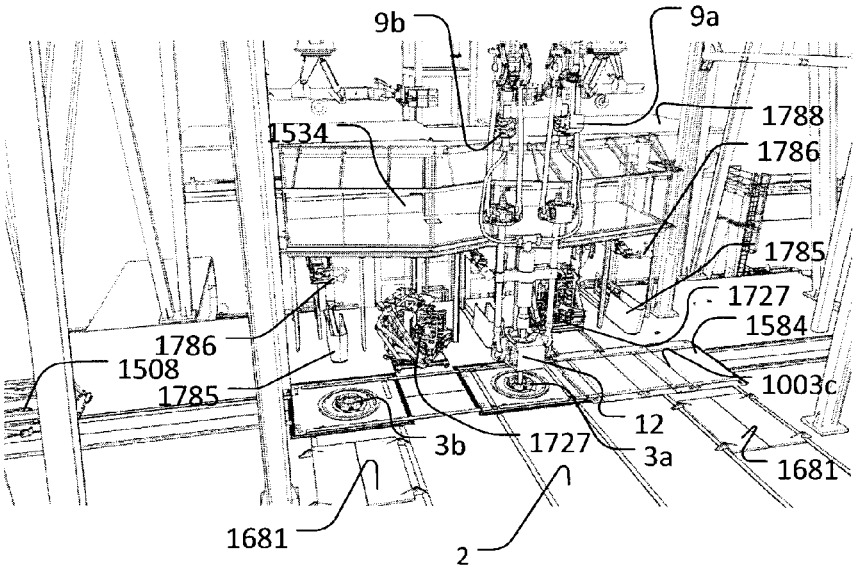
Figure 13:
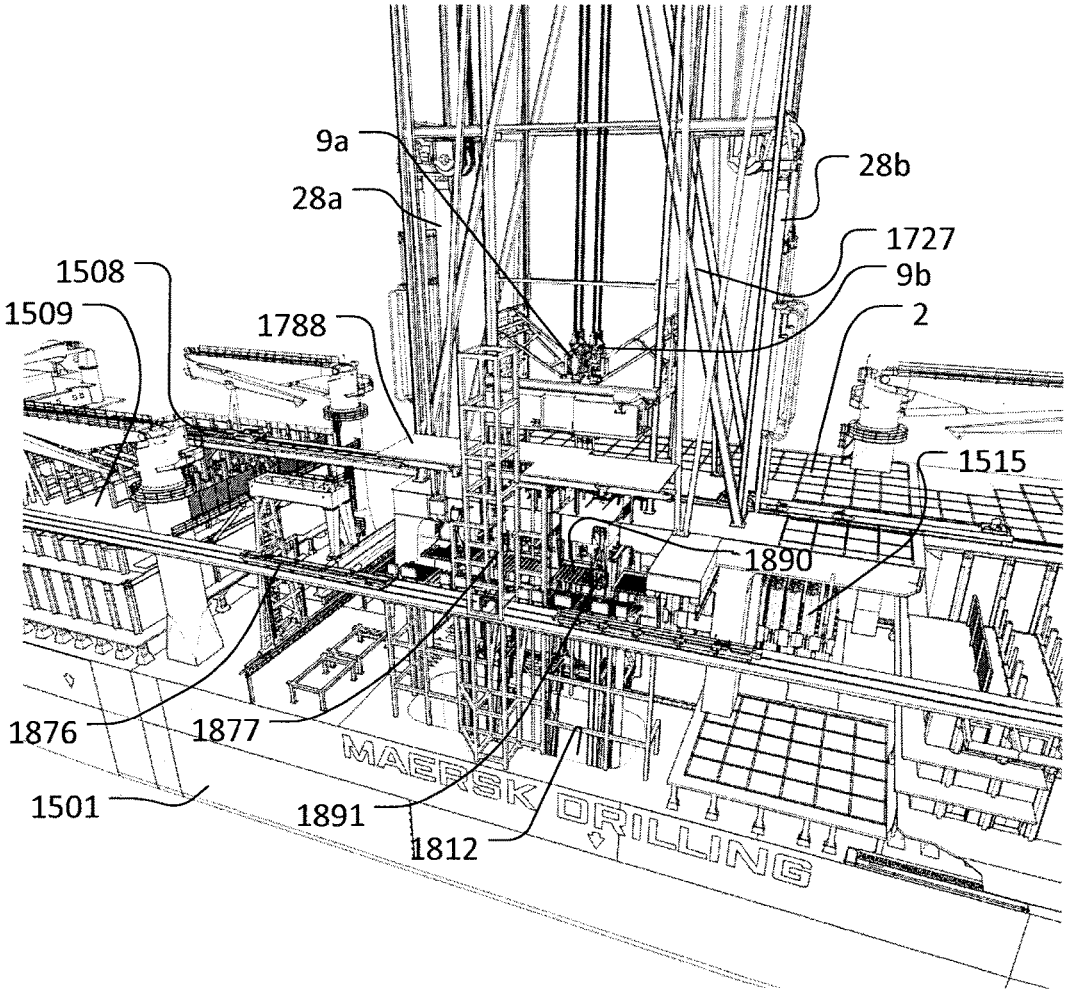
Figure 14:
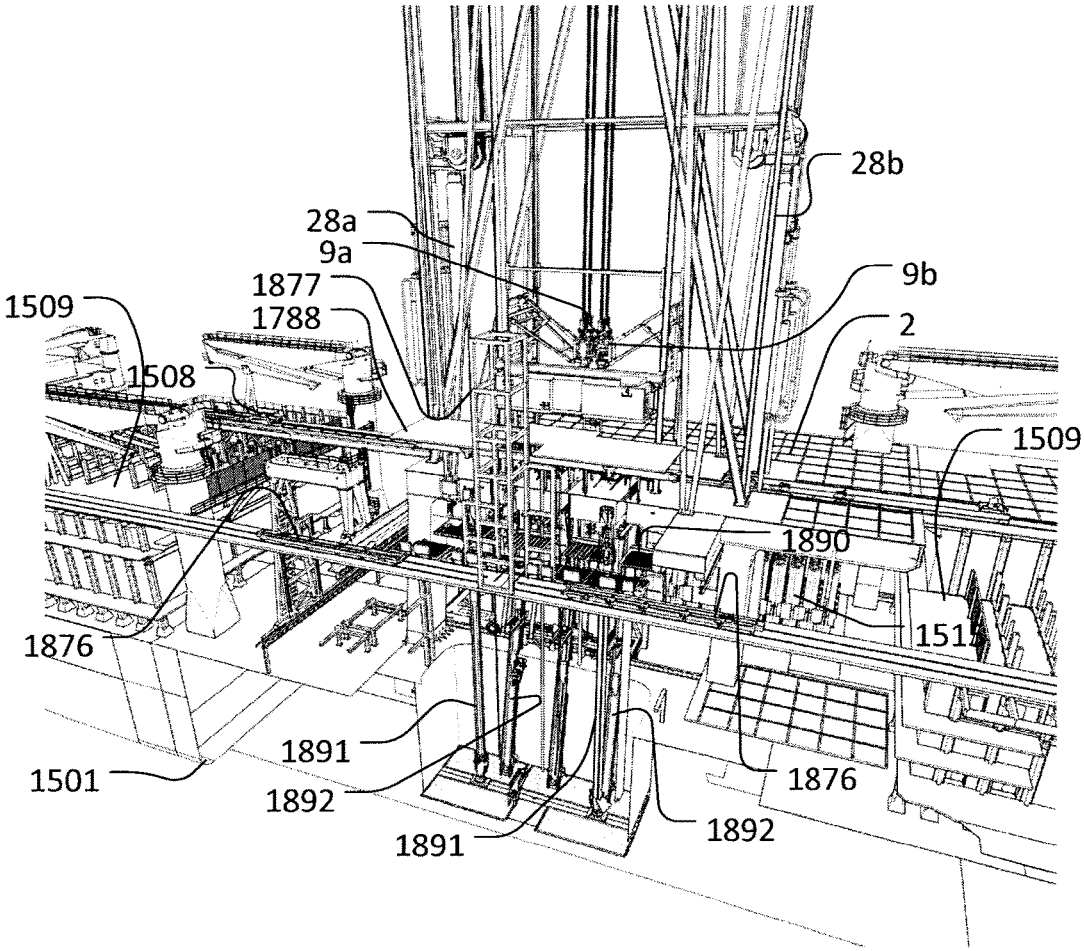
Figure 15:
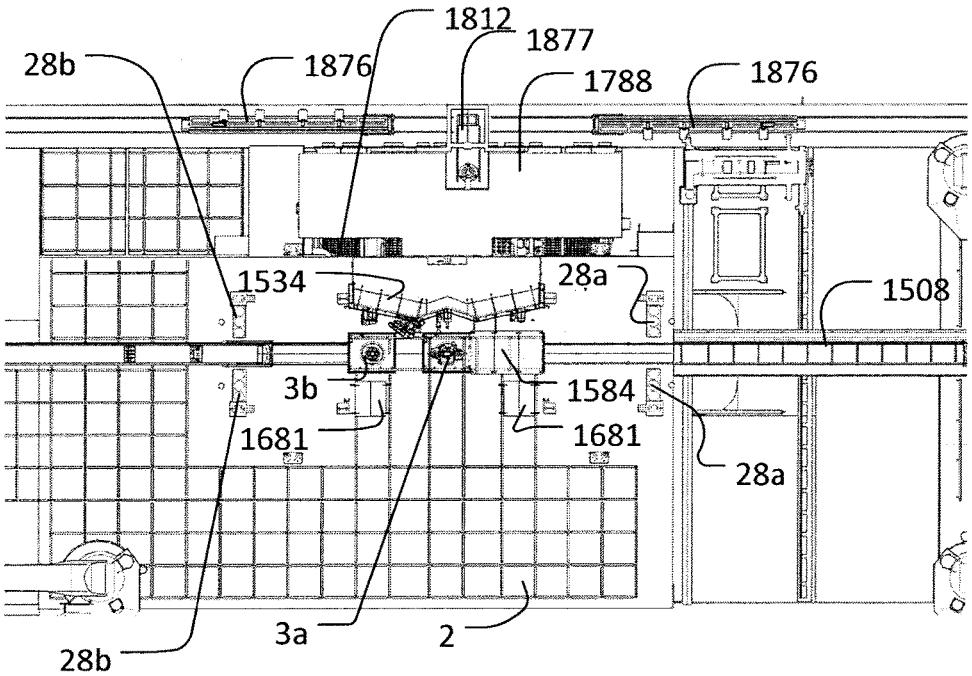
Figure 16:
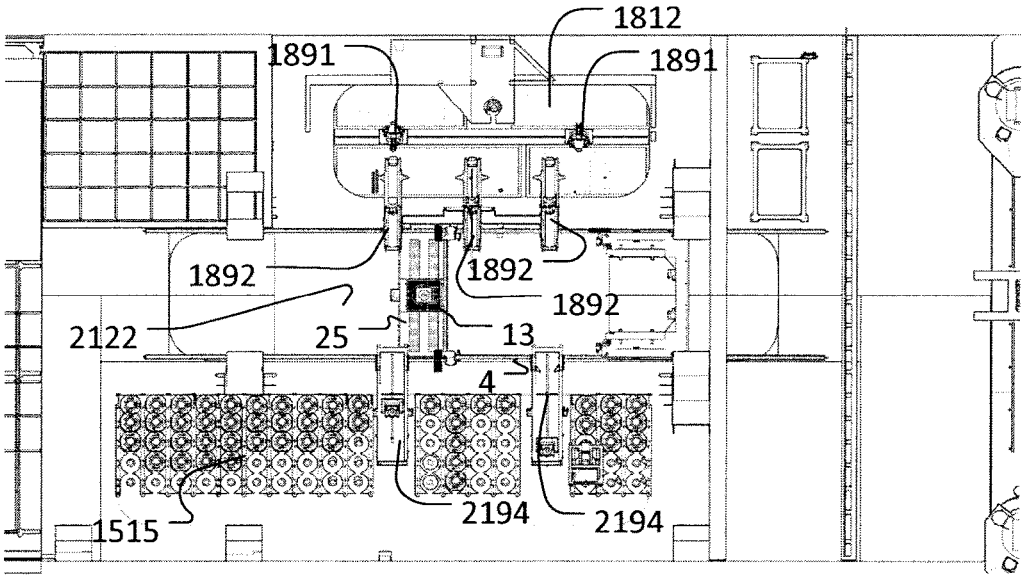
Figure 17:
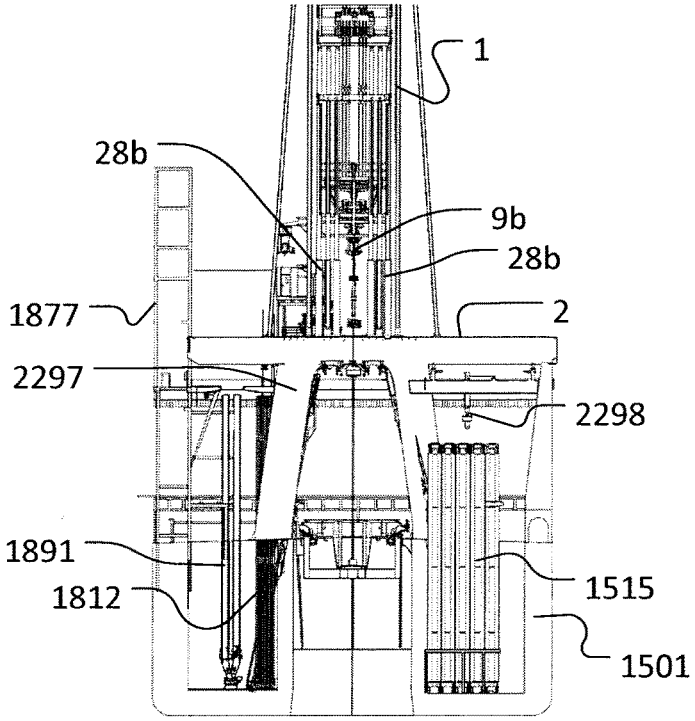
Figure 18:
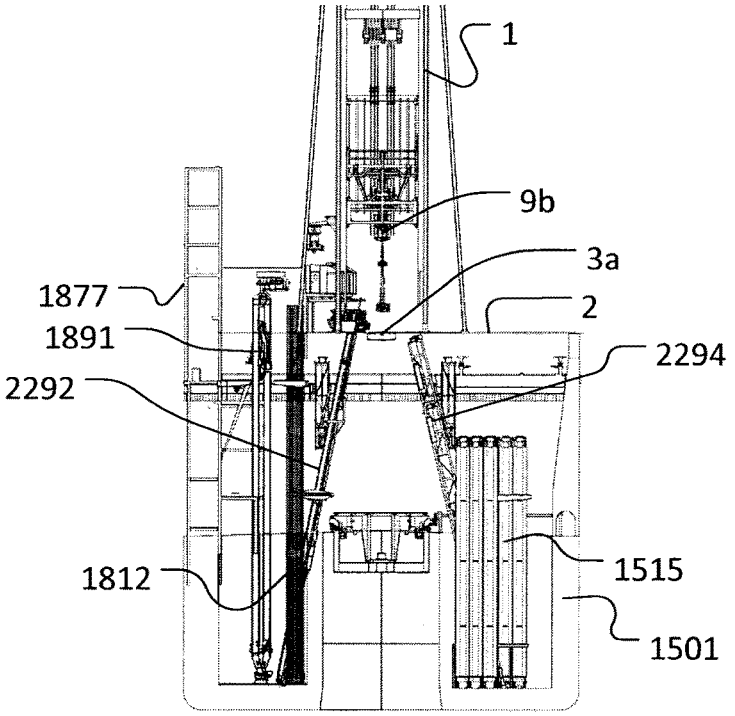

FIGS. 10-18 show an embodiment of a drilling rig, in this example a drillship having a hull 1501. In particular, FIG. 10 shows a side view of the drilling rig, FIGS. 11 and 12 show views of the drill floor seen from the starboard side of the drillship, FIGS. 13 and 14 show views of the drill floor seen from the port side of the drillship (a part of the hull of the ship is cut away in FIG. 14); FIGS. 15 and 16 show horizontal cross sections in a plane above the drill deck and a plane below the drill deck, respectively; finally, FIGS. 17 and 18 show lateral cross sections of the drill ship.

The drilling rig of the present embodiment comprises a drill deck 2 formed on top of a substructure 1597. The substructure comprises a platform supported by legs. The platform defines the drill deck and spans across a moon pool 2122 formed in the hull of the drillship. The drill deck 2 comprises two holes defining well centres 3*a,b*. The drilling rig comprises a drilling support structure in the form of a mast 1. In the present example, the well centres are located within the footprint of the mast 1. The mast includes two mast portions, each associated with, and adjacent to, one of the well centres. The dual activity mast 1 is supported by the substructure 1597 and extends upwardly from the drill deck 2. The mast comprises two mast portions arranged in a face-to-face configuration, i.e. the respective mast portions are located along the axis connecting the well centres such that both well centres are located between the mast portions. Each mast portion supports a hoisting system, each for lowering a drill string through a respective one of the well centres 3*a,b* towards the seabed.

Each of the two hoisting systems may be operable to lower tubulars selectively through a work centre at each of at least two horizontal positions, such as the central position (where the well centre 3*a* is located in the example of FIG. 12) and one of the peripheral positions (3*b*, 1003*c*). To this end, the mast 1 carries two cable crowns 5*a,b*, e.g. in the form of a crown sheave cluster or in the form of a crown block, being skidably arranged on the top of the mast on separate tracks. From each of the cable crowns lifting cables 7*a,b* are running down and connect to a corresponding top drive 9*a,b* which is suspended from a hook or other load carrier connected to the lifting cables. Each of the top drives is connected via a retractable dolly 10*a,b* to a vertical track arranged at the mast 1. The retractable dollies are each adapted so that they can position and keep the top drives in different positions above the well centres.

Each hoisting system has one or more linear actuators in the form of a hydraulic cylinder 28*a,b* having its lowermost end fixed with respect to the drill deck and an upper travelling end with a cable sheave. At least one lifting cable has one end extending from another hydraulic cylinder arranged for compensating heave during e.g. drilling operation, and over the travelling cable sheave and further below a second cable sheave being fixed with respect to the mast, and thereafter over the cable crown. The hydraulic cylinders are displaced from the well centres along the direction connecting the well centres and positioned such that both well centres are located between the cylinders of the respective hoisting systems. As can be most easily seen on FIG. 15, the cylinders of each hoisting system are further (optionally) arranged in two groups of cylinders positioned on either side of an axis connecting the well centres so as to form a gap through which a catwalk machine 1508 or other pipe handling equipment can travel and feed tubulars to one or both of the well centres. Each cable crown 5*a,b* defines an axis that is parallel to the direction connecting the two groups of cylinders of one of the hoisting systems.

As is most easily seen in FIG. 12, both hoisting systems may cooperate so as together to lower or raise tubulars through the same well centre, e.g. the well centre 3*a*, when located at a central position as illustrated in FIG. 12. To this end, a connecting tool 12 may be arranged to connect the top drives 9*a,b*. In this example, the connecting tool is in the form of an elevator and bail sections connected to said elevator in one end and suitable for being lifted by second elevators, each being connect to a respective top drive 9*a,b* via bails in the conventional manner. a stabbing and circulation device (e.g. in the form a casing fill-up and circulating system tools or flow back & circulation tools for drill pipe (CFT)) is mounted between the bail sections and further connected to a mud connection, preferably of one or both (as illustrated here) of the top drives. Thereby it is possible to connect a load to the connecting tool 12, so that it is possible to provide a lifting force by combining the lifting force of both hoisting systems lifting the connecting tool. To better support increased loads, the mast comprises diagonal beams 1578 forming an inverted V.

The drilling rig further comprises a pipe storage area 1509 for storing pipes in horizontal orientation and catwalk machines 1508 or other horizontal pipe handling equipment for transporting pipes between the storage area 1509 and the well centres 3*a,b*. To this end, the catwalk machines are aligned with the axis defined by the two well centres.

The drilling rig comprises a setback structure 1812 or similar pipe storage structure for storing stands of tubulars below the substructure 1597 and partly covered by the drill deck 2. The setback structure comprises a support framework 1890 supporting fingerboards having horizontally extending fingers between which tubulars may be stored. The setback structure is arranged so as to allow stands to be moved to/from both well centres from/to the setback. To this end, one or more column rackers 1891 or similar vertical pipe handling equipment may be arranged to move stands into and out of the setback structure 1812. The setback structure 1812 further comprises stand building equipment 1877 configured to build stands from individual pieces of pipe. The setback structure 1812 is located adjacent the moon pool 2122 laterally displaced from the axis defined by the well centres.

Moreover the drilling rig comprises one or more further catwalk machines 1876 configured to feed tubulars from the pipe storage area 1509 or from other storage areas on the opposite side of the mast (towards the aft of the ship) to the stand building equipment 1877. The stand building equipment 1877 may thus receive the pipes from the catwalk machine 1876, bring them in upright orientation, and connect them to other pieces so as to form stands. To this end the stand building equipment may comprise a mousehole through which the stand may be gradually lowered while it is made up until the lowermost end of the stand is at the lowermost level of the setback area 1812, while the uppermost end of the stand is below the drill floor level. The stands may then be received by pipe rackers 1891 and placed in the setback structure 1812 for future use. To this end the pipe rackers are operable to traverse across the setback area, e.g. in the direction parallel to the direction connecting the well centres.

The drilling rig comprises a number of slanted chutes 1892 each for feeding pipes from the setback area 1812 to one of the well centres. To this end the drilling rig may comprise one chute for each well centre position. Each chute 1892 receives pipes from one of the pipe rackers 1891 and feeds the pipes in a slanted upward direction through a corresponding slit 1785 in the drill floor towards a respective one of the well centres 3*a,b*, where they are picked up at their uppermost end by the corresponding hoisting system and lifted through the slit 1785 until they are vertically suspended above the corresponding well centre. To this end, the drilling rig further comprises pipe handling equipment 1786 operable to guide the pipes while they are being lifted through the slit 1785. The slits 1785 are elongated and point away from the axis connecting the well centres and towards the side where the setback area 1812 is positioned. To allow for the pipes to be presented in this fashion, the driller's cabin 1534 is positioned at an elevated level above the slits 1785. One or more further pipe handling devices, such as iron roughnecks 1727, may be located between neighbouring slits and underneath the driller's cabin, e.g. such that each iron roughneck may service two well centre positions.

The drilling rig comprises another storage area 1515 below the drill deck 2 and configured for storing risers in a vertical orientation. The riser storage area 1515 is located adjacent the moon pool 2122, e.g. on the side of the moon pool opposite the setback structure 1812. The risers may then be moved, e.g. by means of a gantry crane 2298 and respective chutes 2294 or other suitable pipe feeding equipment through holes 1681 in the drill deck floor. The riser feeding holes 1681 may be covered by removable plates, hatches or similar covers, as illustrated in e.g. FIGS. 13 and 15. The riser feeding holes are displaced from the axis connecting the well centres.

As the stands of tubulars and the risers are stored below the drill deck, and since the cat walk machines 1508 extend towards opposite sides from the well centres, and since the mast structure 1 is located on one side of the well centres, the drill deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment. Moreover, at least parts of the setback structure 1812 may be covered by a platform 1788 so as to provide additional storage or working area.

Turning now to FIGS. 19-22, further embodiments of the connecting tool are described. FIG. 19 shows a detail of an offshore drilling rig with a drill deck 3060. The drill deck 3060 has three work centres 3061*a/b/c*, aligned on a common axis wherein at least the work centre 3061*c* located in the middle is a well centre configured for giving access to the sea floor and equipped for drilling related operations at a subsea borehole. Preferably, also one or both of the work centres 3061*a/b* in the peripheral positions are well centres or are adapted to be operable as well centres, e.g. by moving the necessary equipment for performing drilling related operations in a subsea borehole into operation on tubulars to run through the well center. A support structure 3050 extends upwardly from the drill deck 3060. As laid out in FIG. 35-42 the support structure is preferably a mast behind the well centres but in principle surround the well centres as in a typical derrick. The first hoisting system 3040*a* operates at a vertical first hoisting axis A, and the second hoisting system 3040*b* operates at a vertical second hoisting axis B. The first and second hoisting axes A/B are laterally displaced from another and thus define a vertical common hoisting plane. Each of the hoisting systems 3040*a/b* comprises a respective load carrier 3041*a/b* travelling along the respective hoisting axes A/B. The load carriers 3041*a/b* are attached to travelling blocks 3042*a/b*, which via cables 3043*a/b* are raised or lowered by suitable means (not shown), such as traditional draw works, or cylinder hoisting systems as described above. The cables 3043*a/b* run over sheaves 3044*a/b* (in FIG. 35-42 referred to as Stationary sheaves 1433 or movable sheaves 2533 correspond to 3044*a/b* because the type of hoisting system in FIG. 19 could be that of FIG. 35 or 36) arranged at the top of the support structure 3050. The sheaves are oriented to rotate about an axis parallel to the vertical hoisting plane defined by the vertical hoisting axes A/B. This has the advantage that the hoisting systems 3040*a/b* may be operated in a side-by-side configuration, where the hoisting works may be arranged transversely displaced in a direction perpendicular to the common hoisting plane and on the same side thereof, thereby facilitating easy access on the drill deck 3060 to the areas around the work centres 3061*a/b/c*. Accordingly, such a side-by-side configuration allows also to place the support structure 3050 transversely displaced in a direction perpendicular to the common hoisting plane to improve accessibility of the working space around the work centres 3061*a/b/c* on the drill deck 3060. The load carriers 3041*a/b* suspend first and second top drives 3030*a/b*, which are further held in place (and secured against rotation) by retractable dollies (not shown) that are movable along vertical tracks on the support structure 3050. Each top drive 3030*a/b* includes a pipe handler 3020*a/b*.

The hoisting systems are coupled together by means of a connecting tool 3000 to perform operations of lowering and/or raising tubular equipment 99 through the well centre 3061*c*, which is the joint operations well centre for the combined operations. The first hoisting system 3040*a* is arranged such that the first hoisting axis A is positioned at a first lateral distance a from the joint operations well centre 3061*c*, and the second hoisting system 3040*b* is arranged such that the second hoisting axis B is positioned at a second lateral distance b from the joint operations well centre 3061*c*. A first coupling point 3005*a* of the connecting tool 3000 is suspended by the first hoisting system 3040*a*, and a second coupling point 3005*b* of the connecting tool 3000 is suspended by the second hoisting system 3040*b*. The first and second coupling points 3005*a/b* are arranged on opposite ends of a stiff frame of the connecting tool 3000. The first and second hoisting axes A/B are thus kept at a fixed distance from each other, wherein the fixed distance is determined by the connecting tool 3000. The connecting tool 3000 comprises a load bearing device 3001 arranged at a tool axis T. The tool axis T is arranged between the first and second hoisting axes A/B. The load bearing device 3001 engages the tubular equipment 99, such as a string of casing or a riser string, such that a longitudinal axis of the tubular equipment 99 is aligned with the tool axis T. When the tool axis is furthermore aligned with the joint operations well centre 3061*c*, lowering and/or raising of the tubular equipment 99 can be performed.

The coupling assembly further comprises a tubular mud handling device 3010 mounted in a mounting bracket 3006 between the first and second hoisting axes A/B, and suspended by the top drives 3030*a/b* through pivoting joints 3007 ensuring alignment with the tool axis T. The tubular mud handling device 3010 is configured for at least filling drilling mud to the inside of the tubular equipment 99 through a sealing attachment 3011, wherein a principal direction of the sealing attachment 3011 is arranged in axial alignment with the tool centre axis T.

Prior to coupling the hoisting systems 3040*a/b* together, they may separately be engaged in individual operations at respective work/well centres, e.g. located in alignment with the work/well centres at the peripheral locations 3061*a*, 3061*b*, or even aligned with the work/well centre 3061*c* at the joint operations location. In order to reconfigure the offshore drilling rig from individual operation of the hoisting systems to joint operation, the respective individual operations (if any) are disrupted; the hoisting systems 3040*a/b* are arranged such that the respective hoisting axes A/B each are spaced apart from other by a hoisting axis distance and in a horizontal direction are spaced apart from the joint operations well centre 3061*c* by respective distances a/b on either side of the joint operations well centre 3061*c*, preferably such that the joint operations well centre 3061*c* is in the hoisting plane; and the hoisting systems are coupled together by using the connecting tool 3000. Depending on the particular set-up of the drilling rig, the reconfiguration from individual to joint operation may or may not require repositioning of the hoisting axes A/B with respect to the joint operations well centre. A set-up that does not require repositioning of the hoisting axes A/B will typically have less moveable components and may therefore be less costly to build, more reliable in operation, and the design may be more easily scaled up for increased load capacity.

For example, the hoisting axes A/B as well as the three work/well centres 3061*a/b/c* may be fixed with respect to the drill deck 3060, wherein the first hoisting axis A is aligned with the first work/well centre 3061*a*, the second hoisting axis B is aligned with the second work/well centre 3061*b*, and wherein a third work/well centre, the joint operations well centre 3061*c* is located at a fixed position between the first and second work/well centres 3061*a/b*. However, to ensure safe and efficient individual operation of the hoisting systems at respective work centres or to ensure sufficient working space around the respective work centres, the hoisting axes A/B may be required to be spaced apart from each other at a minimum distance, such as at a hoisting axis distance of more than 5 m, such as more than 7 m, such as more than 10 m, or about 12 m. In a set-up with a minimum hoisting axis distance, the connecting tool connecting the two hoisting systems will therefore have to be dimensioned to sustain a corresponding span. Alternatively, in other set-ups, one or more of the well centres 3061*a/b/c* may be moveable at least in a direction parallel to the hoisting plane and/or at least one of the first and second hoisting axes A/B may moveable with respect to the well centres 3061*a/b/c*.

FIGS. 20-22 show different embodiments of the coupling assembly, where the coupling points of the connecting tool are attached at different levels of the hoisting system 3040*a/b* with top drives 3030*a/b* and associated pipe handlers 3020*a/b*. In all embodiments, the coupling assembly includes a tubular mud handling device 3110, 3210, 3310 mounted in a respective mounting bracket 3106, 3206, 3306 between the first and second hoisting axes A/B, and suspended by means of joints 3207, 3307 (not visible in FIG. 20) ensuring alignment with the tool axis T. The tubular mud handling device 3110, 3210, 3310 is configured for at least filling drilling mud to the inside of the tubular equipment 99 through a sealing attachment 3111, 3211, 3311, wherein a principal direction of the sealing attachment 3111, 3211, 3311 is arranged in axial alignment with the tool centre axis T. Drilling mud may be supplied to the tubular mud handling device 3110, 3210, 3310 through a flexible/flexing supply line 3112, 3212, 3312.

FIG. 20 shows an embodiment, where a connecting tool 3100 with first and second coupling points 3105*a/b* couples directly to the load carriers 3041*a/b* of the hoisting systems 3040*a/b* above top drives 3030*a/b*; FIG. 21 shows an embodiment, where a connecting tool 3200 with first and second coupling points 3205*a/b* couples to pipe handlers 3020*a/b* of the top drives 3030*a/b*; and FIG. 22 shows an embodiment where a connecting tool 3300 with first and second coupling points 3305*a/b* couples via a spreader beam 3315 to the pipe handlers 3020*a/b* and via tendons 3314*a/b* to the load carriers 3041*a/b* above the top drives 3030*a/b*.

As mentioned above, in many embodiments, the rig is equipped with a top drive arranged to rotate drill strings and lower them through the first well centre, wherein the top drive is arranged to be lifted by the first hoisting system. To keep the top drive from rotating a guide-dolly is typically arranged to slide along a vertically extending rail or rails while being connected to the top drive. Different constructions of the dolly system may be conceived as illustrated schematically with reference to FIGS. 23-25.

FIG. 23 shows a support structure 4050 carrying two parallel vertical rails 4034 on which a dolly 4032 may travel in a vertical direction. The dolly 4032 carries a top drive 4030. The dolly 4032 comprises a deployment mechanism 4033 that may be extended or retracted in order to bring the top drive 4030 in alignment with a well centre 4061 for performing drilling related operations. A front side of the dolly system may be defined as the side of the dolly 4032 facing towards the well centre 4061; A back side of the dolly system may be defined as the side of the dolly 4032 facing away from the well centre 4061; A position of the dolly system may be defined as the centre point O of the ensemble of vertical rails; A forward direction Dx of the dolly system may be defined as the direction from the centre point O towards the top drive 4030 and the well centre 4061; A transverse direction Dy may be defined as the horizontal direction perpendicular to the forward direction Dx.

FIG. 24 shows a support structure 4150 carrying a single vertical rail 4134 on which a dolly 4132 may travel in a vertical direction. The dolly 4132 carries a top drive 4130. The dolly 4132 comprises a deployment mechanism 4133 that may be extended or retracted in order to bring the top drive 4130 in alignment with a well centre 4161 for performing drilling related operations. A front side of the dolly system may be defined as the side of the dolly 4132 facing towards the well centre 4161; A back side of the dolly system may be defined as the side of the dolly 4132 facing away from the well centre 4161; A position of the dolly system may be defined as the centre point O of the single vertical rail 4134; A forward direction Dx of the dolly system may be defined as the direction from the centre point O towards the top drive 4130 and the well centre 4161. A transverse direction Dy may be defined as the horizontal direction perpendicular to the forward direction Dx.

FIG. 25 shows a support structure 4250 with two parts, each carrying a vertical rail 4234. A dolly 4232 is guided between the two rails 4234 for travel in a vertical direction. The dolly 4232 carries a top drive 4230 in alignment with a well centre 4261 for performing drilling related operations. A position of the dolly system may be defined as the centre point O of the ensemble of vertical rails 4234. In this embodiment, the position O of the dolly system coincides with the position of the top drive 4230 and the well centre 4261. In this embodiment, a transverse direction Dy may be defined as the horizontal direction connecting the two rails 4234, and a forward direction Dx of the dolly system may be defined as the horizontal direction perpendicular to the transverse direction Dy.

Referring now to FIGS. 26-32 different layouts for the angular orientation of two dolly systems a/b in a dual activity rig with respect to each other are now described with reference to their respective locations O(a), O(b) and forward directions Dx(a), Dx(b), as well as the corresponding transverse directions Dy(a), Dy(b). In FIGS. 26-32, the dolly systems are represented by the embodiment of FIG. 23. However, any dolly system embodiment characterised by a position O, as well as forward and transverse directions Dx, Dy are applicable accordingly.

Figure 26:
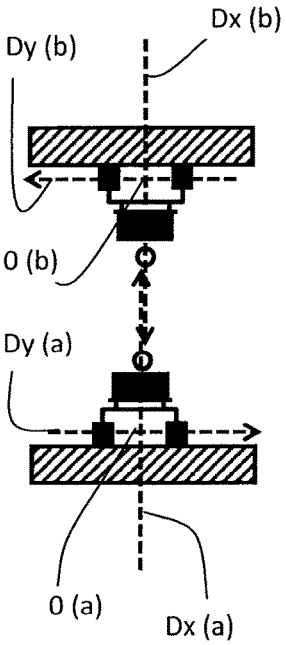
Figure 27:
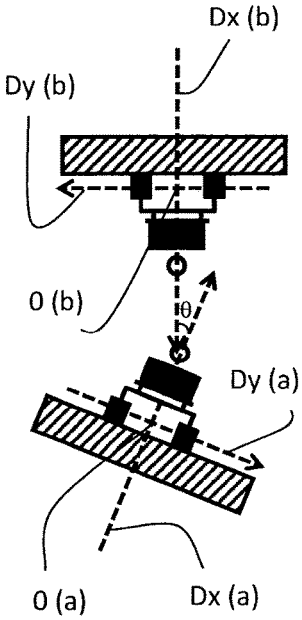
Figure 28:
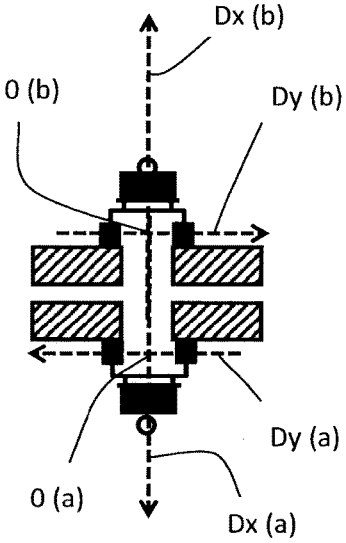
Figure 29:
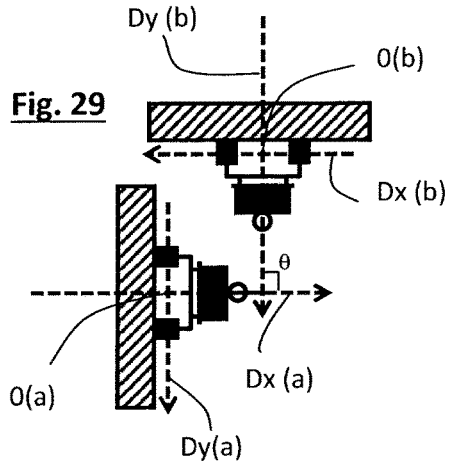
Figure 30:
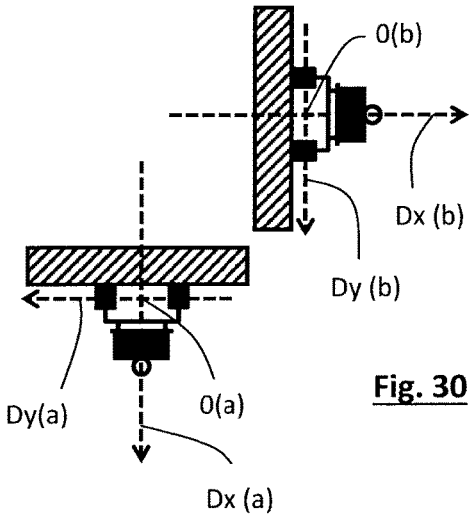
Figure 31:
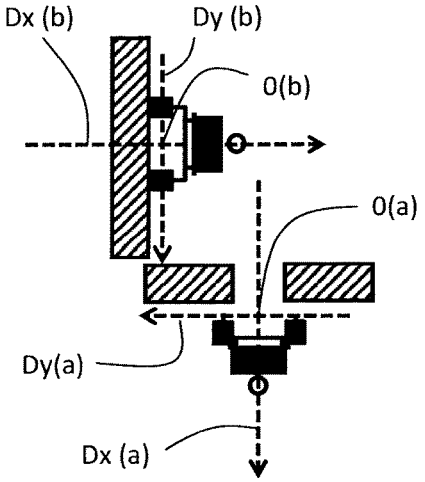
Figure 32:
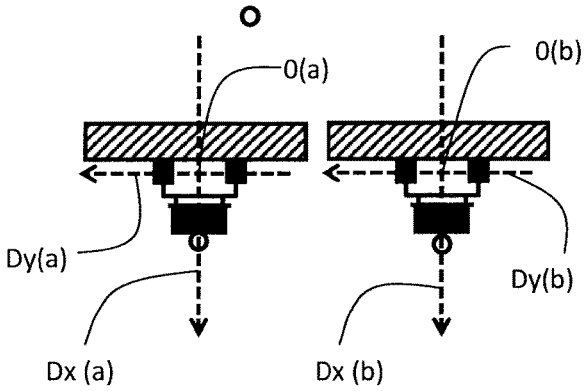

FIG. 26 shows a face-to-face configuration where the forward directions Dx(a) and Dx(b) are aligned with each other and point towards each other. The forward direction Dx(a) of the first dolly system (a) is anti-parallel with the forward direction Dx(b) of the second dolly system (b). The angle between the forward directions Dx(a), Dx(b) in this configuration may be defined as zero. FIG. 27 shows a configuration where the dolly systems a, b are oriented to face towards each other, and may therefore be described as a face-to-face "orientation". However, as compared to the face-to-face configuration of FIG. 26, the forward directions Dx(a), Dx(b) of this configuration enclose an acute angle theta. The well centres served by this angled configuration in face-to-face orientation are located between the dolly systems a, b. FIG. 28 shows a back-to-back configuration where the forward directions Dx(a) and Dx(b) are aligned with each other and point away from each other. As in FIG. 26, the forward direction Dx(a) of the first dolly system (a) is anti-parallel with the forward direction Dx(b) of the second dolly system (b), and the angle between the forward directions Dx(a), Dx(b) is zero. However, in contrast to FIG. 26, the dolly systems are arranged between the well centres served by this configuration. FIG. 29-FIG. 31 show different angled configurations, wherein the angle between the forward directions Dx(a), Dx(b) is about 90 degrees. In the configuration of FIG. 29, the dolly systems (a, b) are oriented towards each other, such that the forward directions Dx(a), Dx(b) converge to a point of intersection in front of both the dolly systems (a, b). In the configuration of FIG. 30, the dolly systems (a, b) are oriented away from each other, such that the forward directions Dx(a), Dx(b) diverge from a point of intersection located on the back side of both dolly systems (a, b). In the configuration of FIG. 31, the dolly system (b) is arranged behind dolly system (a), such that a point of intersection between the forward directions Dx(a) and Dx(b) is arranged in front of dolly system (b) and on the back side of dolly system (a). FIG. 32 shows a side-by-side configuration where the forward directions Dx(a) and Dx(b) are parallel to each other pointing in the same direction, and the transverse directions Dy(a), Dy(b) are aligned with each other, wherein the centre points O(a) and O(b) of the dolly systems ((a, b) are spaced apart from each other in a transverse direction.

FIG. 33 shows schematically a layout of a dual activity rig having a first hoisting system and a dolly system with top drive associated therewith. The dolly system may for example be of the kind shown in FIG. 23. The dual activity rig further comprises a second hoisting system (not shown). However, the second hoisting system is not equipped with a dolly system and top drive. Such a configuration may be characterised with reference to the location of the second hoisting axis with respect to the dolly system associated with the first hoisting system: a forward cooperation zone 4062 is located in a forward direction in front of the of the dolly system and top drive 4030, whereas transversely adjacent zones 4063 may be referred to as sideways cooperation zones.

FIG. 34 shows schematically an advantageous layout according to one embodiment of a dual activity drilling rig configured for individual operation at separate well centres. The dual activity rig has first and second hoisting systems that are equipped with first and second top drives guided by respective first and second dolly systems. This layout has a back-to-back configuration of first and second dollies 4332*a/b* running on respective vertical tracks 4334*a/b* attached to respective first and second portions 4350*a/b* of a common support structure to independently serve operations at the separate first and second well centres 4361*a/b*, wherein the rig may be supplied from adjacent pipe storage area 4351. In case heavy duty operations require the joint operation of both the first and second hoisting systems, they can be coupled together for joint operation through a joint operation well centre 4361*c*. To that end, the respective portions of the support structure 4350*a/b* is split such that a connecting tool according to the above described embodiments may be installed, wherein a tool axis of the connecting tool is aligned with the joint operations well centre 4361*c*. Operations at the joint operations well centre 4361*c* may be also be supplied from the adjacent pipe storage area 4351, e.g. through a respective opening/tunnel between the first and second portions of the support structure 4350*a/b*.

FIG. 35-42 corresponds to FIGS. 14-21 of co-pending PCT application PCT/EP2014/050509 except that the rig further comprises a joint operations well centre, between the two hoisting systems and reachable by hooking up connecting tool according to the invention. The numbering of features follows that of PCT/EP2014/050509 except for the joint operations well centre 3061*c*. Examples of numberings of FIGS. 35-42 and their corresponding numbers in FIG. 1-34 include:

Well centre 1423 and 2423 corresponds to 3061*a/b*

Stationary sheaves 1433 or movable 2533 correspond to 3044*a/b* because the type of hoisting system in FIG. 19 could be that of FIG. 35 or 36.

Top drives 2437 corresponds to 3030*a/b*

Mast 1404 or 2404 corresponds to 3050

Other correspondences will be clear to the skilled person.

FIG. 35 illustrates another embodiment of an offshore drilling rig. The drilling rig of FIG. 35 is a drillship having a hull 1401. The drilling rig comprises a drill floor deck 1407 formed on top of a substructure 1497. The substructure comprises a platform supported by legs. The platform defines the drill floor deck and spans across a moon pool formed in the hull of the drillship. The drill floor deck 1407 comprises two holes defining well centres 1423 (referred to as 3061*a/b* in FIG. 19) located next to a dual activity mast 1404. The rig also comprises a joint operations well centre 3061*c* which can be reach by hooking a connecting tool to the two hoisting system (e.g. directly to the hook and/or to either of the top drives). The direction intersecting with both well centres defines a transverse direction which, in this case, is parallel with a longitudinal axis of the drillship. The dual activity mast 1404 is supported by the substructure 1497 and extends upwardly from the drill floor deck 1407. The mast comprises two mast portions arranged side by side in the transverse direction such that they are both located on the same side relative to the well centres. Each mast portion accommodates a hoisting system, each for lowering a drill string through a respective one of the well centres 1423 towards the seabed. In the example of FIG. 35, the hoisting system is a draw-works system where the hoisting line is fed over stationary sheaves 1433 carried by support members. The drawworks motor/drum (not shown) may be positioned at a suitable location on the drilling rig. Alternatively, other hoisting systems such as a hydraulic hoisting system may be used, as will be illustrated below. Each well centre is located next to one of the mast portions and the corresponding hoisting system. The position of each of the well centres relative to the corresponding hoisting system defines a longitudinal direction, in this example the transverse direction of the drill ship.

The side-by-side configuration of the dual activity mast and well centres allows for efficient dual operations, easy access to both well centres, and convenient visual control of both well centres from a single driller's cabin 1434 which may e.g. be positioned symmetrically relatively to the well centres but displaced from the axis connecting the well centres, e.g. within the footprint of the mast. The driller's cabin may be split up into two or more cabins.

The drilling rig comprises a setback structure 1412 or similar pipe storage structure for storing stands of tubulars such that the stored tubulars are located partly or completely below the level defined by the drill floor deck, i.e. below the uppermost platform of the substructure 1497 and partly covered by the drill floor deck 1407. The setback structure comprises a support framework supporting fingerboards having horizontally extending fingers between which tubulars may be stored. The setback structure is positioned and arranged so as to allow stands to be moved to/from both well centres from/to the setback. To this end, on or more column rackers or similar vertical pipe handling equipment may be arranged to move stands into and out of the setback structure 1412. The handling of tubulars to and from the setback area 1412 will be illustrated in more detail in connection with the embodiments described below. In some embodiments, e.g. in case of stands of drill pipe or casings, the tubulars may be taller than the drill floor. Hence, when they are stored in the setback structure in an upright orientation their uppermost ends may extend above the drill floor level. When feeding them to one of the well centres they may be laid into a chute as will be described below. Alternatively, the setback structure may extend from the drill floor deck upwards. The handling of tubulars within the setback area may be performed by vertical pipe rackers or the like. The setback structure 1412 further comprises stand building equipment 1477 configured to build stands from individual pieces of pipe. An example of such stand building equipment is described in WO 02/057593. Alternatively or additionally, stands may be built on the drill floor.

In some embodiments, each mast portion and hoisting system form a respective gap between the two support members that carry the sheaves 1433, through which gap tubular equipment is movable between the setback structure 1412 towards the respective well centres.

Optionally, the drilling rig further comprises a pipe storage area 1409 for storing pipes in horizontal orientation located towards the bow of the drillship, i.e. transversely displaced from the well centres. One or more catwalk machines 1408 or similar horizontal pipe handling equipment are arranged to feed tubulars from the storage area 1409 or from other storage areas to the well centres. To this end, the catwalk machines are aligned with the axis defined by the two well centres. These catwalk machines 1408 and one or more stores for (e.g. 1409) or aft (not shown) may be used in combination or as an alternative to having riser 1415 stored below the drill deck. In the embodiment of FIG. 35 the catwalk machines 1408 may be used to provide additional riser joints, load the riser storage below the drill deck and/or to provide the drill floor with other tubulars. One or each of the catwalk machines may be operable to service both well centres. Moreover the drilling rig comprises one or more further catwalk machines travelling on tracks 1476 and configured to feed tubulars from the pipe storage area 1409 or from other storage areas on the opposite side of the mast (towards the aft of the ship) to the stand building equipment 1477. The catwalk machine(s) travelling on tracks 1476 is/are configured to travel along a direction parallel with the catwalk machines 1408, but on the other side of the mast. In the present embodiment, one or more catwalk machines may be operable to travel along a substantial portion of the length of the drillship. It will be appreciated that, in some embodiments, each catwalk machine may be configured to only travel to/from the stand building equipment 1477 without being configured to pass the stand building equipment. Consequently, the drilling rig may comprise two catwalk machines travelling on tracks 1476 on respective sides of the stand building equipment so as to be able to feed tubulars to the stand building equipment from both sides. The stand building equipment 1477 may thus receive pipes from the catwalk machine on tracks 1476, bring them in upright orientation, and connect them to other pipes as to form stands. The stands may then be placed in the setback structure for future use.

The drilling rig comprises another storage area 1415 below the drill floor deck 1407 and configured for storing risers in a vertical orientation. The risers may then be moved, e.g. by means of a gantry crane and respective chutes or other suitable pipe feeding equipment through holes in the drill floor, as will be described in more detail in connection with the description of the further embodiments below.

As the mast structure 1404 is located on one side of the well centres, and since the setback area is located on the side of the mast opposite the well centres and/or behind the driller's cabin 1434, the drill floor deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment. Generally, riser joints and/or other tubulars may be tilted between an upright and a horizontal orientation by a tilting apparatus as described in co-pending Danish patent application no. PA 2013 00302, the entire contents are hereby included herein by reference.

FIGS. 36-42 show another embodiment of a drilling rig, in this example of drillship having a hull 2501, similar to the drilling rig of FIG. 35 but with a different mast structure and hoisting system. In particular, FIGS. 36 and 37 show 3D views of the drill floor seen from the starboard and port sides of the drillship, respectively (a part of the hull of the ship is cut away in FIG. 37); FIGS. 38 and 39 show horizontal cross sections in a plane above the drill floor and a plane below the drill floor, respectively; FIGS. 40 and 41 show lateral cross sections of the drill ship. Finally, FIG. 42 shows another 3D view of the drill floor seen from the starboard side of the drillship.

As in the example of FIG. 35, the drilling rig of the present embodiment comprises a drill floor deck 2407 formed on top of a substructure 2897. The substructure comprises a platform supported by legs. The platform defines the drill floor deck and spans across a moon pool 2722 formed in the hull of the drillship. The drill floor deck 2407 comprises two holes defining well centres 2423 (referred to as 3061*a/b* in FIG. 19), one or both being equipped with a diverter housing. The rig also comprises a joint operations well centre 3061*c* which can be reach by hooking a connecting tool to the two hoisting system (e.g. directly to the hook and/or to either of the top drives). The mast includes two mast portions, each associated with, and adjacent to, one of the well centres. In the present example, the well centres are located outside the footprint of the mast 2404 as described in detail in connection with FIG. 14. As in the previous embodiments, the direction between each well centre and the associated hoisting system defines a longitudinal direction. In this example, the direction intersecting with both well centres defines a transverse direction which, in this case, is parallel with a longitudinal axis of the drillship. The dual activity mast 2404 is supported by the substructure 2897 and extends upwardly from the drill floor deck 2407. Each mast portion accommodates a respective hydraulic hoisting system each for lowering a drill string through a respective one of the well centres 2423 towards the seabed. Each hydraulic hoisting system comprises cylinders 2406, respectively, that extend upwardly from the drill floor deck and support the load to be lowered or hoisted. Each well centre is located next to one of the mast portions and the corresponding hoisting system; both well centres are located on the same side relative to the mast, i.e. in a side-by-side configuration.

The cylinders 2406 of each hoisting system are arranged in two groups that are positioned displaced from each other in the transverse direction so as to form a gap between the two groups. Each gap is thus aligned with a respective one of the well centres along the longitudinal direction and is shaped and seized so as to allow tubulars to be moved through the gap towards the respective well centre and even raised into an upright position while being located at least partly in the gap between the cylinders. The exact shape, size and location of the gap may depend on the type of tubular to be fed through the gap, e.g. whether the gap is to be used for feeding drill pipes, casings and/or riser through the gap. The well centre is longitudinally displaced from the gap. The rods of the cylinders support respective sheaves 2533, e.g in the form of a sheave cluster, over which the hoisting wires 2484 are suspended. The cable sheaves 2533 define an axis that is parallel to the direction connecting the two groups of cylinders of one of the hoisting systems. One end of the hoisting wires 2484 is anchored to the drilling rig, while the other end is connected to top drive 2437 or hook of the corresponding hoisting system, via a travelling yoke 2187. The sheaves 2533 are laterally supported and guided by the respective mast portions. Each top drive 2437 is connected via a dolly 2569 to a vertical track arranged at the mast 2404. The fixed ends of the hoisting wires are anchored via a yoke 2482 and respective sets of deadline compensators 2483. The compensators 2483 are also arranged in two groups so as to form a gap over which the yoke 2482 extends. Hence, tubulars can pass through the gap between the compensators 2483 and below the yoke 2482.

The side-by-side configuration of the dual activity mast and well centres allows efficient dual operations, easy access to both well centres, and convenient visual control of both well centres from a single driller's cabin 2433 which may e.g. be positioned transversely between the well centres, e.g. within the footprint of the mast.

The drilling rig further comprises a pipe storage area 2509 for storing pipes in horizontal orientation and catwalk machines 2508 or other horizontal pipe handling equipment for transporting pipes between the storage area 2509 and the well centres 2423, also as described in connection with FIG. 35.

The drilling rig comprises a setback structure 2512 or similar pipe storage structure for storing stands of tubulars below the substructure 2897 and partly covered by the drill floor deck 2407. The setback structure comprises a support framework 2590 supporting fingerboards having horizontally extending fingers between which tubulars may be stored. One or more column rackers 2491 or similar vertical pipe handling equipment may be arranged to move stands into and out of the setback structure 2512. The setback structure 2512 further comprises stand building equipment 2677 configured to build stands from individual pieces of pipe through a foxhole 2592. The setback structure 2512 is located adjacent the moon pool 2722 laterally displaced from the axis defined by the well centres.

Moreover the drilling rig comprises one or more further catwalk machines (not shown) configured to feed tubulars from the pipe storage area 2509 or from other storage areas on the opposite side of the mast (towards the aft of the ship) to the stand building equipment 2677, all as described in connection with FIG. 35. The stand building equipment 2677 may thus receive the pipes from the catwalk machine, bring them in upright orientation, and connect them to other pieces so as to form stands. To this end the stand building equipment may comprise a mousehole 2589 through which the stand may be gradually lowered while it is made up until the lowermost end of the stand is at the lowermost level of the setback area 2512, while the uppermost end of the stand is below the drill floor level. The stands may then be received by pipe rackers 2491 and placed in the setback structure 2512 for future use. To this end the pipe rackers are operable to traverse across the setback area, e.g. in the direction parallel to the direction connecting the well centres.

The drilling rig comprises a number of slanted chutes 2592 each for feeding pipes from the setback area 2512 to one of the well centres. Each chute 2592 receives pipes from one of the pipe rackers 2491 feeds the pipes in a slanted upward direction through a corresponding slit 2485 in the drill floor and through the gap formed by the cylinders 2406 of the corresponding hoisting system towards a respective one of the well centres 2423, where they are picked up at their uppermost end by the corresponding hoisting system and lifted through the slit 2485 until they are vertically suspended above the corresponding well centre. To this end, the drilling rig further comprises pipe handling equipment operable to guide the pipes while they are being lifted through the slit 2485. The slits 2485 are elongated and point away from the axis connecting the well centres and towards the side where the setback area 2512 is positioned.

The drilling rig comprises another storage area 2515 below the drill floor deck 2507 and configured for storing risers in a vertical orientation, as described in connection with FIG. 35. The riser storage area 2515 is located adjacent the moon pool 2722, e.g. on the side of the moon pool opposite the setback structure 2512. The risers may be moved, e.g. by means of a gantry crane and respective chutes 2794 or other suitable pipe feeding equipment through holes 2481 in the drill deck floor. The riser feeding holes 2481 may be covered by plates, hatches or similar covers. In FIG. 36, the holes are shown in the open position with the uppermost end of a riser extending through the open hole. The riser feeding holes are displaced from the axis connecting the well centres.

As in the previous example, in the embodiments of FIGS. 35-42 a main deck is located beneath the drill floor deck and allows heavy subsea equipment, e.g. BOPS and Christmas trees to be moved to the moon pool under the well centres so as to allow such equipment to be lowered toward the seabed. Consequently, the drill floor deck and, in particular, the part of that drill floor deck that is located in close proximity to the well centre may be stationary and does not need to be hoisted or lowered for the subsea equipment to be lowered to the seabed.

As the stands of tubulars and the risers are stored below the drill floor deck, and since the catwalk machines 2508 extend towards opposite sides from the well centres, and since the mast structure 2404 is located on one side of the well centres, the drill floor deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment. In particular, when no riser operations are performed, the holes 2481 may be covered or otherwise secured. Moreover, at least parts of the setback structure 2512 may be covered by a platform so as to provide additional storage or working area.

Even though the embodiments of FIGS. 35-42 have been described in the context of a drillship, it will be appreciated that the described features may also be implemented in the context of a semi-submersible or other type of drilling rig. In particular, storage of risers and/or other tubulars below the drill floor deck may be implemented on other types of drilling rigs as well.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore drilling rig configured for lowering and/or raising a string of tubular equipment into a subsea borehole, the drilling rig comprising:

a drill deck;

a first hoisting system being adapted for raising or lowering a first load carrier along a vertical first hoisting axis, wherein the first hoisting system is supported by a first support structure extending upwardly relative to the drill deck and adapted for individual operation at a first work centre in the drill deck at said first hoisting axis;

a second hoisting system being adapted for raising or lowering a second load carrier along a vertical second hoisting axis spaced apart from the first hoisting axis, wherein the second hoisting system is supported by a second support structure, that is separate from or common with said first support structure, extending upwardly relative to the drill deck and adapted for individual operation at a second work centre in the drill deck at said second hoisting axis;

a joint operations well centre on the drill deck, wherein the first and second hoisting systems are configured for operating in conjunction over the joint operations well centre, wherein the first and second hoisting axes during joint operations are located apart from the joint operations well center and the positions of the first and second hoisting axes are fixed with respect to the drill deck.

2. An offshore drilling rig according to claim 1, wherein the joint operations well centre is the first well centre or the second well centre.

3. An offshore drilling rig according to claim 1, wherein the joint operations well centre is a third well centre different from the first and second well centres.

4. An offshore drilling rig according to claim 3, wherein the positions of the first, second and third well centres are fixed with respect to the drill deck.

5. An offshore drilling rig according claim 1, wherein at least one well centre is movable with respect to the drill deck.

6. An offshore drilling rig according to claim 5, wherein the movable well centre is the joint operations well centre.

7. An offshore drilling rig according to claim 1 wherein the first and second hoisting systems are arranged in a side-by-side configuration.

8. An offshore drilling rig according to claim 1, further comprising a connecting tool comprising a load bearing device adapted for suspending tubular equipment in axial alignment with a vertical tool axis of the connecting tool, wherein the first and second hoisting axes during joint operations are coupled together by means of the connection tool such that the tool axis is located spaced apart from the first and second hoisting axes and in alignment with the joint operations well centre.

9. An offshore drilling rig according to claim 8, wherein the tool axis is located between the first and second hoisting axes.

10. An offshore drilling rig according to claim 8, wherein the connecting tool has coupling points at which it is coupled to the hoisting systems, wherein first coupling points of the connecting tool are coupled to first elements of the drilling rig that are vertically moveable with respect to the drill deck by means of and/or in conjunction with the first hoisting system, wherein said vertically moveable first elements comprise one or more of a first load carrier of the first hoisting system, a first dolly that is vertically moveable attached to the first support structure, and a first top drive suspended by the first hoisting system and attached to the first support structure via the first dolly.

11. An offshore drilling rig according to claim 8, wherein second coupling points of the connecting tool are coupled to second elements of the drilling rig that are vertically moveable with respect to the drill deck by means of and/or in conjunction with the second hoisting system, wherein said vertically moveable second elements comprise one or more of a second load carrier of the second hoisting system, a second dolly that is vertically moveable attached to the second support structure, and a second top drive suspended by the second hoisting system and attached to the second support structure via the second dolly.

12. An offshore drilling rig according to claim 8, wherein the connecting tool further comprises a tubular mud handling device configured for at least filling drilling mud to the inside of the tubular equipment through a sealing attachment, wherein a principal direction of the sealing attachment is arranged in axial alignment with the tool axis.

13. An offshore drilling rig according to claim 12, wherein the sealing attachment is an axial press-fit seal applied in the direction of the tool axis.

14. An offshore drilling rig according to claim 12, wherein the tubular mud handling device is attached to the connecting tool.

15. An offshore drilling rig according to claim 14, wherein the tubular mud handling device is attached to the connecting tool by means of a gimbal mount.

16. An offshore drilling rig according to claim 15, further comprising at least one top drive suspended from one of the load carriers.

17. An offshore drilling rig according to claim 16, wherein a mud handling system of the top drive is operatively coupled to the tubular mud handling device via a flexing/flexible fluid connection.

18. An offshore drilling rig according to claim 8, wherein the connecting tool further comprises a swivel device (or is adapted to receive a swivel device) so the connecting tool allows for rotation around a vertical swivel axis of a load suspended in the load bearing device.

19. An offshore drilling rig according to claim 18, wherein the connecting tool and/or the swivel device comprises a rotary actuator for driving the rotation about the swivel axis.

20. An offshore drilling rig according to item 19, wherein the rotary actuator comprises an electrical or hydraulic motor.

21. An offshore drilling rig according to claim 18, further comprising at least one top drive suspended from one of the load carriers wherein the top drive is operatively coupled to the swivel device so as to drive the swivel rotation and/or wherein the top drive is operatively coupled to the link tilt device so as to drive the link tilt action.

22. An offshore drilling rig according to claim 8, wherein the connecting tool further comprises a link tilt device adapted for tilting the load bearing device at least about a horizontal tilt axis.

23. A method of lowering and/or raising a string of tubular equipment into a subsea borehole through a joint operations well centre in a drill deck of an offshore drilling rig according claim 1, the method comprising providing a first hoisting system for raising or lowering a first load carrier along a vertical first hoisting axis, wherein the first hoisting system is supported by a first support structure and adapted for individual operation at a first work centre in the drill deck at said first hoisting axis;

providing a second hoisting system for raising or lowering a second load carrier along a vertical second hoisting axis, wherein the second hoisting system is supported by a second support structure, that is separate from or common with said first support structure, and adapted for individual operation at a second work centre in the drill deck at said second hoisting axis;

wherein the first and second hoisting axes are laterally displaced from another by a hoisting axis distance and fixed relative to the drill deck;

operatively coupling the first and second hoisting systems by means of a connecting tool, wherein the connecting tool comprises a load bearing device located at a vertical tool axis of the connecting tool, and wherein the tool axis is spaced apart from the first and second hoisting axes;

engaging the tubular equipment by the load bearing device, and lowering/raising the tubular equipment when the tool axis is aligned with the joint operations well centre.

24. The method according to claim 23, wherein the tool axis is located between the first and second hoisting axes.

25. The method according to claim 24, wherein providing the first and second hoisting systems include positioning the first and second hoisting axes with respect to the joint operations well centre.

26. The method according to claim 23, wherein the first and second hoisting systems are operated in a side-by-side configuration.

27. The method according to claim 26, wherein the fixed distance is at least partially determined by the connecting tool.

28. The method according to claim 23, wherein the distance between the first and second hoisting axes at least during the step of lowering/raising the tubular equipment is larger than 5 m.

29. The method according to claim 23, wherein the joint operations well centre at least during the step of lowering/raising the tubular equipment is located between the first and second hoisting axes.

30. The method according to claim 29, wherein said drilling through the first well centre is through a drilling riser connected to the first well centre operably to guide return mud from the drilling process back to the drilling rig.

31. The method according to claim 23, further comprising a) drilling a section of a well into the seabed through the first well centre;

b) hooking up the connecting tool;

c) running a string of casing through the joint operations well centre via the first and second hoisting systems in collaboration.

32. The method according to claim 31, further comprising subsequently drilling a further section through the first or second well centre.

33. The method according to claim 31, comprising building (making up) at least part of the string of casing in the first well centre.

34. The method according to claim 33, comprising hanging off the string of casing and/or landing string in one or more of a blow-out preventer connected to the well, the top section of the riser connected to the first well centre during said drilling of the section of the well or in the rotary table of the movable well centre.

35. The method according to claim 31, comprising running the string of casing at least part of the way to the seabed in the first well centre.

36. The method according to claim 31, further comprising shifting said riser to the joint operations well centre located between the first well centre and the second work centre.

37. The method according to claim 36, wherein said shifting comprises moving the first well centre such as into alignment with the tool axis of the connecting tool whereby said first well centre acts as the joint operation well centre.

38. The method according to claim 36, wherein said shifting comprises disconnecting the riser from the first well centre, skidding the riser below the drill floor and connecting the riser to the joint well centre.

39. The method according to claim 23, wherein the distance between the first and second hoisting axes at least during the step of lowering/raising the tubular equipment is larger than 12 m.

* * * * *